US012650282B2

(12) United States Patent
McKelvain et al.

(10) Patent No.: US 12,650,282 B2
(45) Date of Patent: Jun. 9, 2026

(54) OPTICS MOUNTING SYSTEM FOR A FIREARM

(71) Applicant: HS Produkt D.O.O., Karlovac (HR)

(72) Inventors: Benjamin Boyd McKelvain, Geneseo, IL (US); Peter Pigatti, Davenport, IA (US); Dubravko Jagunić, Ozalj (HR); Alexander S. Joseph, Geneseo, IL (US)

(73) Assignee: HS Produkt D.O.O., Karlovac (HR)

( * ) Notice: Subject to any disclaimer, the term of this patent is extended or adjusted under 35 U.S.C. 154(b) by 0 days.

(21) Appl. No.: 19/069,377

(22) Filed: Mar. 4, 2025

(65) Prior Publication Data

US 2025/0224210 A1 Jul. 10, 2025

Related U.S. Application Data

(63) Continuation-in-part of application No. PCT/IB2024/054160, filed on Apr. 29, 2024, which is a continuation-in-part of application No. PCT/HR2023/000006, filed on Apr. 28, 2023, application No. 19/069,377, filed on Mar. 4, 2025 is (Continued)

(51) Int. Cl.

| | |
|---|---|
| ***F41G 11/00*** | (2006.01) |
| ***F41A 3/66*** | (2006.01) |
| ***F41G 1/30*** | (2006.01) |

(52) U.S. Cl.

CPC ..... *F41G 11/001* (2013.01); *F41A 3/66* (2013.01); *F41G 1/30* (2013.01)

(58) Field of Classification Search

CPC ..... F41G 11/001; F41G 11/003; F41G 1/30
See application file for complete search history.

(56) References Cited

U.S. PATENT DOCUMENTS

| | | | | |
|---|---|---|---|---|
| 6,327,806 | B1 * | 12/2001 | Paige | F41G 1/30 42/130 |
| 8,832,983 | B1 * | 9/2014 | Wolf | F41G 1/00 42/76.01 |
| 9,506,726 | B2 * | 11/2016 | Wolf | F41G 1/26 |

(Continued)

FOREIGN PATENT DOCUMENTS

| | | |
|---|---|---|
| AT | 15586 U1 | 3/2018 |
| WO | WO 2023249525 A1 | 12/2023 |

OTHER PUBLICATIONS

Badger Ordinance, Condition One Accessories, Retrieved Apr. 21, 2023 https://www.badgerordnance.com/shop/condition-one-mounts/condition-one-accessories.html.

(Continued)

*Primary Examiner* — Joshua E Freeman
(74) *Attorney, Agent, or Firm* — Woodard, Emhardt, Henry, Reeves & Wagner, LLP

(57) ABSTRACT

A slide for a firearm includes a top surface and an optical sight mounting surface recessed into the top surface of the slide. At least one pin opening is defined through a portion of the optical sight mounting surface and is configured to receive a pin for attaching an optical sight to the slide. At least one sight attachment opening is defined through the optical sight mounting surface to serve as another connection point for the optical sight. The pin opening and the sight attachment opening allow the optical sight to be attached directly to the slide of the firearm.

21 Claims, 46 Drawing Sheets

Related U.S. Application Data a continuation-in-part of application No. PCT/HR2023/000006, filed on Apr. 28, 2023.

(60) Provisional application No. 63/513,350, filed on Jul. 12, 2023, provisional application No. 63/499,256, filed on Apr. 30, 2023.

(56) References Cited

U.S. PATENT DOCUMENTS

| | | | | |
|---|---|---|---|---|
| 10,024,628 | B2 | 7/2018 | Toner et al. | |
| 10,876,815 | B1 | 12/2020 | Wingfield | |
| 11,002,517 | B1 * | 5/2021 | Holly | F41G 1/30 |
| 11,067,348 | B1 * | 7/2021 | Ribic | F41G 1/30 |
| 11,067,362 | B1 * | 7/2021 | Chin | F41G 1/30 |
| 11,112,214 | B2 | 9/2021 | Niswander et al. | |
| 12,253,333 | B2 * | 3/2025 | Planck | F41G 1/30 |
| 2008/0216379 | A1 * | 9/2008 | Javorsky | F41G 1/345 42/115 |
| 2014/0230305 | A1 * | 8/2014 | Zimmer | F41C 3/00 42/111 |
| 2015/0241175 | A1 * | 8/2015 | Wolf | F41G 11/005 42/124 |
| 2018/0087871 | A1 * | 3/2018 | Toner | F41G 1/16 |
| 2019/0049217 | A1 * | 2/2019 | Costet | F41G 1/16 |
| 2020/0025520 | A1 * | 1/2020 | Niswander | F41G 11/003 |
| 2021/0222970 | A1 | 7/2021 | Ribic et al. | |
| 2021/0222978 | A1 | 7/2021 | Bachstein et al. | |
| 2021/0254933 | A1 * | 8/2021 | Langdon | F41A 3/66 |
| 2021/0270572 | A1 * | 9/2021 | Dawson, Jr. | F41G 11/001 |
| 2021/0318099 | A1 * | 10/2021 | Holly | F41G 11/002 |
| 2022/0136801 | A1 * | 5/2022 | Niswander | F41G 11/001 42/111 |
| 2023/0011632 | A1 * | 1/2023 | Salinas | F41A 21/36 |
| 2023/0341213 | A1 | 10/2023 | Lee et al. | |

OTHER PUBLICATIONS

Midwest Gun Works, FN 509 Tactical Red Dot Mounting Kit, Retrieved Apr. 18, 2023 https://www.midwestgunworks.com/page/mgwi/prod/66-100370.

Roe, J., "MR920: How to Mount your Optic (Optic Ready Slides Only)", Shadow Systems Corp, May 3, 2020; Retrieved Apr. 18, 2023 https://shadowsystemscorp.com/mr920-how-to-mount-your-optic-optic-ready-slides-only/.

Strike Industries, Strike Slide for Glock™ G17 or G19 GEN3, retrieved from the Internet Dec. 4, 2025: https://www.strikeindustries.com/si-g-slide.html.

Tactical Supply, Condition One Modular Mount, Retrieved Apr. 21, 2023 https://ustacticalsupply.com/conditiononemodularmount.aspx.

* cited by examiner

OPTICS MOUNTING SYSTEM FOR A FIREARM

CROSS-REFERENCE TO RELATED APPLICATION

This application is a continuation of International Application No. PCT/IB2024/054160 filed Apr. 29, 2024, which claims the benefit of International Application No. PCT/HR2023/000006 filed Apr. 28, 2023, and U.S. Provisional Application No. 63/499,256 filed Apr. 30, 2023, and U.S. Provisional Application No. 63/513,350 filed Jul. 12, 2023 the entire disclosures of which are hereby incorporated by reference.

BACKGROUND OF THE INVENTION

The present invention pertains generally to firearms and, in particular aspects, to a system for mounting an optical sight for a firearm.

To improve accuracy and/or allow for a user to aim a firearm, an optical sight may be added to the firearm. Popular optical sights include the Trijicon RMR®, the Shield Sights RMSc, and the Leupold Deltapoint® Pro. However, different mounting assemblies are needed to attach these optical systems to a firearm. Therefore, there remains a need for improvement in this field.

SUMMARY OF THE INVENTION

A firearm may include a frame and a slide positioned atop said frame. The slide may include a slide top surface, and an optical sight mounting portion on said slide top surface. In some examples, the optical sight mounting portion may be recessed into said slide top surface. The optical sight mounting portion may include an optical sight mounting surface. At least one first pin opening may be defined through said optical sight mounting surface. If there are more than one first pin openings, the first pin openings may be aligned along a width of said optical sight mounting surface. At least one second pin opening may be defined through said optical sight mounting surface. If there are more than one second pin openings, the second pin openings may be aligned along a width of said optical sight mounting surface.

A first optical sight may be attachable to said slide top surface. The first optical sight may include at least one pin recess defined through a bottom surface of said optical sight. Each of said at least one first pin openings may be positioned to receive a first optical sight pin for securing the first optical sight to said slide top surface. Each of said at least one second pin openings may be positioned to receive a second optical sight pin for securing a second optical sight to said slide top surface.

At least one first pin recess may be defined through the bottom surface of said first optical sight, and the first pin recess may be aligned with said at least one first pin opening so that the first optical sight pin is positioned within said first pin recess and said first pin opening when said first optical sight is positioned on said slide top surface. The first optical sight may cover each of said at least one second pin openings when said first optical sight is positioned on said slide top surface.

At least one first sight attachment opening may be defined through said optical sight mounting surface. Additionally, at least one first connection opening may be defined through the bottom surface of said first optical sight. Each of said at least one first sight attachment openings may be positioned to receive a first optical sight connector for securing the first optical sight to said slide top surface. An optical sight connector may be configured to fit within one of said at least one first sight attachment openings defined through said optical sight mounting surface and one of said at least one connection openings defined through said optical sight to secure said slide to said optical sight mounting surface.

At least one plate attachment opening may be defined through said optical sight mounting surface of said slide, wherein each of said at least one plate attachment openings are threaded. If there are more than one plate attachment openings, the plate attachment openings may be aligned along a width of said optical sight mounting surface. Each of said at least one plate attachment openings may be positioned rearward of each of said at least one first pin openings and forward of each of said at least one second pin openings.

In some examples, when a first optical sight is positioned on said optical sight mounting surface, a first optical sight pin may be positioned in each of said at least one first pin openings and of said at least one second pin openings is empty. Likewise, when a second optical sight is positioned on said optical sight mounting surface, a second optical sight pin may be positioned in each of said at least one second pin openings and each of said at least one first pin openings is empty.

In some instances, at least one second sight attachment opening may be defined through said optical sight mounting surface. Each of said at least one second sight attachment openings may be positioned to receive a second optical sight connector for securing the second optical sight to said slide top surface. In some examples, more than one second sight attachment openings may be defined through said optical sight mounting surface, and the second sight attachment openings may be aligned along a width of said optical sight mounting surface.

In some examples, each of said at least one first pin openings are positioned forward of each of said at least one first sight attachment openings. Additionally, each of said at least one first pin openings may be positioned forward of each of said at least one second pin openings. In some examples, each of the second pin openings may be positioned rearward of said pair of second sight attachment openings on said optical sight mounting surface.

A method may comprise inserting a first connection pin into a first pin opening defined through an optical sight mounting surface on a top surface of a slide of a firearm. A first optical sight may be placed on said optical sight mounting surface. In some examples, the first optical sight may be mounted directly on said top surface of said slide. A first pin recess defined through a surface of said first optical sight may be aligned with said first pin opening defined through said optical sight mounting surface so that said connection pin is at least partially inserted into said first pin recess. An optical sight connector may be inserted through a first sight connection opening defined through said first optical sight and into an aligned first sight attachment opening defined through said optical sight mounting surface to secure said first optical sight to said top surface of said slide. The first optical sight covers a second pin opening defined through said optical sight mounting surface when said first optical sight is positioned on said top surface of said slide. The second pin opening may be configured to receive a second connection pin for securing a second optical slide to said top surface of slide.

The optical sight mount may be integral to a portion of the firearm (e.g., the slide) or a separate component attachable to the firearm (e.g., an optics mounting plate). The optical sight mount includes an optical sight mounting surface. A pin opening may be defined by the optical sight mounting surface. A connection pin is configured to fit within the pin opening and includes a pin body. The connection pin is movable (e.g., rotation and/or translation) from a first position to a second position within the pin opening. An optical sight including a pin recess defined by a bottom surface of the optical sight has at least a portion of the pin recess positioned over the pin opening when the optical sight is positioned on the optical sight mounting surface. A portion of the connection pin is positioned within the pin recess of the optical sight when the optical sight is positioned on the optical sight mounting surface. And when the connection pin is in the first position, forcing the optical sight towards the optical sight mounting surface, such as by tightening an optical sight connector, moves the connection pin from the first position into the second position. When in the second position, the connection pin applies a force to the optical sight along a direction parallel to the optical sight mounting surface and/or to a plane defined by the optical sight mounting surface. The connection pin may rotate and/or translate relative to the optical sight mounting surface when moving from the first position to the second position. The connection pin may provide a mechanical advantage to apply a greater force to the optical sight along a direction parallel to the optical sight mounting surface/plane than a force applied to the connection pin along a direction orthogonal to the optical sight mounting surface/plane. The connection pin may be separate from an optical sight connector extending through the optical sight an into the optical sight mounting surface and configured to force the optical sight towards the optical sight mounting surface. The connection pin may not be accessible from a top side of the optical sight when the optical sight is mounted on the optical sight mount, the top side being opposite the bottom surface of the optical sight. A portion of the connection pin that applies a force to the optical sight along a direction parallel to the optical sight mounting surface may rise to a greater height above a bottom surface of the pin than a top surface of the connection pin that contacts the optical sight in the first position. The top surface of the connection pin may be positioned above the optical sight mounting surface in the first position when the optical sight is spaced from the optical sight mounting surface and not contacting the connection pin. The connection pin may rotate about a pivot point relative to the optical sight mounting surface when moving from the first position to the second position. The portion of the connection pin that applies a force to the optical sight along a direction parallel to the optical sight mounting surface may be closer to the pivot point than the top surface of the connection pin that contacts the optical sight in the first position.

A firearm may include a frame and a slide. The slide may be positioned atop the frame so that the slide may move along a length of the frame. A barrel is supported within the slide. The firearm also includes a trigger assembly that is housed within the frame and a trigger guard that at least partially surrounds the trigger assembly. An optical sight may be attached to the slide at an optical sight mount. The optical sight mount may be removable from the slide. Alternatively, the optical sight mount may be integral to the slide.

The optical sight has a top surface and a bottom surface and one or more openings and recesses defined by the bottom surface that assist to secure the optical sight to the optical sight mount. One or more connection openings may extend through the bottom surface of the optical sight and, optionally, through the top surface. The connection openings may receive a connector, such as a threaded screw, that forces the optical sight towards the optical sight mount of the firearm.

The optical sight may have one or more forward pin recesses that are defined by the bottom surface. The forward pin recesses may only extend through a portion of the optical sight and not through the top surface. The forward pin recesses may be configured to receive a connection pin that assists to secure the optical sight to the optical sight mount, such as by resisting movement of the optical sight along the optical sight mount.

The optical sight may include one or more rear pin recesses that are defined by the bottom surface. The rear pin recesses may only extend through a portion of the optical sight and not through the top surface. The rear pin recesses may be configured to receive a connection pin that resists (e.g., limits) movement of the optical sight along the optical sight mount. The rear pin recesses may be positioned rearward of the connection openings.

The optical sight mount includes an optical sight mounting area having an optical sight mounting surface and a number of openings defined by the optical sight mounting surface that assist with securing the optical sight to the optical sight mount. One or more mounting openings may be defined by the optical sight mounting surface of the optical sight mount and open towards the connection openings of the optical sight when the optical sight is positioned on the optical sight mount. The mounting openings may be configured to receive at least a portion of the connector that is inserted through the connection openings.

One or more forward pin openings may be defined at least partially through the optical sight mounting surface. The forward pin openings may open towards the forward pin recesses of the optical sight when the optical sight is secured to the optical sight mount. The forward pin openings may be shaped to receive a connection pin. In some instances, the forward pin openings may have a non-symmetric shape. The forward pin openings may include a pin opening bottom surface so that forward pin openings are blind holes defined by the optical sight mounting surface.

One or more rear pin openings may be defined at least partially through the optical sight mounting surface. The rear pin openings may include a rear pin opening bottom surface. The rear pin openings may open towards the rear pin recesses of the optical sight when the optical sight is secured to the optical sight mount. In the embodiment shown, the rear pin openings may have a circular cross-section. The rear pin openings may be any suitable shape for receiving a connection pin to assist with securing the optical sight to the optical sight mount.

The optical sight mount may also include one or more additional mounting openings that may allow a different optical sight (e.g., different type and/or brand of optical sight) other than optical sight to be mounted to the optical sight mount. The mounting openings may be positioned on optical sight mount at a location that corresponds to the connection openings of a different variety of optical sight. Additional mounting openings or pin openings may be included on optical sight mount to accommodate even more varieties of optical sights.

The connection pin may have a pin base that has a cross-section that approximates the cross-sectional shape of the forward pin openings. The pin base may include a base top surface and a pin bottom surface. A pin body may extend from the base top surface at one end of the pin base and includes a body top surface. The pin body may include a curved pin inner surface.

A pin projection may extend from the other end of the base top surface of the pin base and includes a projection top surface. A height of the pin projection may be less than a height of the pin body so that the projection top surface is positioned lower than the body top surface. The pin projection may include a curved inner projection surface. A pin channel may be defined between the pin body and the pin projection.

The pin bottom surface may include two sections, a level portion and an angled portion, with a pivot point between the two sections. The angled portion of the pin bottom surface is angled with respect to the level portion of the pin bottom surface. Preferably, the connection pin is arranged so that the center of mass of the connection pin is positioned over the level portion of the pin bottom surface rather than over the angled portion of the pin bottom surface. This allows the connection pin to sit on the level portion of the pin bottom surface when the connection pin is positioned within the forward pin opening.

The connection pin may sit within the pin opening so that the level portion of the pin bottom surface is in contact with the pin opening bottom surface of the pin opening. The angled portion of the pin bottom surface may be angled so that the angled portion of the pin bottom surface is not in contact with the pin opening bottom surface, forming a gap between the angled portion of the pin bottom surface and the pin opening bottom surface.

The pin body of the connection pin may have a height that allows the body top surface to extend above the optical sight mounting surface of the optical sight mount 10. The pin projection may have a height that allows the projection top surface to extend above the optical sight mounting surface of the optical sight mount when the connection pin is positioned in the forward pin opening so that the only level portion of the pin bottom surface is in contact with the pin opening bottom surface.

A connection pin may be positioned in each of the pin openings (forward and/or reward). The pin recesses of certain optical sights may not be perfectly aligned with the pin openings of the optical sight mount. Additionally, the pin recess may have a width that is less than the width of the pin opening. This may cause the optical sight to not fit securely on optical sight mount, allowing the position of the optical sight to shift upon handling of the firearm. A shift of position of the optical sight may reduce the accuracy of the optical sight and/or require recalibration.

The shape of the connection pins may assist to secure the optical sight to the optical sight mount and reduce movement of the optical sight. When the optical sight is positioned on the optical sight mount, a bottom surface of the optical sight may come into contact with the projection top surface of the pin projection of the connection pin(s), causing the connection pin to rotate (e.g., pivot or tilt) within the forward pin opening. The force of the bottom surface of the optical sight on the pin projection causes the angled portion of the pin bottom surface to be pushed further into the forward pin opening, into the gap formed between the angled portion of the pin bottom surface and the pin opening bottom surface.

As the bottom surface of the optical sight contacts the pin projection and forces the pin projection portion of the connection pin further into the forward pin opening, at least a portion of the pin body portion of the connection pin moves laterally with respect to the optical sight mounting surface of the optical sight mount. The connection pin rotates (e.g., tilts) within the forward pin opening until the pin body contacts the bottom surface of the optical sight at an outside surface of the forward pin recess defined in the bottom surface of the optical sight. Advantageously, the force on the pin projection applied by the bottom surface biases the pin body in an outward direction against the outside surface of the forward pin recess of the bottom surface of the optical sight This assists to at least resist lateral movement of the optical sight on the optical sight mount even when the forward pin recesses of the optical sight do not align exactly with the forward pin openings in the optical sight mount of the slide.

Preferably the top surface that contacts the optical sight is further from the pivot point than the surface that applies lateral force to the optical sight. Advantageously, this can provide a mechanical advantage so the lateral force applied to the optical sight is greater than the connecting force applied along a direction normal to the mounting surface/plane. It is contemplated, however, that the surface providing lateral force (i.e., along a direction parallel to the mounting surface) against the optical sight be further from the pivot point than the projection top surface.

Advantageously, the present disclosure provides arrangements in which lateral force applied to the optical sight by the connection pin continuously increases as the connector, such as a threaded screw, increases force on the optical sight towards the optical sight mount of the firearm. In this way, the force against movement along the mounting surface/plane is proportional to the force applied by the connector forcing the optical sight towards the mounting surface.

The present disclosure also discloses methods, including methods of attaching an optical sight to a firearm, such as the arrangements disclosed herein. Such methods may comprise a firearm having an optical sight mounting area, wherein the optical sight mounting area is selectively configurable to receive a first optical sight or a second optical sight. Such methods may include a pin opening defined by an optical sight mounting surface of the optical sight mounting area, wherein the pin opening is configured to alternatingly receive a first optical sight connection pin and a second optical sight connection pin. The methods comprise positioning the first optical sight connection pin in the pin opening; moving a first optical sight into the optical sight mounting area, the first optical sight including a pin recess, wherein at least a portion of the pin recess is positioned over the pin opening when the first optical sight is positioned in the optical sight mounting area so that at least a portion of the first optical sight connection pin enters the first optical sight pin recess when the first optical sight is positioned in the optical sight mounting surface; and forcing the first optical sight towards the optical sight mounting surface so that the first optical sight connection pin bears upon an inner surface of the first optical sight pin recess and resists movement of the first optical sight with respect to the firearm along a plane defined by the optical sight mounting surface. Preferably the first optical sight connection pin moves with respect to the optical sight mounting surface when the first optical sight is forced towards the optical sight mounting surface. The first optical sight connection pin may rotate and/or translate within the pin opening when the first optical sight is forced towards the optical sight mounting surface.

Further forms, objects, features, aspects, benefits, advantages, and embodiments of the present invention will become apparent from a detailed description and drawings provided herewith.

DESCRIPTION OF THE SELECTED EMBODIMENTS

Figure 1:
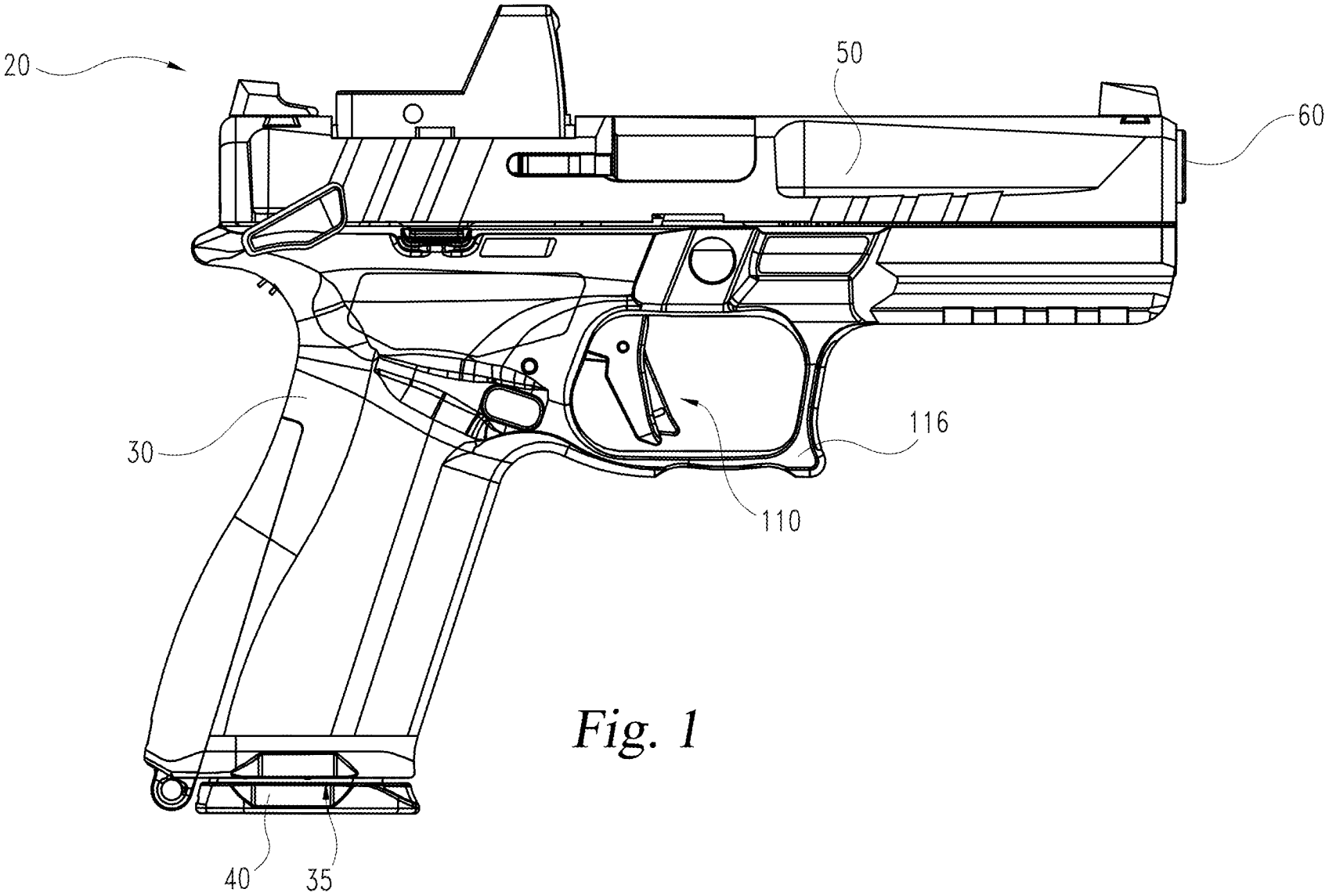
FIG. 1 is a side view of a firearm.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

Directional terms, such as forward, rearward, top, bottom, etc., are used in this description with reference to the specific embodiment shown and used for purposes of clarity. It should be recognized that these terms are not meant to be limiting. For the purposes of this description, the term "forward" refers to the direction moving toward the front end of the barrel, where a bullet exits upon being fired. The term "rearward" refers to a direction moving toward the grip end of the firearm.

A side view of a firearm 20 is shown in FIG. 1. Firearm 20 includes a frame 30 that defines a magazine well 35 for receiving a magazine 40. A slide 50 is positioned atop the frame 30 so that the slide 50 may move along the length of the frame 30. A barrel 60 is supported within the slide 50. The firearm 20 also includes a trigger assembly 110 that is housed within the frame 30. In some embodiments, the trigger assembly 110 may include a trigger 113 and a trigger safety 114 that is protected by a trigger guard 116.

Figure 2:
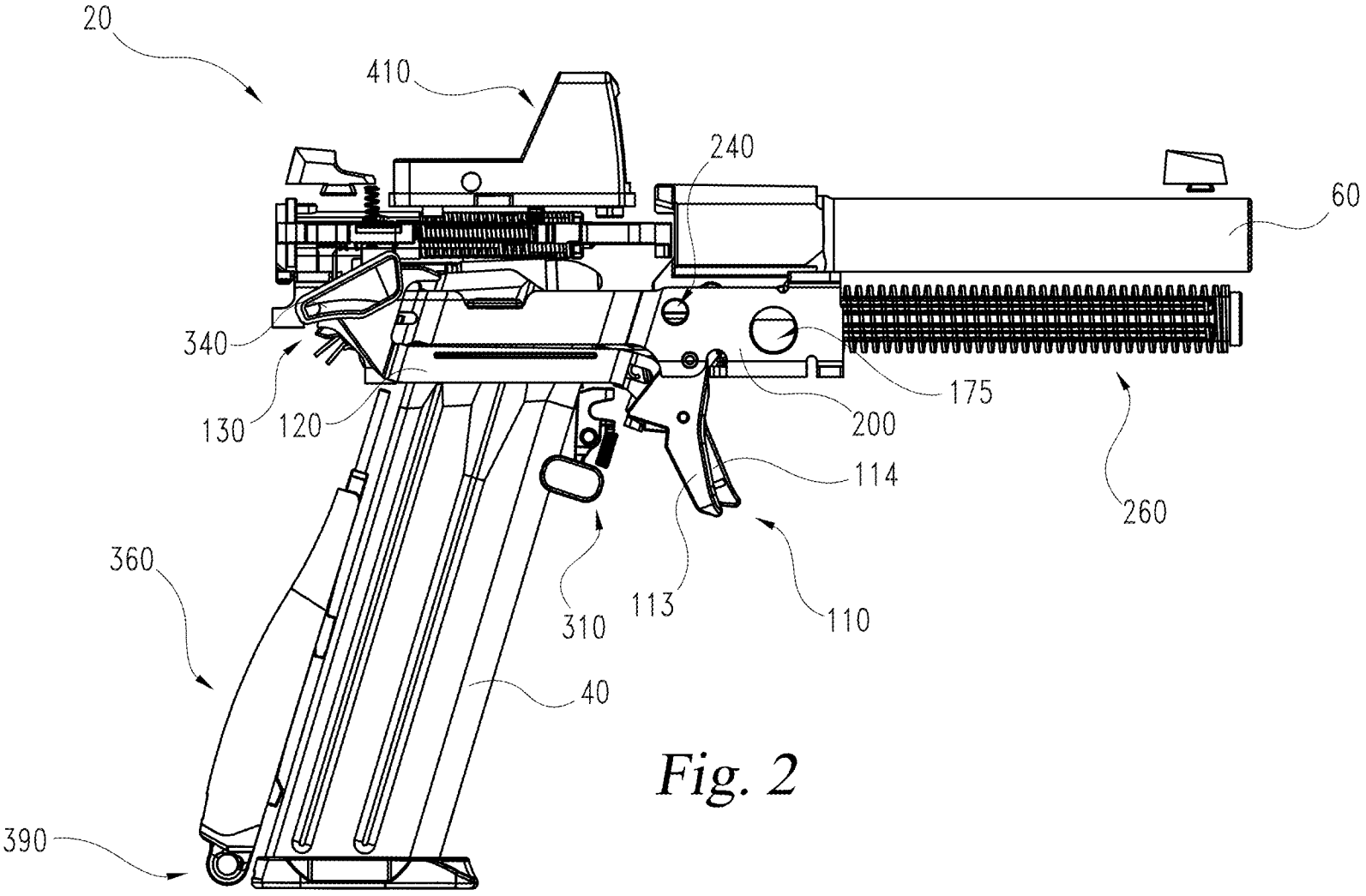
FIG. 2 is a right side view of the firearm of FIG. 1 with the frame and the slide removed.
Figure 3:
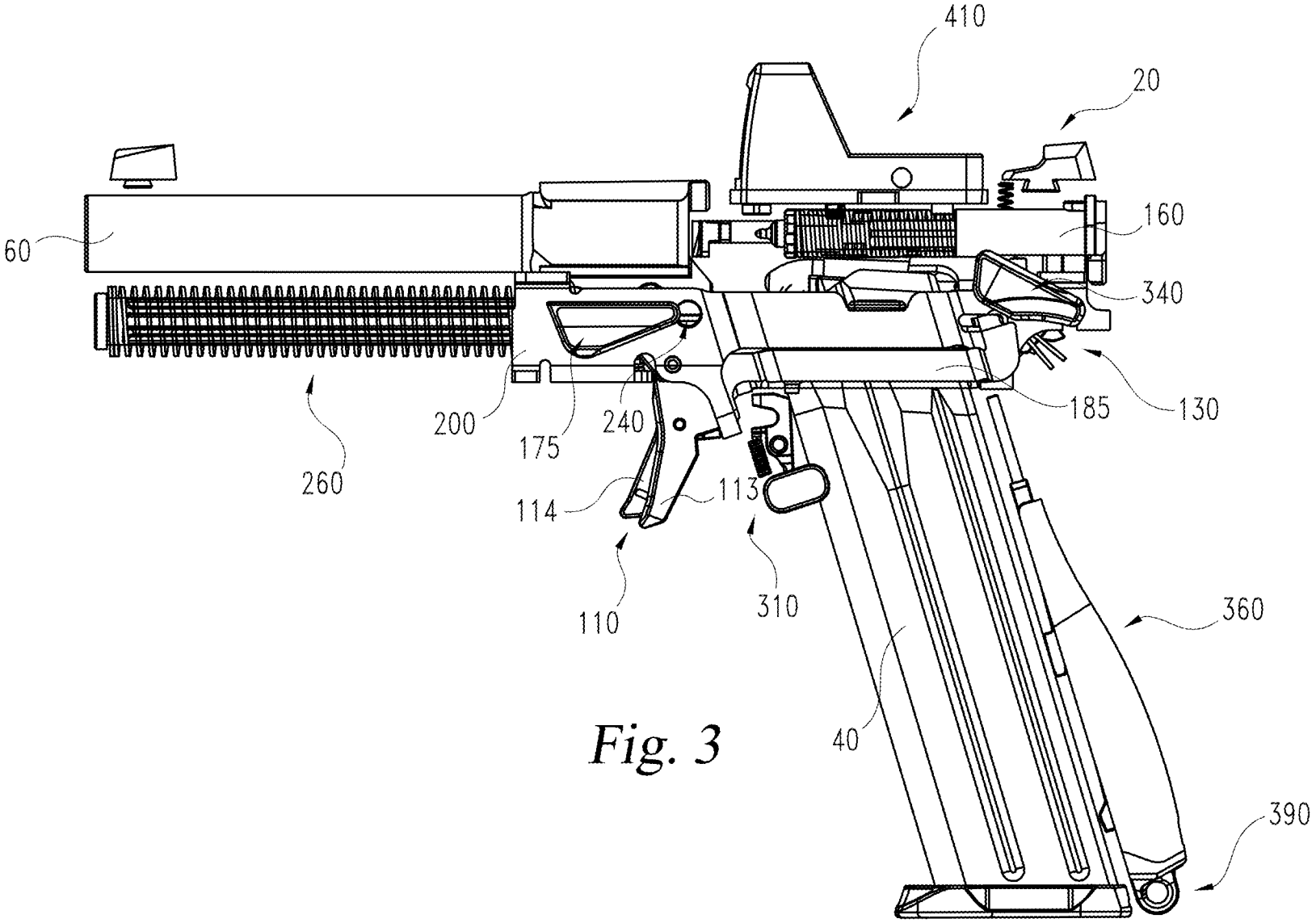
FIG. 3 is a left side view of the firearm of FIG. 1 with the frame and the slide removed.

FIGS. 2 and 3 show a right side view and a left side view, respectively, of the firearm 20 with the frame 30 and the slide 50 hidden to more clearly show the inner components of the firearm 20. As shown in FIG. 2, the trigger assembly 110 includes a trigger bar 120 that extends rearwardly from the trigger 113 and interacts with a sear assembly 130. The sear assembly 130 interacts with the firing pin 160 to allow release of the firing pin when the trigger 113 is pulled so that the firing pin may contact a loaded cartridge to fire the firearm 20.

A safety disassembly system 175 includes a safety disassembly lever 185 that is also capable of interaction with the sear assembly 130. The safety disassembly system 175 prevents accidental firing of the firearm 20 during disassembly of the firearm 20. In some embodiments, the safety disassembly lever 185 may also prevent disassembly of the firearm 20 when a magazine 40 is inserted into the magazine well. The safety disassembly lever 185 may also prevent insertion of a magazine 40 into the magazine well 35 when the safety disassembly system 175 is in a position to allow disassembly of the firearm 20.

A trigger housing 200 may be fit within the frame 30 and may provide support for the trigger assembly 110 and may also provide additional support for the frame 30. In addition to supporting the trigger assembly, the trigger housing 200 may also support the safety disassembly system 175. In some embodiments, the trigger housing 200 may define opposed openings through which a portion of the safety disassembly system 175 may be inserted. The trigger housing 200 may also provide support for a slide stop assembly 240. The slide stop assembly 240 may include a slide stop lever and a slide stop pin. The slide stop assembly 240 allows the slide 50 to be held in a rearward position.

A recoil spring assembly 260 is positioned below the barrel 60. The recoil spring assembly 260 assists to return the slide 50 to a forward position after the firearm 20 is fired.

A magazine catch assembly 310 is found within the frame 30 and adjacent to the magazine well 35 and the magazine 40 when the magazine 40 is loaded into the magazine well. The magazine catch assembly 310 holds the magazine 40 within the magazine well 35, and operation of the magazine catch assembly allows the magazine 40 to be released from the magazine well 35. In some embodiments, the magazine catch assembly 310 is designed to be ambidextrous so it may be operated by a right-handed or a left-handed user from either side of the firearm 20. Further, in some embodiments, the magazine catch assembly 310 may operate to prevent release of the magazine 40 from the magazine well 35 when the trigger 113 is pulled.

The firearm 20 also includes a manual safety assembly 340 which is positioned near the rearward end of the firearm 20. The manual safety assembly 340 may be in contact with and secured to a portion of the trigger housing 200. The manual safety assembly 340 may be rotatable with respect to the trigger housing 200, so that when the manual safety assembly 340 is rotated into an engaged orientation, the manual safety assembly 340 prevents rotation of the sear assembly 130. This prevents the firearm 20 from firing because the sear assembly 130 is unable to rotate to release the firing pin 160.

A backstrap assembly 360 is attachable to a rearward face of the frame 30. The backstrap assembly 360 provides a grip for a user firing the firearm 20. The backstrap assembly 360 may be designed to ergonomically fit within the hand of a user to increase comfort and make the firearm 20 more secure and easier to handle. In some embodiments, the backstrap assembly 360 may be designed to be attached and detached from the frame 30 without the need for an additional tool. Additionally, in some embodiments, the backstrap assembly 360 may include a lanyard assembly 390 that allows a lanyard to be attached the firearm 20.

An optical sight assembly 410 may be positioned on the top of the slide 50 of firearm 20. The slide 50 may include multiple mounting locations for the optical sight assembly 410 so that different varieties of optical sight assemblies 410 may be attached to the slide 50 as desired without the need for different mounting plates to be installed on the slide 50.

Figure 4:
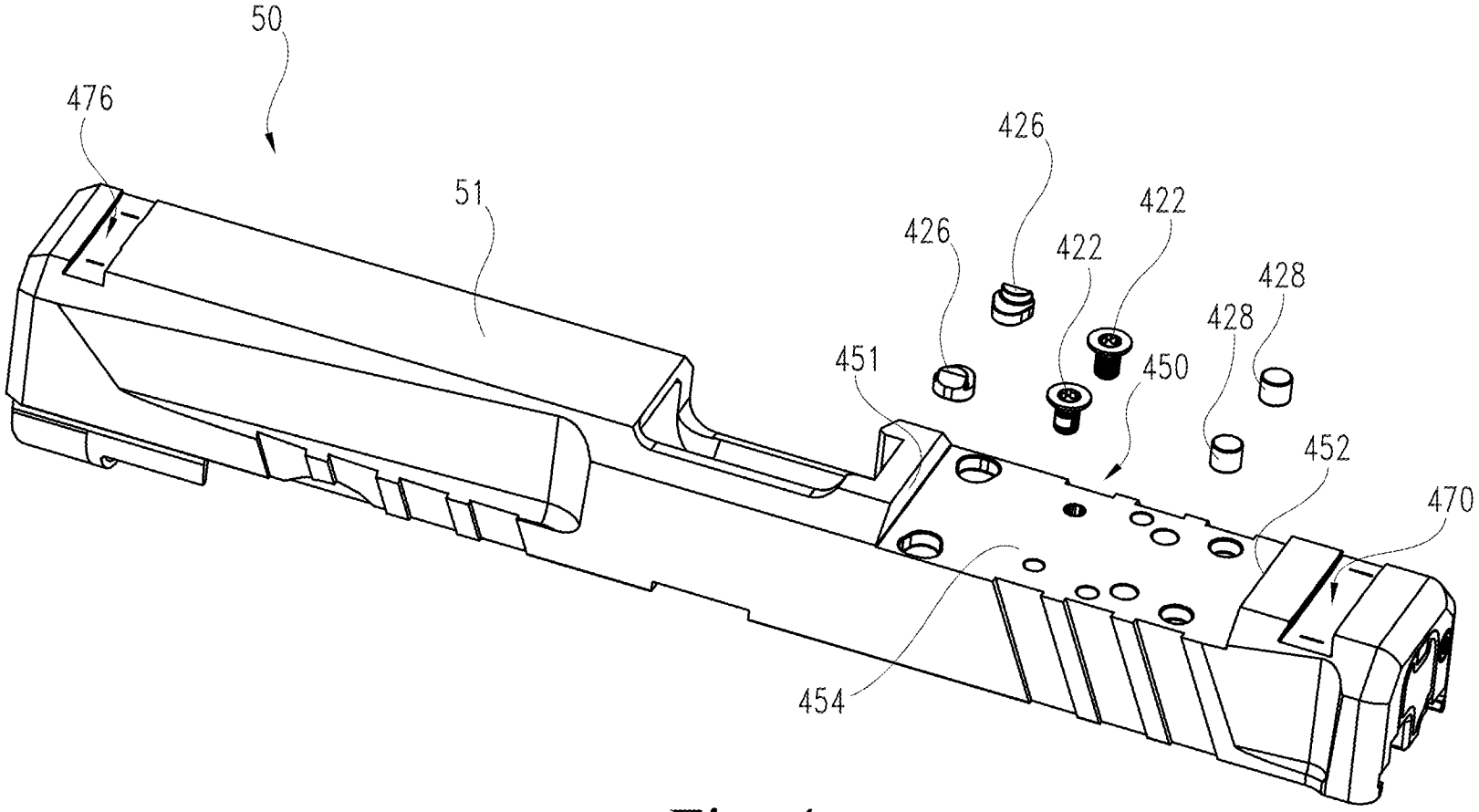
FIG. 4 is a perspective view of a slide of the firearm of FIG. 1.

A perspective view of the slide 50 of the firearm 20 is shown in FIG. 4. As shown, the slide 50 includes an optical sight mounting portion 450 that is defined on the slide 50. The optical sight mounting portion 450 of the slide 50 is recessed into a top surface 51 of the slide 50, forming a front optical sight mounting edge 451 and a rear optical sight mounting edge 452. An optical sight mounting surface 454 is defined between the front optical sight mounting edge 451 and the rear optical sight mounting edge 452.

Various connection members, such as pins or screws, may be used to attach an optical sight assembly 410 at the optical sight mounting portion 450 of the slide 50. FIG. 4 illustrates some examples of these connection members. For example, plate connectors 422 may be used to attach a plate to the slide 50. Forward and/or rearward connection pins may help further secure optical sight assemblies, or portions thereof, to the slide. For example, forward connection pins 426 may help to secure certain types of optical sight assemblies 410 to the slide 50 while rear connection pins 428 may be used to help secure other types of optical sight assemblies 410 to the optical sight mounting portion 450 of slide 50. In some embodiments, the connection pins may be cylindrical, in other embodiments, the connection pins may have a different shape. For example, in the embodiments shown, the forward connection pins 426 have a rounded triangular base and include a raised portion extending from the rounded triangular base. In other embodiments, other suitable shapes of connection pins may also be used to allow different varieties of optical sights to be attached to the slide 50 of the firearm 20.

A rear sight slot 470 may be recessed into top surface 51 of the slide 50. The rear sight slot 470 may be used to mount a rear sight 472 (see FIG. 6) to the firearm 20. In some embodiments, the rear sight slot 470 may be a dovetail slot. In addition to the rear sight slot 470, a front post slot 476 may also be recessed into the top surface 51 of the slide 50 at a forward end of the slide 50. The front post slot 476 may be configured to receive a front post 478 (see FIG. 6). In some embodiments, the front post slot 476 is a dovetail slot and the front post 478 slides into the dovetail slot.

Figure 5:
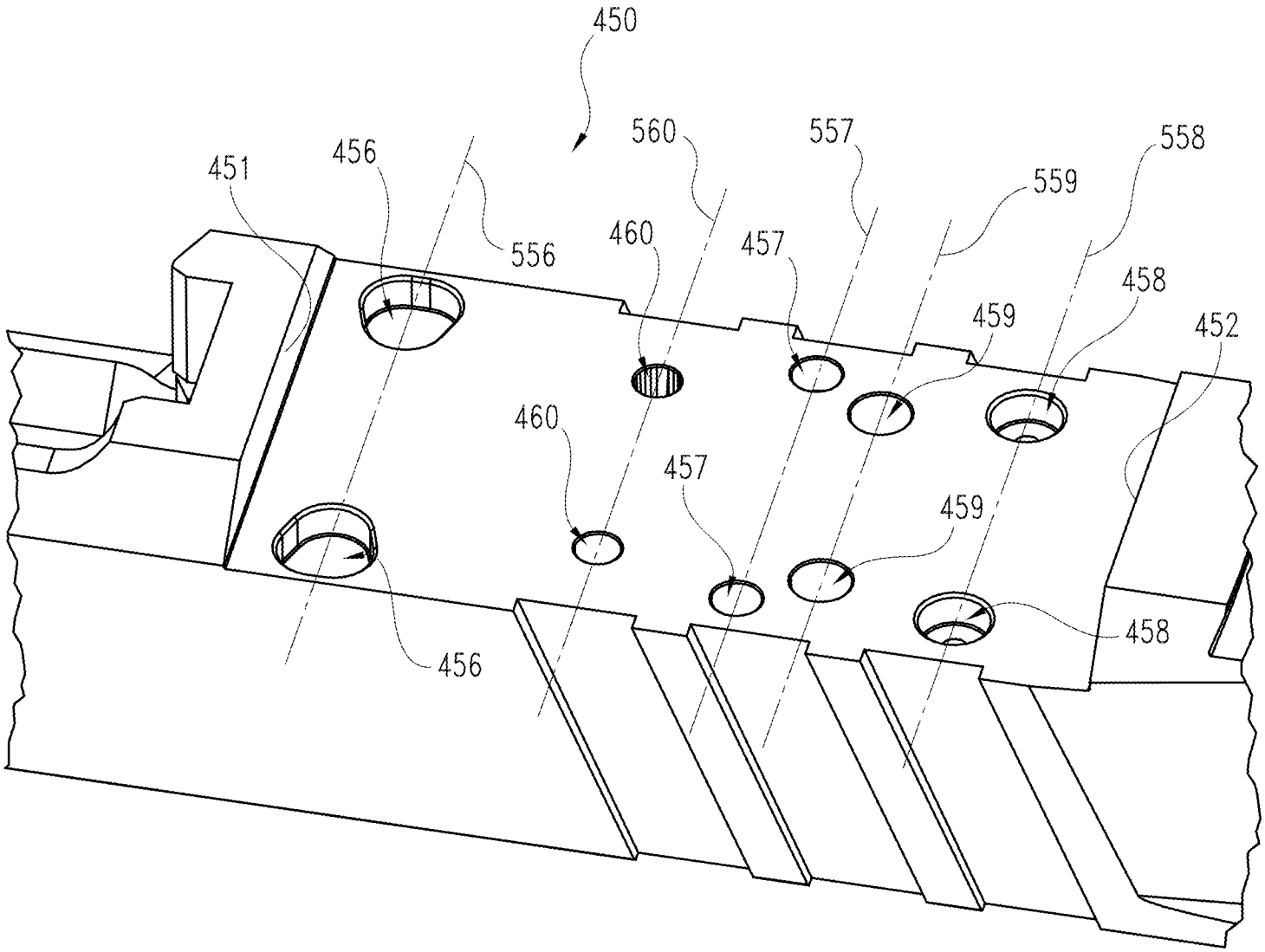
FIG. 5 is a perspective view of the optical sight mounting portion of the slide of FIG. 4.

As shown in more detail FIG. 5, there are several mounting openings defined through the optical sight mounting surface 454 of the slide 50. In the embodiment shown, the mounting openings are arranged in pairs. Some of the mounting openings may correspond to the attachment points of a particular type of mounting plate that may be used to attach a desired optical sight to the firearm 20. Others of the mounting openings may correspond to the attachment points of a specific variety of optical sight to allow the optical sight to be attached directly to the slide 50 without the use of a mounting plate.

A pair of forward pin openings 456 are defined at least partially through the optical sight mounting surface 454 near the front optical sight mounting edge 451. The forward pin openings 456 may be shaped to receive forward connection pins 426 (shown in FIG. 4). In some instances, the forward pin openings 456 may have non-symmetric shape, as shown in FIG. 5. In some embodiments, the forward pin openings 456 may be designed to correspond to the position of connection pins for a Trijicon RMR® red dot sight so that a Trijicon RMR® sight may be mounted directly to the slide 50.

In addition to the forward pin openings 456, a pair of forward sight attachment openings 457 may be defined at least partially through the optical sight mounting surface 454 to provide a place to insert screws to further secure an optical sight to the slide 50. In some embodiments, the forward sight attachment openings 457 may be threaded to receive a threaded fastener. In some embodiments, the forward sight attachment openings 457 may be positioned to correspond to the position of mounting screws for the Trijicon RMR® red dot sight. For example, the forward sight attachment openings 457 may be positioned with respect to the forward pin openings 456, so that the Trijicon RMR® sight may be connected directly to the slide 50 with the connection pins of the Trijicon RMR® sight being secured at the forward pin openings and optical sight connectors to secure the Trijicon RMR® sight to the slide 50 inserted into the forward sight attachment openings 457.

A pair of rear pin openings 458 are defined at least partially through the optical sight mounting surface 454 near the rear optical sight mounting edge 452. The rear pin openings 458 may be shaped to receive the rear connection pins 428 (shown in FIG. 4). In some embodiments, the rear pin openings 458 may be designed to correspond to the position of connection pins for a Leupold Deltapoint® Pro red dot sight so that a Leupold Deltapoint® Pro sight may be mounted directly to the slide 50.

In addition to the forward pin openings 456, a pair of rear sight attachment openings 459 may be defined at least partially through the optical sight mounting surface 454 to provide a place to insert screws to further secure an optical sight to the slide 50. In some embodiments, the rear sight attachment openings 459 may be threaded to receive a threaded fastener. In some embodiments, the rear sight attachment openings 459 may be positioned to correspond to the position of mounting screws for the Leupold Deltapoint® Pro red dot sight. For example, the rear sight attachment openings 459 may be positioned with respect to the rear pin openings 458, so that the Leupold Deltapoint® Pro sight may be connected directly to the slide 50 with the connection pins of the Leupold Deltapoint® Pro sight being secured at the forward pin openings and optical sight connectors to secure the Leupold Deltapoint® Pro sight to the slide 50 inserted into the rear sight attachment openings 459. In the embodiment shown in FIG. 5, the rear sight attachment openings 459 are positioned forward of the rear pin openings 458 but rearward of the forward pin openings and the forward sight attachment openings 457.

A pair of plate attachment openings 460 may also be defined at least partially through the optical sight mounting surface 454. The plate attachment openings 460 may receive a fastener, such as plate connector 422, that may be used to secure a plate 480 to the slide 50. In the embodiment shown, the plate attachment openings 460 are positioned rearward of the forward pin openings 456 but forward of the forward sight attachment openings 457. In some embodiments, the plate attachment openings 460 may be threaded to receive a threaded fastener such as a screw to secure the plate to the slide 50.

As shown in FIG. 5, each set of openings 456, 457, 458, 459, and 460 are aligned on the optical sight mounting surface 454. For example, the forward pin openings 456 are aligned along the axis 556 extending along the width of the optical sight mounting surface 454. The forward sight attachment openings are aligned along axis 557. The rear pin openings 458 are aligned along axis 558 that extends along the width of the optical sight mounting surface 454. Similarly, the rear sight attachment openings 459 are aligned on axis 559 and the plate attachment openings 460 are aligned on axis 560.

Figure 6:
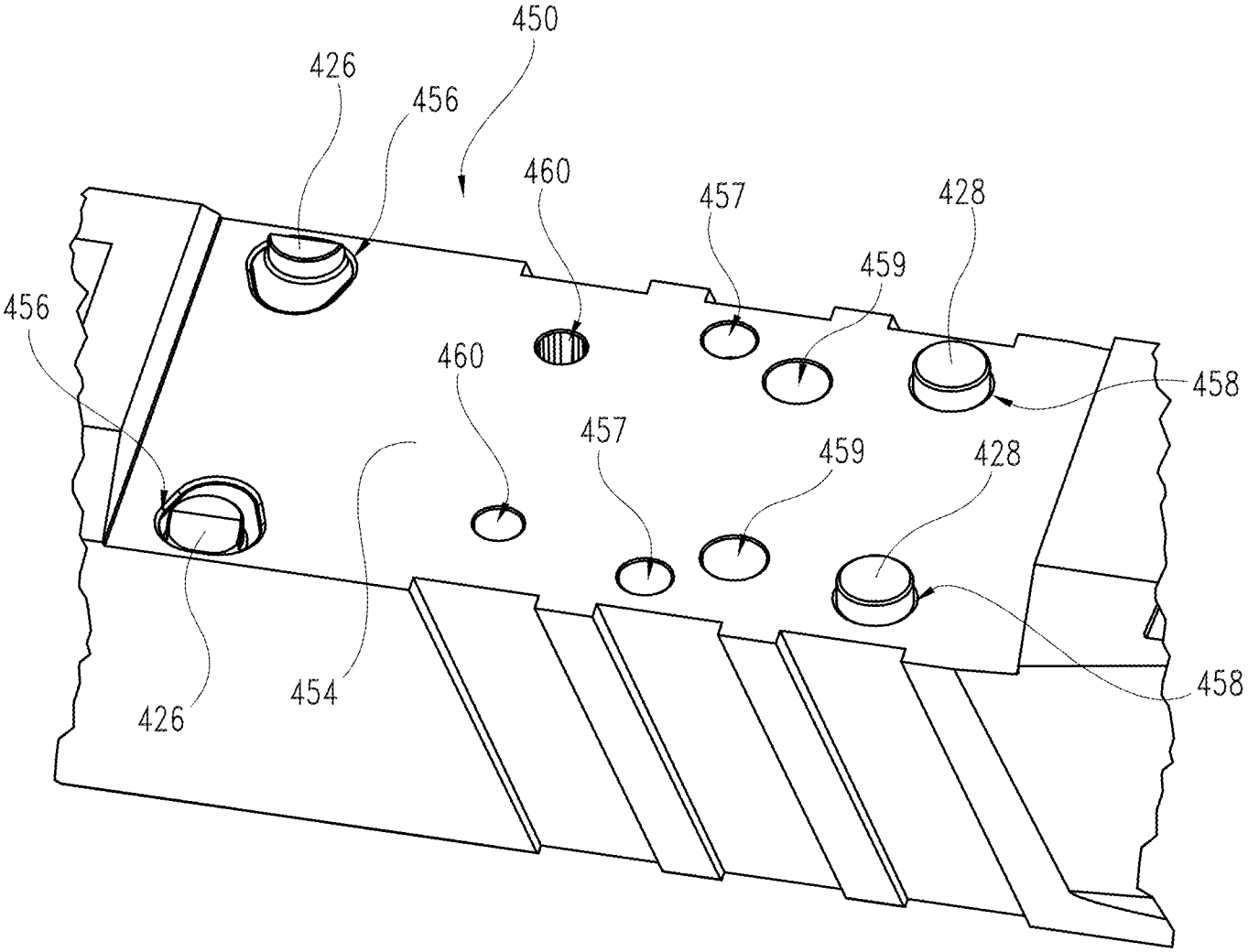
FIG. 6 is a perspective view of the optical sight mounting portion of the slide of FIG. 4 with connection pins inserted into the connection pin openings.

FIG. 6 shows a view of the optical sight mounting portion 450 of the slide 50 with connection pins 426, 428 inserted into the pin openings 456, 458. As shown, the forward connection pins 426 are inserted into a respective forward pin opening 456, and the rear connection pins 428 are inserted into a respective rear pin opening 458. The forward connection pins 426 rest within the forward pin openings 456 so that a portion of the forward connection pin 426 extends above the optical sight mounting surface 454. Likewise, the rear connection pins 428 rest within the rear pin openings 458 so that a portion of the rear connection pin 428 extends above the optical sight mounting surface 454.

Figure 7:
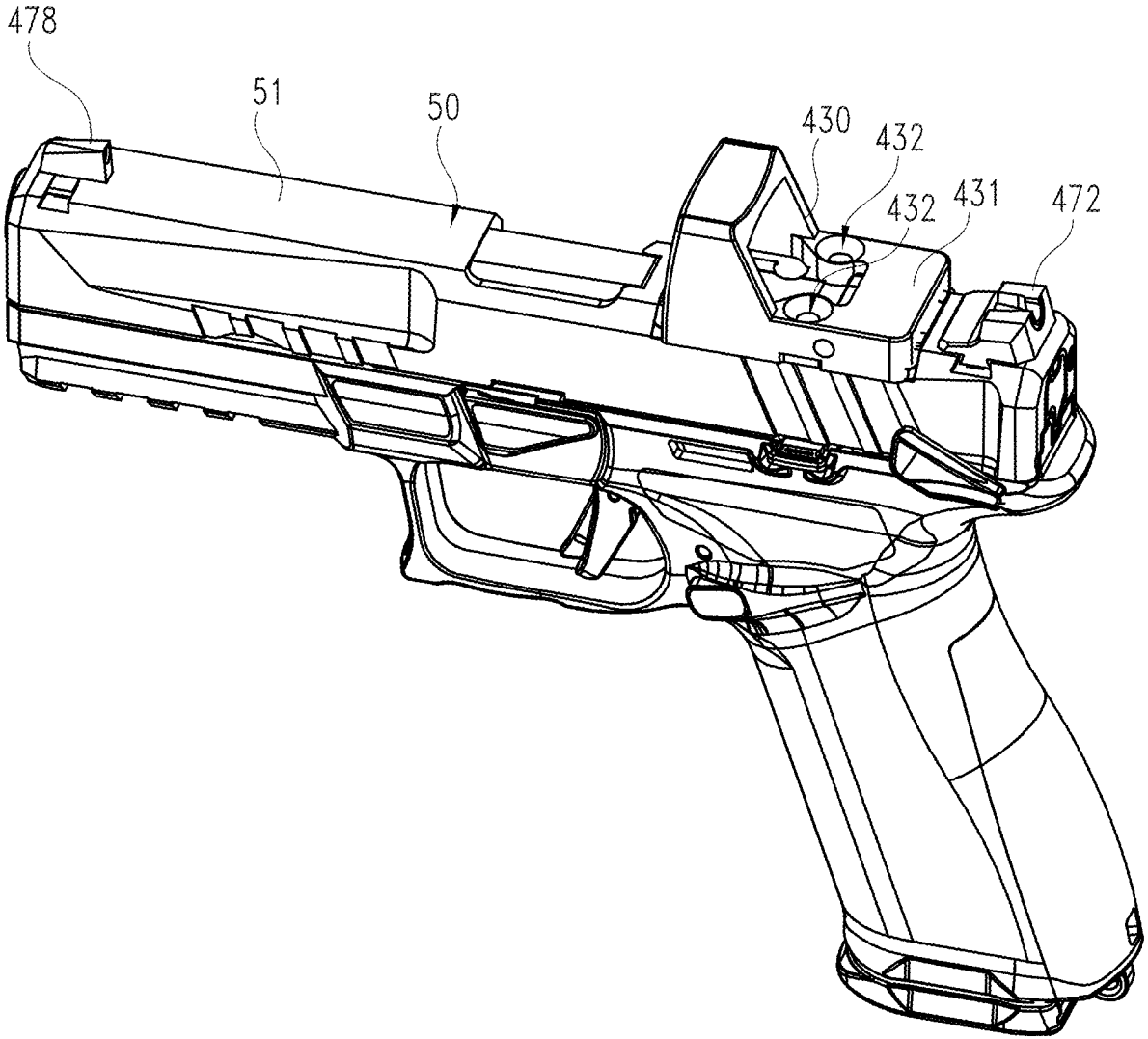
FIG. 7 is a perspective view of the firearm of FIG. 1 with an optical sight attached to said slide.
Figure 8:
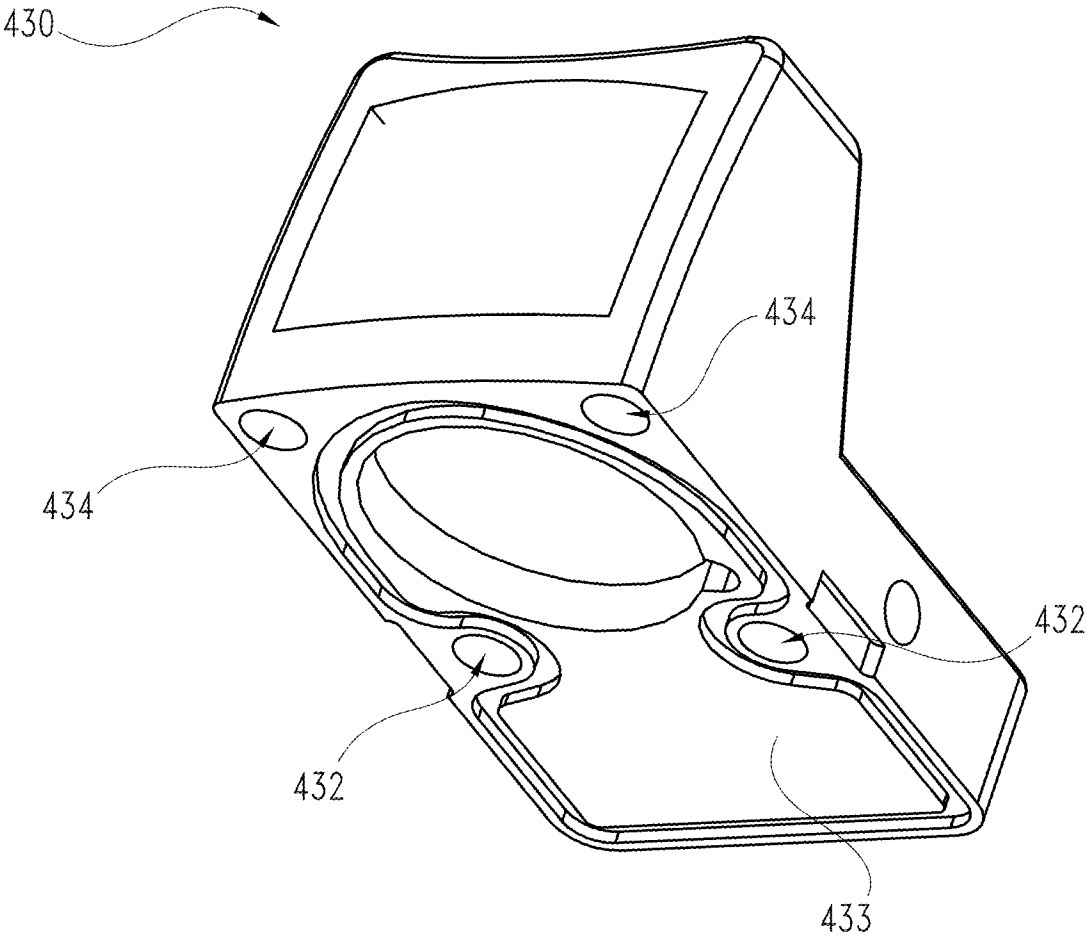
FIG. 8 is a perspective view of the optical sight of the firearm of FIG. 7.

FIG. 7 shows an embodiment of the firearm 20 that includes an optical sight 430 attached to the top surface 51 of the slide 50 at the optical sight mounting portion 450 of slide 50. In the embodiment shown, the optical sight 430 is a Trijicon RMR® red dot sight and is attached directly to the top surface 51 of the slide 50 without requiring a separate mounting plate to be connected to the slide 50. The optical sight 430 includes connection openings 432 defined through a top surface 431 and a bottom surface 433 of the optical sight 430 so that the connection openings 432 extend completely through the optical sight 430. The connection openings 432 are designed to receive optical sight connectors 435 to secure the optical sight 430 to the slide 50. The optical sight 430 also includes a pair of pin recesses 434 (see FIG. 8) for receiving a pin to further secure the optical sight 430 to the slide 50.

Each of the connection openings 432 of the optical sight 430 is aligned with a respective forward sight attachment opening 457 defined through the top surface 51 of slide 50 when the optical sight 430 is placed on the optical sight mounting portion 450 of slide 50. An optical sight connector 435 may be inserted through the connection opening 432 and into the forward sight attachment opening 457 to mount the optical sight 430 to the top surface 51 of the slide. Likewise, each of the pin recesses 434 are aligned with a respective forward pin opening 456, so that the pin recess 434 may receive a mounting pin that is positioned in forward pin opening 456 to further secure optical sight 430 to the slide 50.

Figure 9:
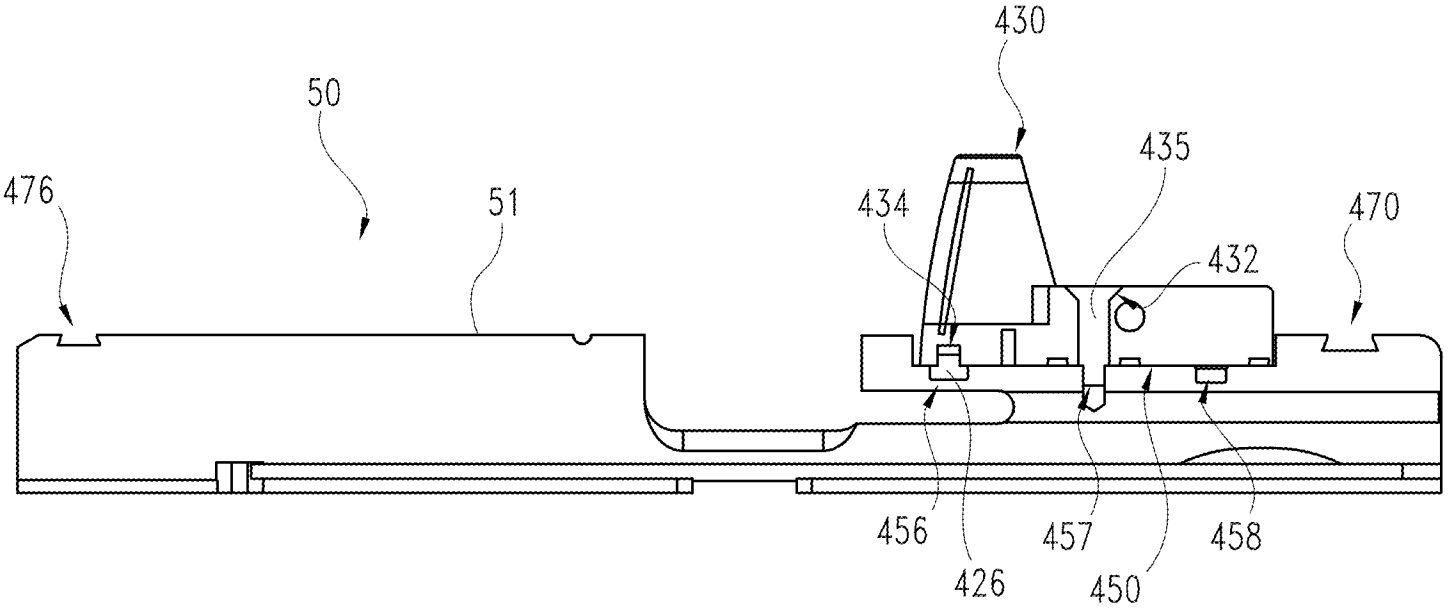
FIG. 9 is a cross-sectional view of the optical sight of FIG. 8 attached to the slide of the firearm of FIG. 1.

As shown in FIG. 9, there are no openings defined through the optical sight 430 that align with the rear pin openings 458, so the optical sight 430 simply covers the rear pin openings 458. Therefore, rear pin openings 458 are unused when the optical sight 430 is installed on the firearm 20, but are available on the slide 50 in the event another type of optical sight is desired to be installed on the firearm 20.

Figure 10:
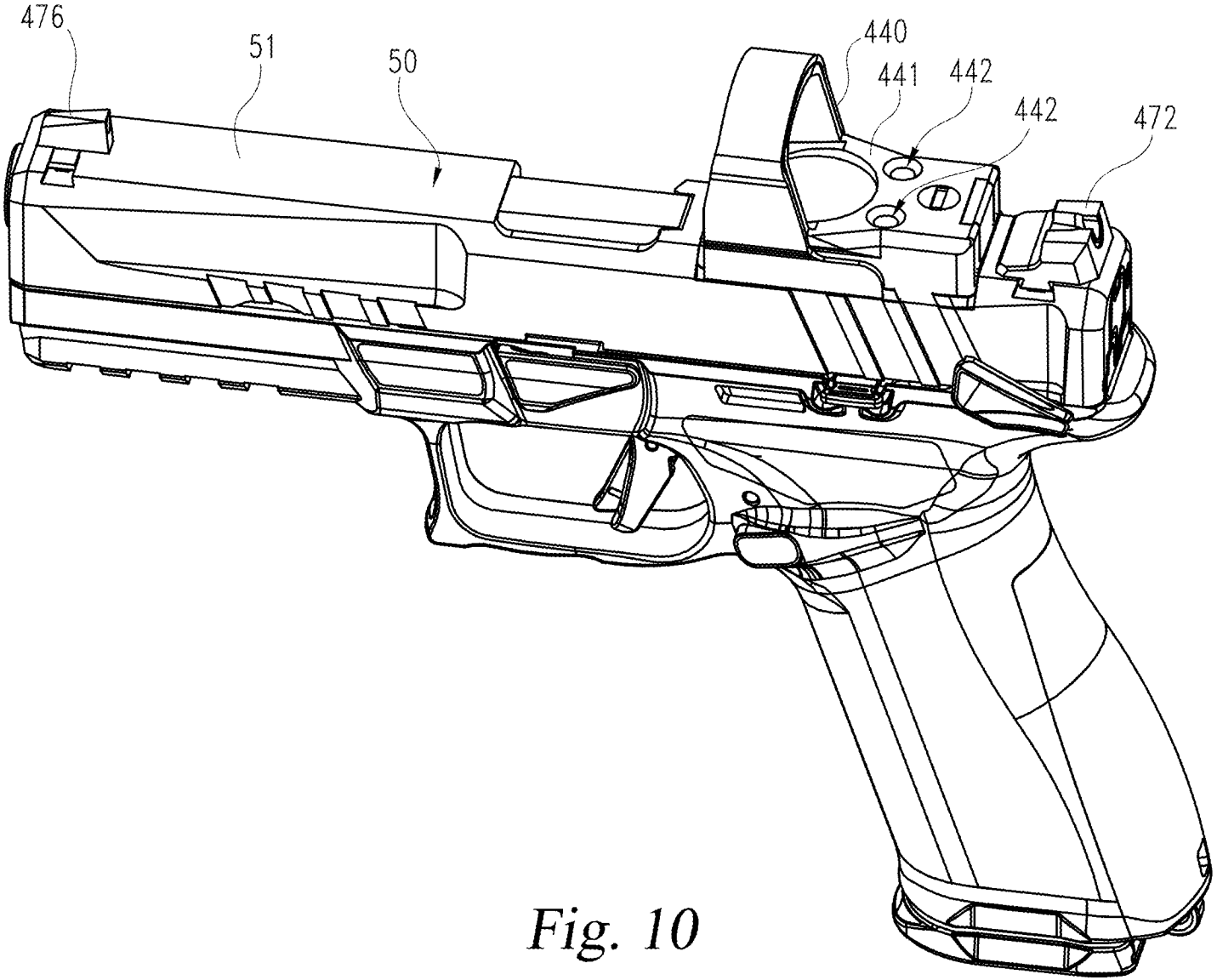
FIG. 10 is a perspective view of the firearm of FIG. 1 with an optical sight attached to said slide.

FIG. 10 shows an embodiment of the firearm 20 that includes another embodiment of an optical sight 440 attached to the top surface 51 of the slide 50 at the optical sight mounting portion 450 of slide 50. In the embodiment shown, the optical sight 440 is a Leupold Deltapoint® red dot sight and is attached directly to the top surface 51 of the slide 50 without requiring a separate mounting plate to be connected to the slide 50. Optical sight 440 has a top surface 441 and includes connection openings 442 that extend through top surface 441 and a bottom surface 443 of the optical sight 440, for receiving optical sight connectors 445 to secure the optical sight 440 to the slide 50.

Figure 11:
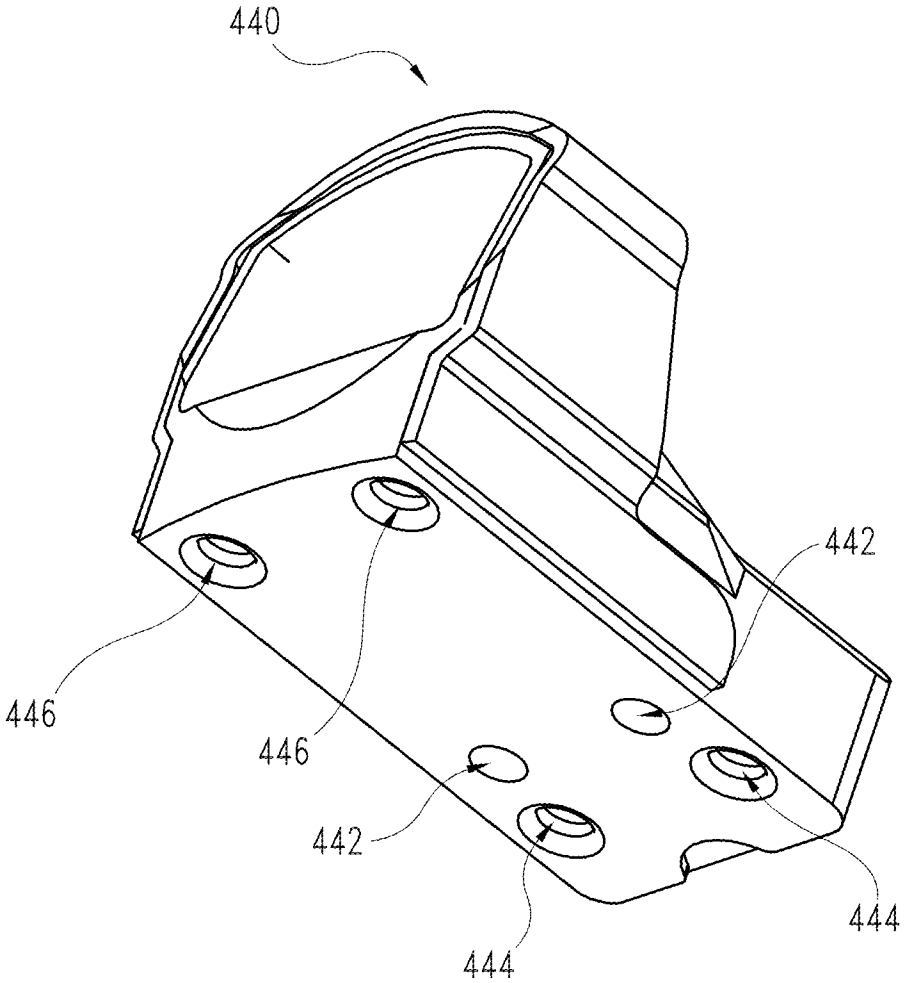
FIG. 11 is a perspective view of the optical sight of the firearm of FIG. 10.

A perspective view of the optical sight 440 is shown in FIG. 11. As shown, the bottom surface 443 of the optical sight 440 and includes a pair of pin recesses 444 that are positioned rearwardly with respect to connection openings 442 and that are defined through the bottom surface 443 of the optical sight 440. In the embodiment shown, the pin recesses 444 do not extend through the top surface 441 of optical sight 440. Each pin recess 444 is configured to receive a pin to secure the optical sight 440 to the slide 50. In some embodiments, optical sight 440 may also include a pair of forward pin recesses that are defined through the bottom surface 443 of the optical sight 440 at a position forward of the connection openings 442 and the pin recesses 444. Similar to the pin recesses 444, the forward pin recesses 446 do not extend through the top surface 441 of the optical sight 440. The forward pin recesses 446 may optionally be used to receive a second set of pins for securing the optical sight 440 to slide 50.

Figure 12:
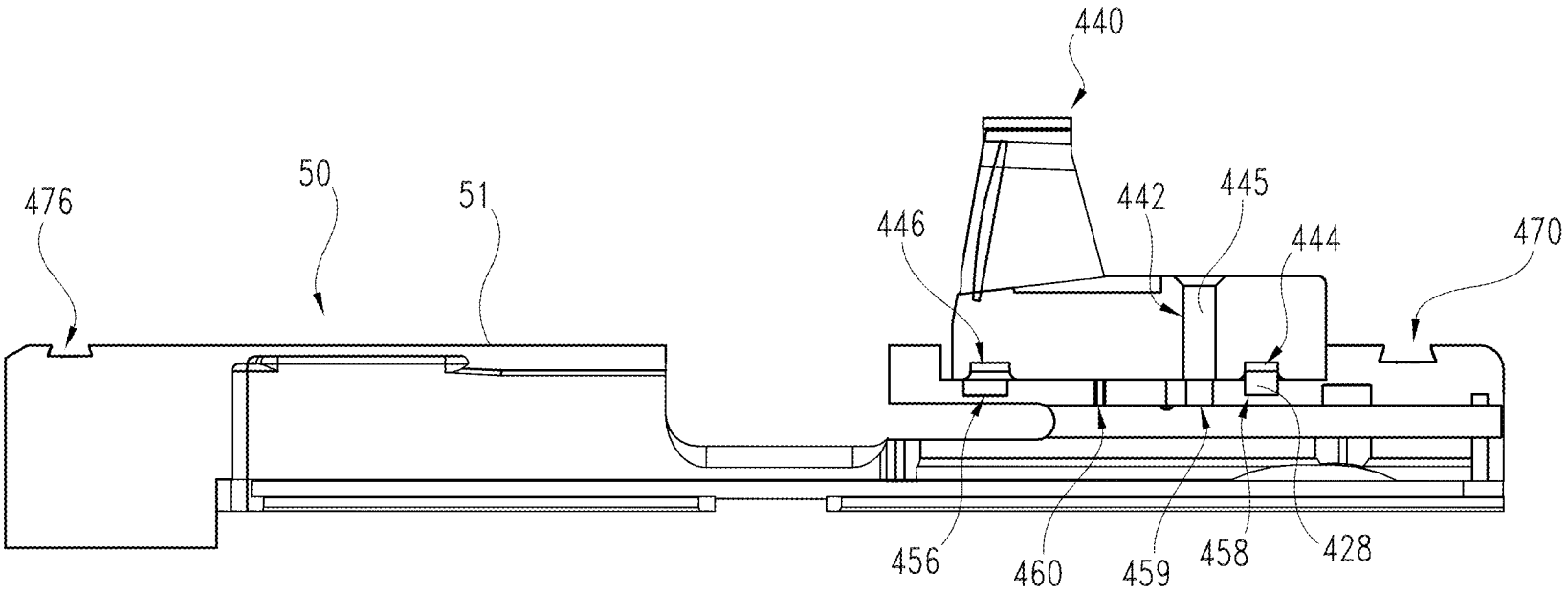
FIG. 12 is a cross-sectional view of the optical sight of FIG. 11 attached to the slide of the firearm of FIG. 1.

As shown in FIG. 12, each of the connection openings 442 of the optical sight 440 is aligned with a respective rear sight attachment opening 459 defined through the top surface 51 of slide 50 when the optical sight 440 is placed on the optical sight mounting portion 450 of slide 50. An optical sight connector 445 may be inserted through the connection opening 442 and into the rear sight attachment opening 459 to mount the optical sight 440 to the top surface 51 of the slide. Likewise, each of the pin recesses 444 are aligned with a respective rear pin opening 458, so that the pin recess 444 may receive a mounting pin that is positioned in rear pin opening 458 to further secure optical sight 440 to the slide 50. Optionally, the forward pin recesses 446 may be aligned with the forward pin openings 456, and a pin inserted into the forward pin openings 456 may be inserted into forward pin recesses 446. However, in some embodiments the forward pin recesses 446 may not be used to secure the optical sight 440 to the slide 50.

Figure 13:
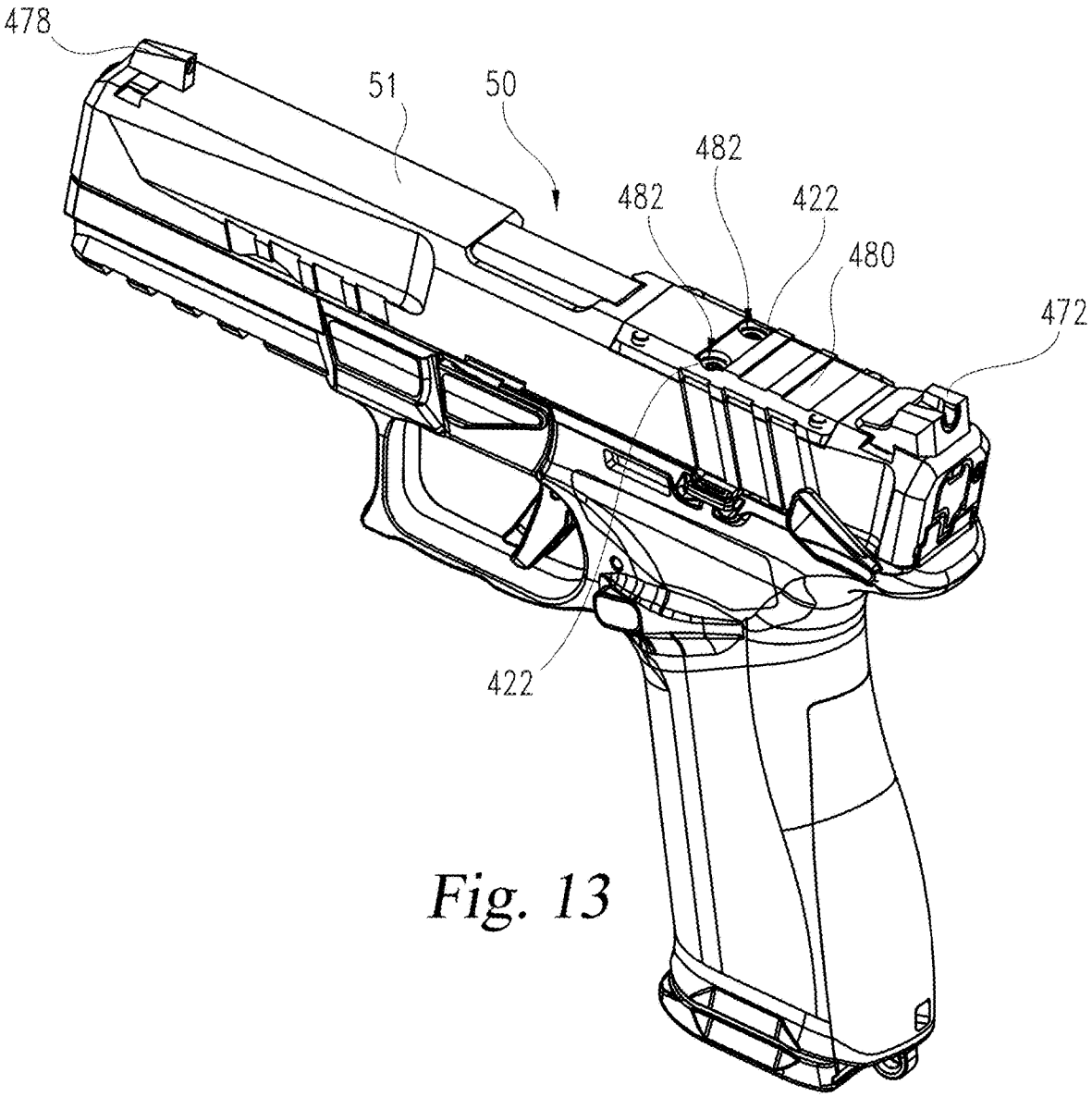
FIG. 13 is a perspective view of the firearm of FIG. 1 with a plate attached to said slide.

Although the firearm 20 allows for optical sights to be mounted directly to the slide 50, the optical sight mounting portion 450 of the slide 50 may also receive a mounting plate 480 to allow for other types of optical sights to be installed on slide 50 or to cover the optical sight mounting portion 450 of the slide 50 when no optical sight is desired on firearm 20. For example, as shown in FIG. 13, the plate 480 may be attached to the slide 50 at the optical sight mounting portion 450 of the slide 50. In some embodiments, the plate 480 may include attachment features for securing different varieties of optical sights to the slide 50 by attaching the optical slide to the plate 480 rather than directly to the slide 50.

Figure 14:
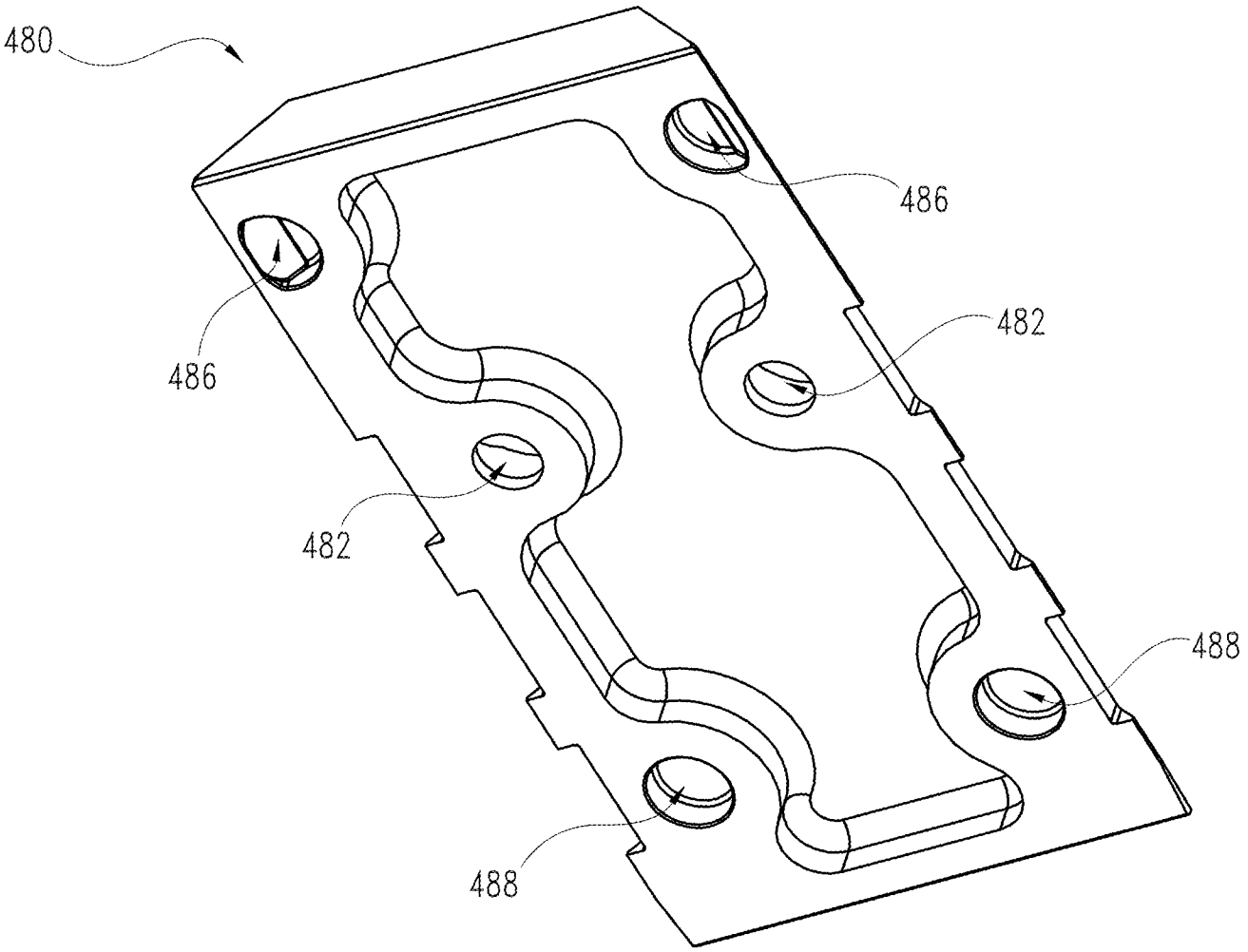
FIG. 14 is a bottom perspective view of the plate of FIG. 13.

A bottom perspective view of the plate 480 is shown in FIG. 14. As shown, the plate 480, includes a pair of plate screw openings 482 configured to receive plate screws that may attach the plate 480 to the slide 50. The plate screw openings 482 are aligned with the plate attachment openings 460 defined through the top surface 51 of the slide when the plate 480 is positioned at the optical sight mounting portion 450 of the slide 50. The plate connectors 422 may be inserted through the plate screw openings 482 of the plate 480 and then through the plate attachment openings 460 of the slide 50 to attach the plate 480 to the slide 50.

The plate 480 also includes forward connection pin recesses 486 that are aligned with the position of the forward pin openings 456 defined in the optical sight mounting portion 450 of slide 50. A forward connection pin 426 may be held within the forward pin opening 456 and the corresponding forward connection pin recess 486 so that the forward connection pin 426 is covered by the plate 480 and available for use if an optical sight assembly 410 is desired to be added to the firearm 20. Likewise, the plate includes rear connection pin recess 488 that are aligned with the position of the rear pin openings 458 defined in the optical sight mounting portion 450 of slide 50. A rear connection pin 428 may be held within the rear pin opening 458 and the corresponding rear connection pin recess 488 so that the rear connection pin 428 is covered by the plate 480 and available for use if an optical sight assembly 410 is desired to be added to the firearm 20.

Figure 15:
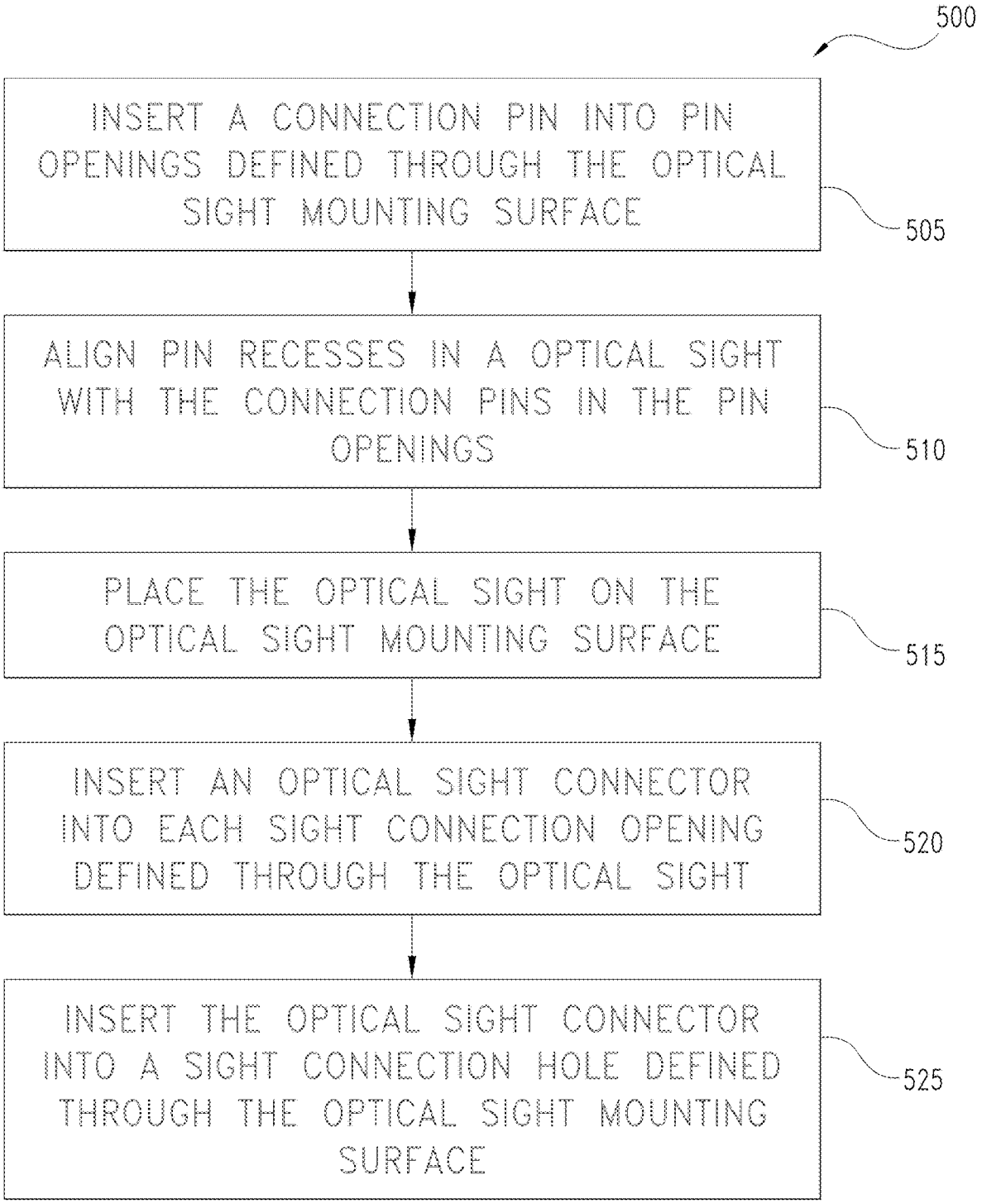
FIG. 15 is a flowchart for a method of installing an optical sight on the slide of the firearm of FIG. 1.

A flowchart 500 describing a method of installing an optical sight on a firearm is shown in FIG. 15. In a first stage 505, a connection pin is inserted into pin openings defined through the optical sight mounting surface on the top surface of the slide. The pin openings may be recessed into the optical sight mounting surface and the connection pins may fit within the pin openings so that a portion of the connection pin extends above the optical sight mounting surface.

In a second stage 510, the pin recesses in an optical sight are aligned with the connection pins that are positioned in the pin openings in the optical sight mounting surface. In a third stage 515, the optical sight is placed directly on the optical sight mounting surface of the slide so that the portion of the connection pins extending above the optical sight mounting surface enters the pin recesses of the optical sight. The connection pins may assist to secure the optical sight to the slide.

In a fourth stage 520, an optical sight connector is inserted into each sight connection opening defined through the optical sight. In a fifth stage 525, each optical sight connector is then inserted into a corresponding sight attachment opening that is defined through the optical sight mounting surface and that is aligned with the sight connection opening defined through the optical sight. In some embodiments, the optical sight connector may be threaded and the sight attachment opening may have corresponding threading so that the optical sight connector may be screwed into the sight connection opening.

To remove the optical sight from the slide, each of the optical sight connectors are removed from the sight attachment openings defined in the optical sight mounting surface and, optionally, removed from the corresponding sight connection opening defined through the optical sight. The optical sight is then pulled away from the optical sight mounting surface so that each connection pin is removed from the respective pin recess in the optical sight.

The first optical sight may then be replaced with a second optical sight that may have a different construction than the first optical sight. The method described in flowchart 500 may be repeated to install the second optical sight on the slide. For example, the location of the pin recesses on the second optical sight may be differ from the location of the pin recesses on the first optical sight. Therefore, the connection pins may be inserted into different pin openings in the optical sight mounting surface that align with the pin recesses of the second optical sight. The second optical sight may be then be placed directly on the optical sight mounting surface of the slide so that the portions of the connection pins extending above the optical sight mounting surface enter the pin recesses of the second optical sight. Optical sight connectors may be inserted into sight connection openings defined through the second optical sight and then inserted into corresponding sight attachment openings that are defined through the optical sight mounting surface. In some instances, the corresponding sight attachment openings for the second optical sight may be different than the sight attachment openings for the first optical sight.

Figure 16:
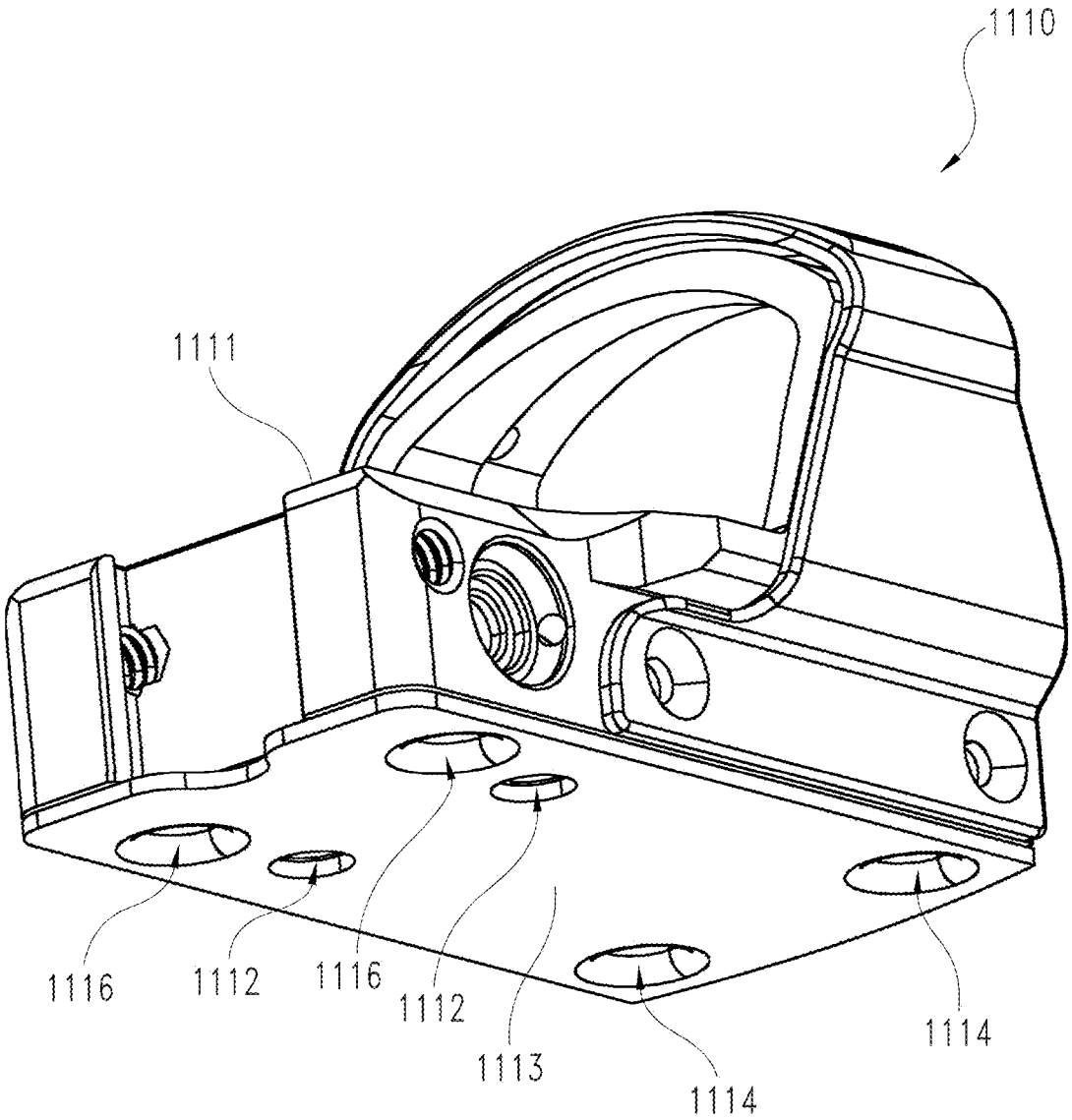
FIG. 16 is a rear perspective view of an optical sight for the firearm of FIG. 1.

A perspective view of one embodiment of an optical sight 1110 is shown in FIG. 16. Optical sight 1110 has a top surface 1111 and a bottom surface 1113 and a number of openings and recesses defined by the bottom surface 1113 that assist to secure the optical sight 1110 to the optical sight mount 1150. A pair of connection openings 1112 extend through the bottom surface 1113 of the optical sight 1110 and through the top surface 1111. The connection openings 1112 may receive a connector, such as a threaded screw, that forces the optical sight 1110 towards the optical sight mount 1150 of the firearm 20.

The optical sight 1110 includes a pair of forward pin recesses 1114 that are defined by the bottom surface 1113. In the embodiments shown, the forward pin recesses 1114 only extend through a portion of the optical sight 1110 and do not extend through the top surface 1111. Each of the forward pin recesses 1114 is configured to receive a connection pin that assists to secure the optical sight 1110 to the optical sight mount 1150, such as by resisting movement of the optical sight 1110 along the optical sight mount 1150.

Figure 17:
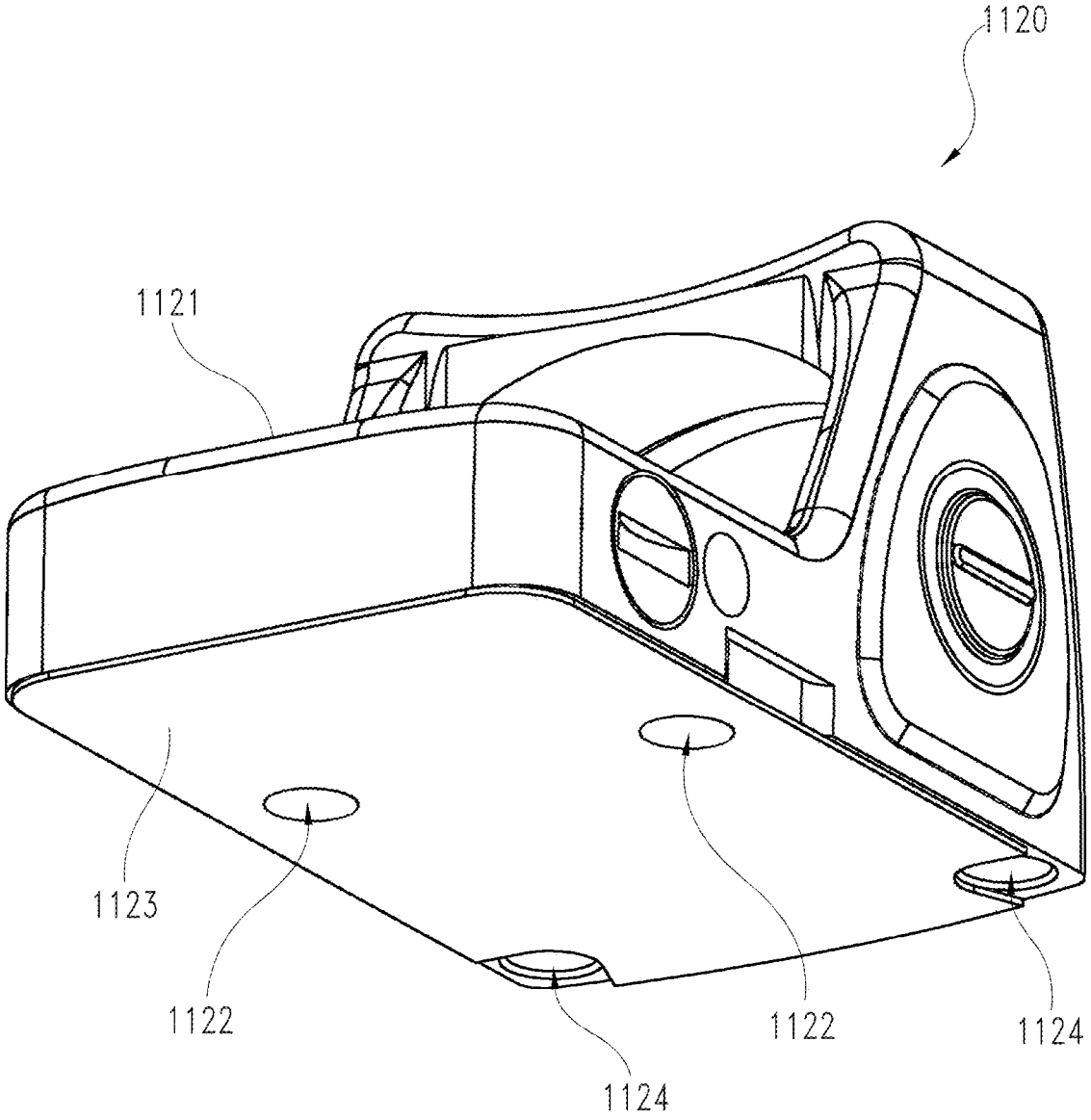
FIG. 17 is a rear perspective view of an alternative optical sight for the firearm of FIG. 1.

The optical sight 1110 also includes a pair of rear pin recesses 1116 that are defined by the bottom surface 1113. In the embodiments shown, the rear pin recesses 1116 only extend through a portion of the optical sight 1110 and do not extend through the top surface 1111. Each of the rear pin recesses 1116 is configured to receive a connection pin that resists (e.g., limits) movement of the optical sight 1110 along the optical sight mount 1150. In the embodiment shown, the rear pin recesses 1116 are positioned rearward of the connection openings 1112. An alternative embodiment of an optical sight 1120 is illustrated in FIG. 17. Optical sight 1120 has a top surface 1121 and a bottom surface 1123 and a number of openings and recesses defined by the bottom surface 1123 that assist to secure the optical sight 1120 to the optical sight mount 1150. A pair of connection openings 1122 extend through the bottom surface 1113 of the optical sight 1110 and through the top surface 1121. The connection openings 1122 may receive a connector, such as a threaded screw, that forces the optical sight 1120 towards the optical sight mount 1150 of the firearm 20.

The optical sight 1120 also includes a pair of forward pin recesses 1124 that are defined by the bottom surface 1123. In the embodiments shown, the forward pin recesses 1124 only extend through a portion of the optical sight 1120 and do not extend through the top surface 1121. Each of the forward pin recesses 1124 is configured to receive at least a portion of a connection pin that assists to resist (e.g., limit) movement of the optical sight 1120 along the optical sight mount 1150. In the embodiment shown, the forward pin recesses 1124 are positioned forward of the connection openings 1122 defined in optical sight 1120.

Figure 18:
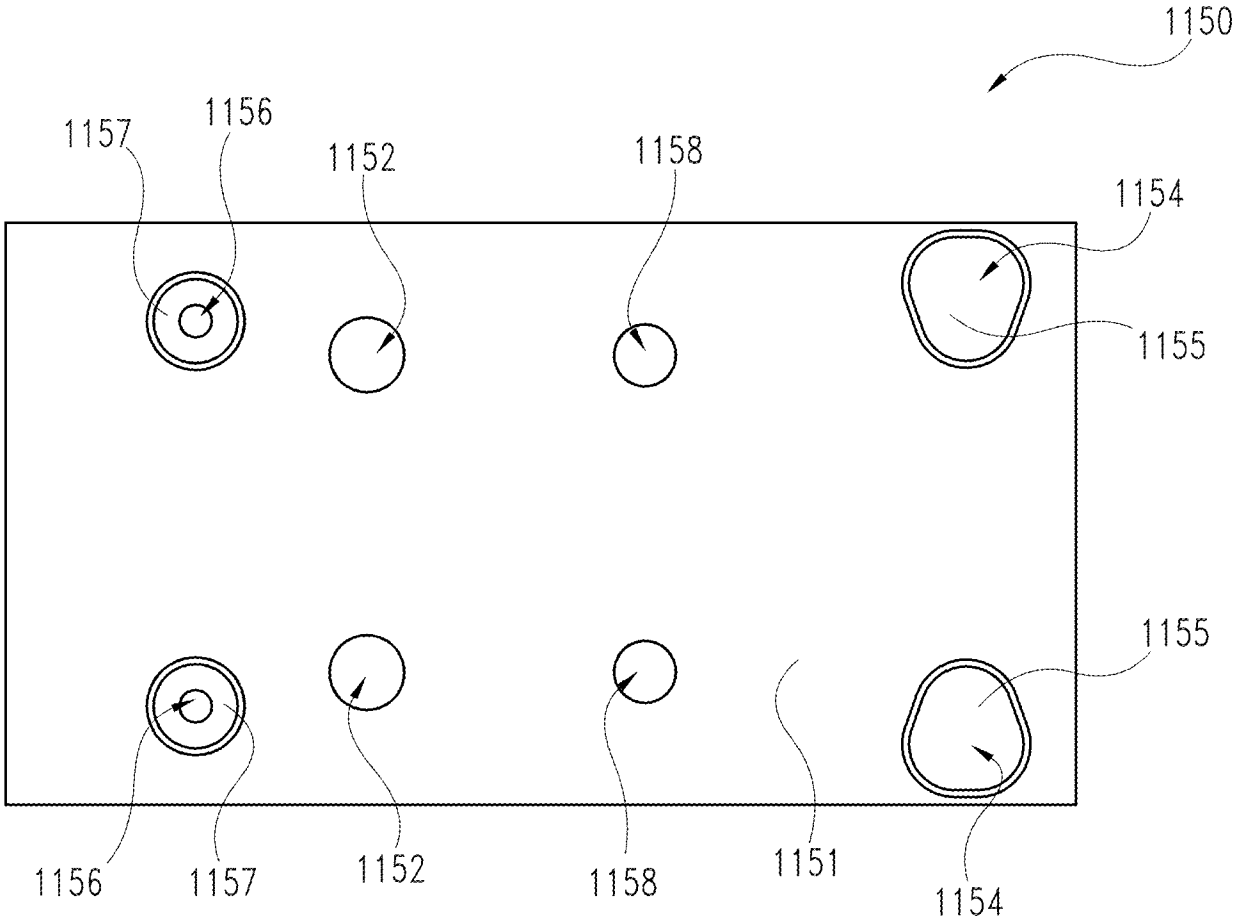
FIG. 18 is a top view of an optical sight mount of the firearm of FIG. 1.

A top view of the optical sight mount 1150 is shown in FIG. 18. The optical sight mount 1150 includes an optical sight mounting area having an optical sight mounting surface 1151 and a number of openings defined by the optical sight mounting surface 1151 that assist with securing the optical sight 1110 to the optical sight mount 1150. A pair of mounting opening 1152 are defined by the optical sight mounting surface 1151 of the optical sight mount 1150 and open towards the connection openings 1112 of the optical sight 1110 when the optical sight 1110 is positioned on the optical sight mount 1150. The mounting openings 1152 are configured to receive at least a portion of the connector that is inserted through the connection openings 1112.

A pair of forward pin openings 1154 are defined at least partially through the optical sight mounting surface 1151. The forward pin openings 1154 open towards the forward pin recesses 1114 of the optical sight 1110 when the optical sight 1110 is secured to the optical sight mount 1150. In some embodiments, each of the forward pin openings 1154 may be shaped to receive a connection pin, e.g., connection pin 1220 (shown in FIG. 19). In some instances, the forward pin openings 1154 may have a non-symmetric shape. Each of the forward pin openings 1154 includes a pin opening bottom surface 1155, so that forward pin openings 1154 are blind holes defined by the optical sight mounting surface 1151.

A pair of rear pin openings 1156 are defined at least partially through the optical sight mounting surface 1151. Each of the rear pin openings 1156 includes a rear pin opening bottom surface 1157. The rear pin openings 1156 open towards the rear pin recesses 1116 of the optical sight 1110 when the optical sight 1110 is secured to the optical sight mount 1150. In the embodiment shown, the rear pin openings 1156 have a circular cross-section, but in other embodiments, the rear pin openings 1156 may be any suitable shape for receiving a connection pin to assist with securing the optical sight 1110 to the optical sight mount 1150.

The optical sight mount 1150 may also include one or more pairs of additional mounting openings, e.g., mounting openings 1158, that may allow a different optical sight (e.g., different type and/or brand of optical sight) other than optical sight 1110 to be mounted to the optical sight mount 1150. The mounting openings 1158 may be positioned on optical sight mount 1150 at a location that corresponds to the connection openings of a different variety of optical sight. In other embodiments, additional mounting openings or pin openings may be included on optical sight mount 1150 to accommodate even more varieties of optical sights.

Figure 19:
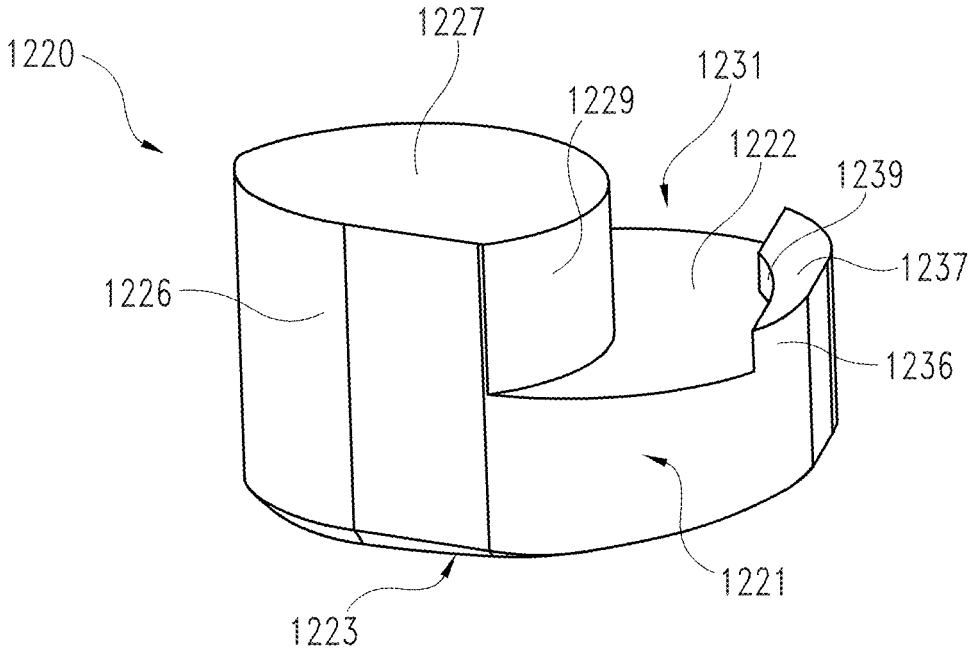
FIG. 19 is a perspective view of a connection pin for the firearm of FIG. 1.

FIG. 19 illustrates a perspective view of an embodiment of a connection pin 1220 for assisting to secure an optical sight 1110 to the optical sight mount 1150. In particular, in some embodiments, the connection pin 1220 may be used with the Leupold Deltapoint® Pro red dot sight. The connection pin 1220 has a pin base 1221 that has a cross-section that approximates the cross-sectional shape of the forward pin openings 1154. The pin base 1221 includes a base top surface 1222 and a pin bottom surface 1223. A pin body 1226 extends from the base top surface 222 at one end of the pin base 1221 and includes a body top surface 1227. In the embodiment shown, the pin body 1226 includes a curved pin inner surface 1229.

A pin projection 1236 extends from the other end of the base top surface 1222 of the pin base 1221 and includes a projection top surface 1237. A height of the pin projection 1236 may be less than a height of the pin body 1226 so that the projection top surface 1237 is positioned lower than the body top surface 1227. In the embodiment shown, the pin projection 1236 also includes a curved inner projection surface 1239. A pin channel 1231 is defined between the pin body 1226 and the pin projection 1236.

Figure 20:
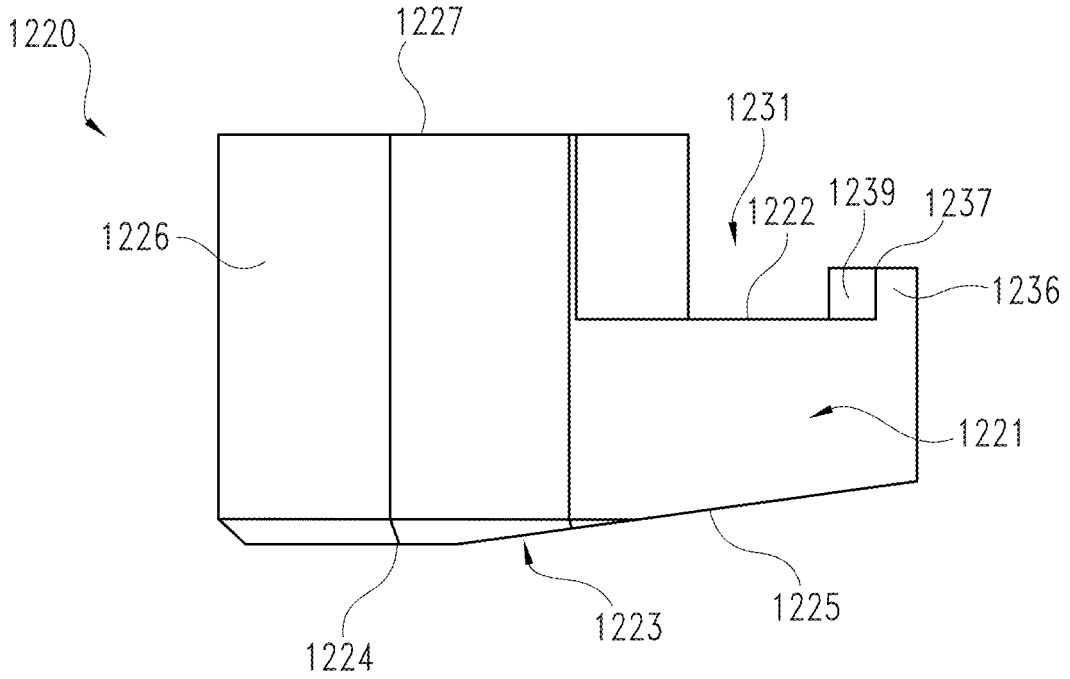
FIG. 20 is a rear view of the connection pin of FIG. 19.

A side view of the connection pin 1220 is shown in FIG. 20. As shown, the pin bottom surface 1223 may include two sections, a level portion 1224 and an angled portion 1225, with a pivot point between the two sections. The angled portion 1225 of the pin bottom surface 1223 is angled with respect to the level portion 1224 of the pin bottom surface 1223. Preferably, the connection pin 1220 is arranged so that the center of mass of the connection pin 1220 is positioned over the level portion 1224 of the pin bottom surface 1223 rather than over the angled portion 1225 of the pin bottom surface 1223. This allows the connection pin 1220 to sit on the level portion 1224 of the pin bottom surface 1223 when the connection pin 1220 is positioned within the forward pin opening 1154.

Figure 21:
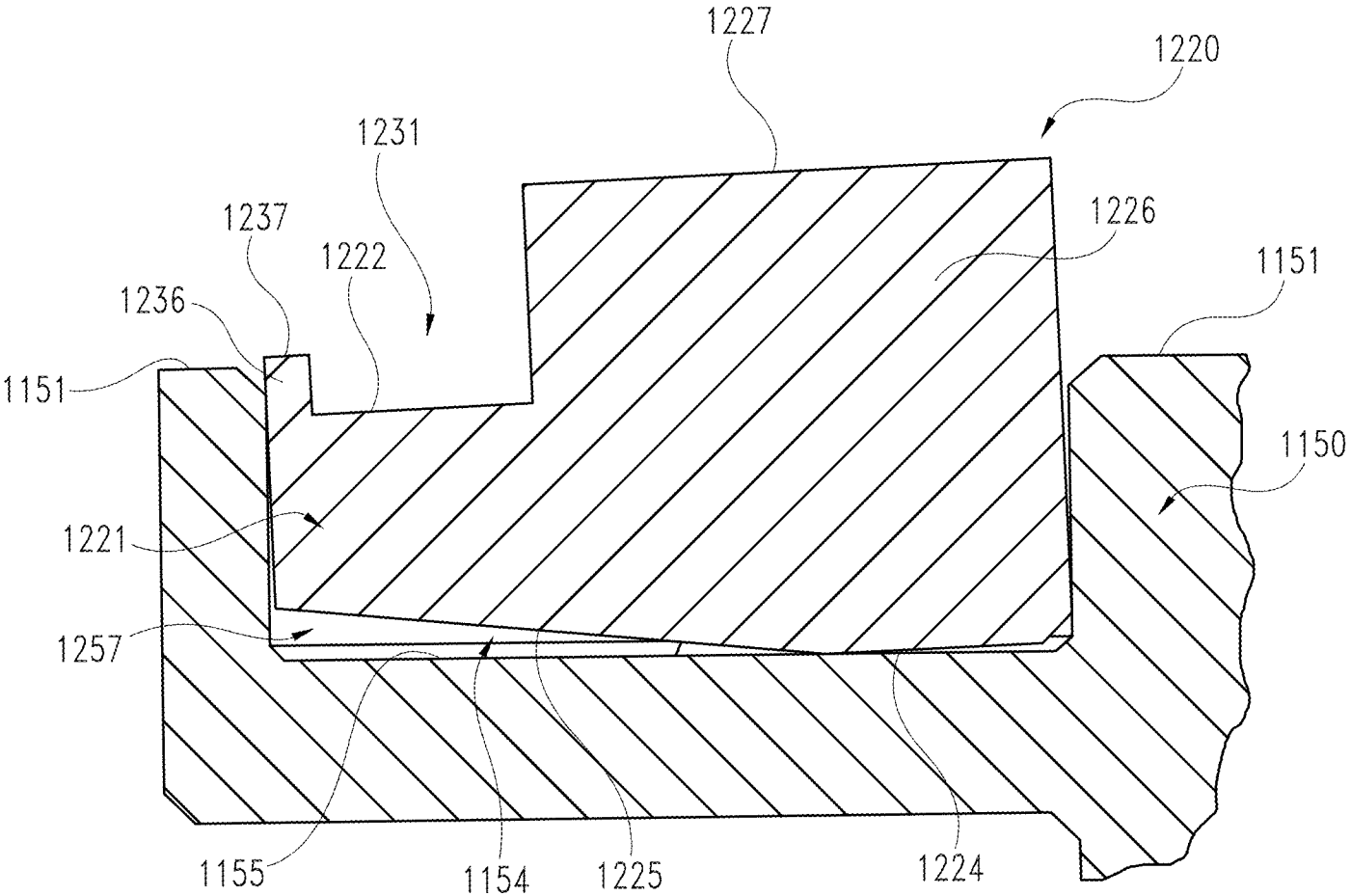
FIG. 21 is a partial cross-sectional rear view of the connection pin of FIG. 19 positioned within a pin opening of the optical sight mount.

A partial, cross-sectional view of one of the connection pins 1220 positioned within a respective forward pin opening 1154 is illustrated in FIG. 21. The connection pin 1220 may sit within the forward pin opening 1154 so that the level portion 1224 of the pin bottom surface 1223 is in contact with the pin opening bottom surface 1155 of the forward pin opening 1154. The angled portion 1225 of the pin bottom surface 1223 may be angled so that the angled portion 1225 of the pin bottom surface 1223 is not in contact with the pin opening bottom surface 1155, forming a gap 1257 between the angled portion 1225 of the pin bottom surface 1223 and the pin opening bottom surface 1155.

Figure 22:
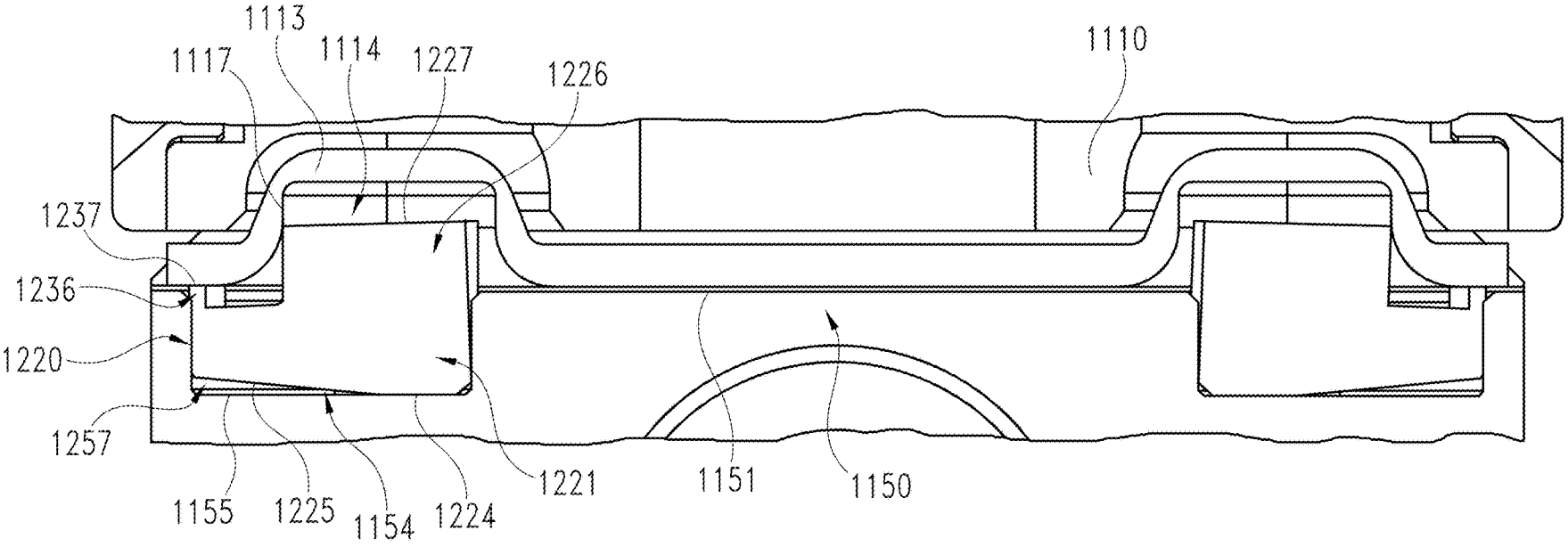
FIG. 22 is a partial cross-sectional rear view of the firearm of FIG. 1 showing the connection pins of FIG. 19 positioned within pin openings of the optical sight mount.

As shown in FIG. 21, the pin body 1226 of the connection pin 1220 has a height that allows the body top surface 1227 to extend above the optical sight mounting surface 1151 of the optical sight mount 1150. The pin projection 1236 also has a height that allows the projection top surface 1237 to extend above the optical sight mounting surface 1151 of the optical sight mount 1150 when the connection pin 1220 is positioned in the forward pin opening 1154 so that the only level portion 1224 of the pin bottom surface 223 is in contact with the pin opening bottom surface 1155. A partial, cross-sectional view of optical sight 1110 mounted to the optical sight mount 1150 is shown in FIG. 22. As shown, a connection pin 1220 is positioned in each of the forward pin openings 1154. As shown, in some instances, the forward pin recesses 1114 of certain optical sights may not be perfectly aligned with the forward pin openings 1154 of the optical sight mount 1150. Additionally, the forward pin recess 1114 may have a width that is less than the width of the forward pin opening 1154. This may cause the optical sight 1110 to not fit securely on optical sight mount 1150, allowing the position of the optical sight 1110 to shift upon handling of the firearm. A shift of position of the optical sight 1110 may reduce the accuracy of the optical sight and/or require recalibration.

The shape of the connection pins 1220 may assist to secure the optical sight 1110 to the optical sight mount 1150 and reduce movement of the optical sight 1110. When the optical sight 1110 is positioned on the optical sight mount 1150, a bottom surface 1113 of the optical sight 1110 comes into contact with the projection top surface of the pin projection 1236 of each of the connection pins 1220, causing the connection pin 1220 to rotate (e.g., pivot or tilt) within the forward pin opening 1154. The force of the bottom surface 1113 of the optical sight 1110 on the pin projection 1236 causes the angled portion 225 of the pin bottom surface 1223 to be pushed further into the forward pin opening 1154, into the gap 1257 formed between the angled portion 1225 of the pin bottom surface 1223 and the pin opening bottom surface 1155.

As the bottom surface 1113 of the optical sight 1110 contacts the pin projection 1236 and forces the pin projection 1236 portion of the connection pin 1220 further into the forward pin opening 1154, at least a portion of the pin body 1226 portion of the connection pin 1220 moves laterally with respect to the optical sight mounting surface 1151 of the optical sight mount 1150. The connection pin 1220 rotates (e.g., tilts) within the forward pin opening 1154 until the pin body 1226 contacts the bottom surface 1113 of the optical sight 1110 at an outside surface 1117 of the forward pin recess 1114 defined in the bottom surface 1113 of the optical sight 1110. Advantageously, the force on the pin projection 1236 applied by the bottom surface 1113 biases the pin body 1226 in an outward direction against the outside surface 1117 of the forward pin recess 1114 of the bottom surface 1113 of the optical sight 1110 This assists to at least resist lateral movement of the optical sight 1110 on the optical sight mount 1150 even when the forward pin recesses 1114 of the optical sight 1110 do not align exactly with the forward pin openings 1154 in the optical sight mount 1150 of the slide 50.

Preferably the projection top surface 1237 is further from the pivot point than the curved pin inner surface 1229, so as to provide a mechanical advantage (i.e., the force applied by curved pin inner surface 1229 being greater than the force applied to projection top surface 1237. It is contemplated, however, that the surface providing lateral force (i.e., along a direction parallel to the mounting surface) against the optical sight be further from the pivot point than the projection top surface.

Figure 23:
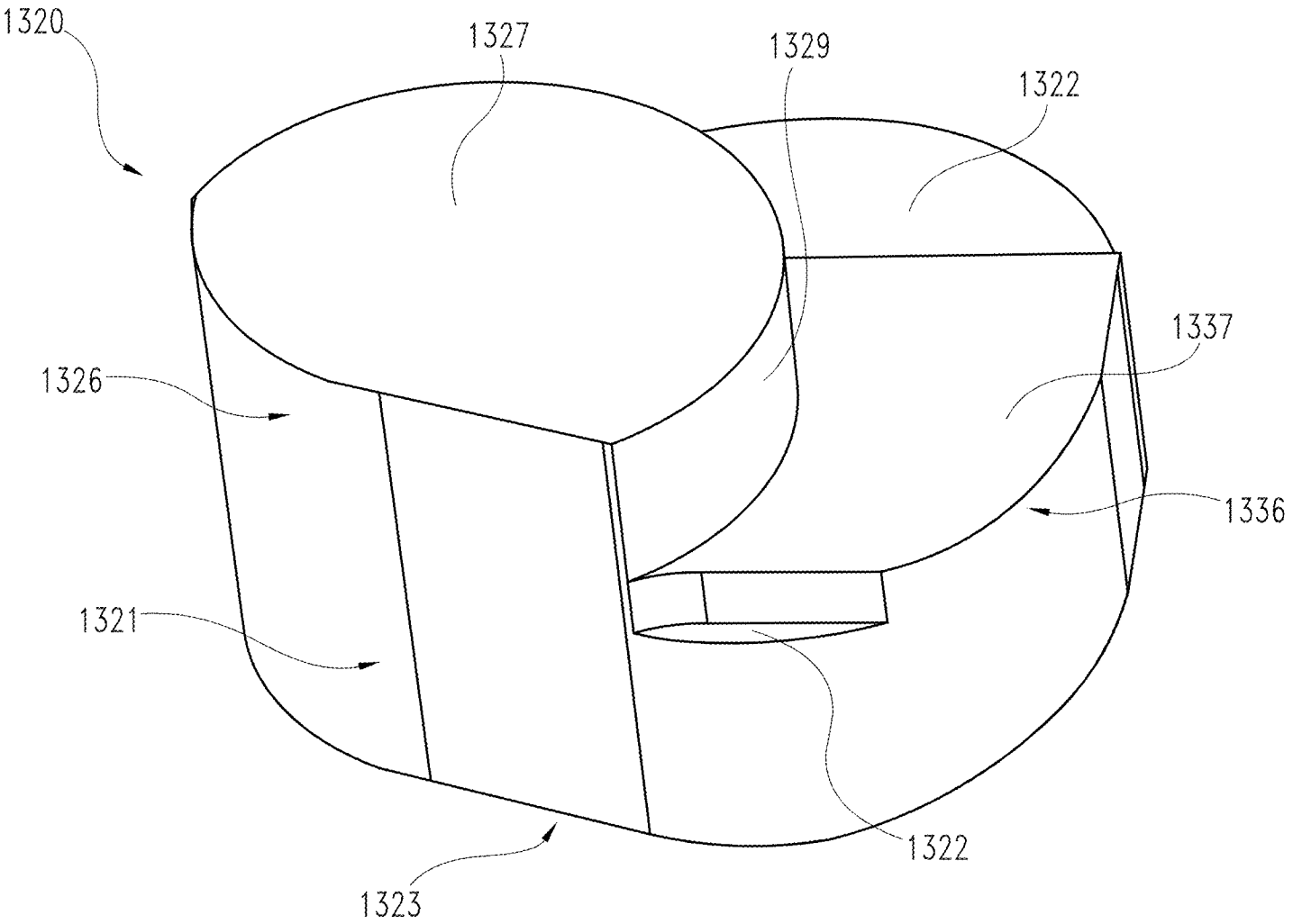
FIG. 23 is a perspective view of a connection pin for the firearm of FIG. 1.
Figure 24:
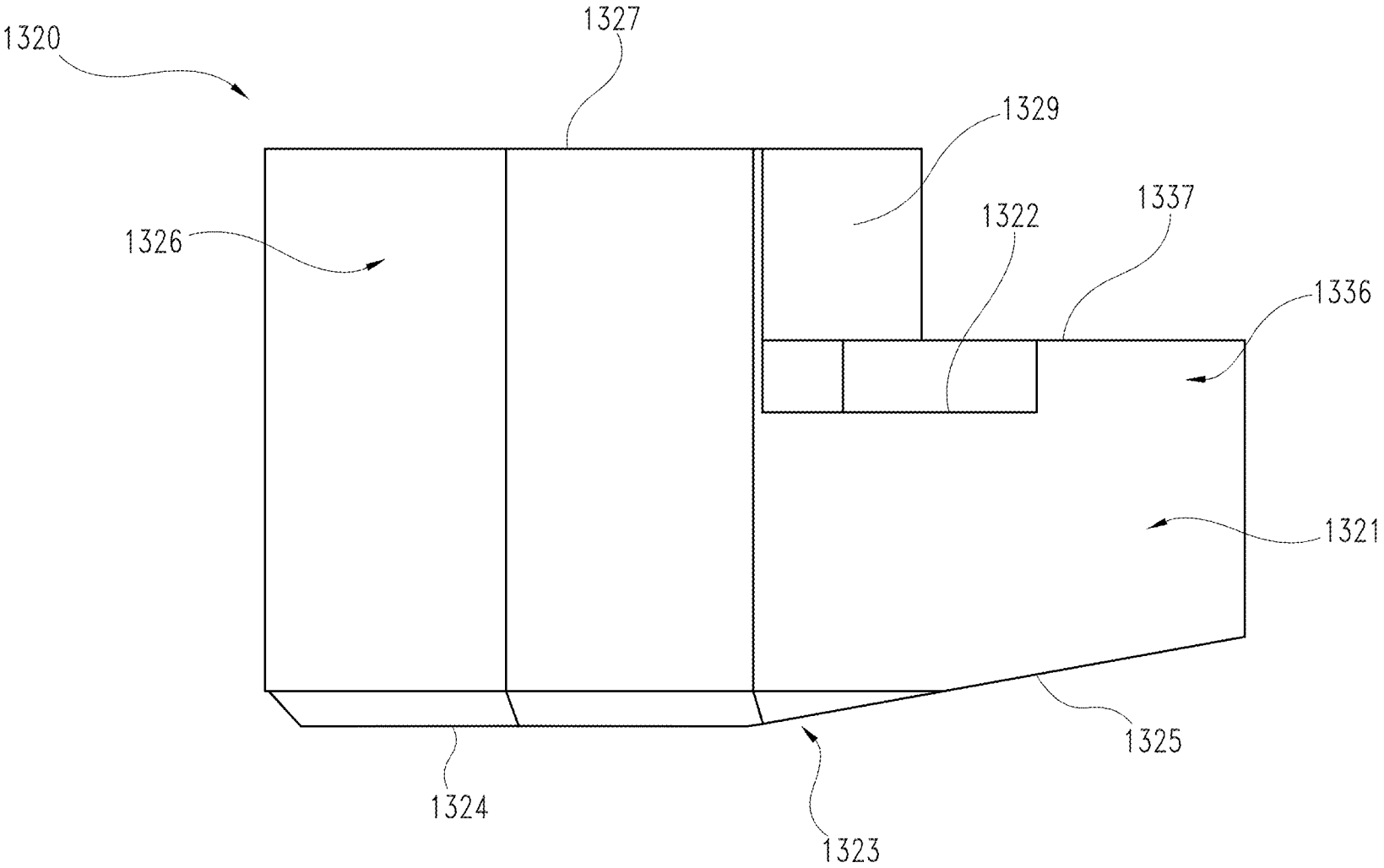
FIG. 24 is a rear view of the connection pin of FIG. 23.
Figure 25:
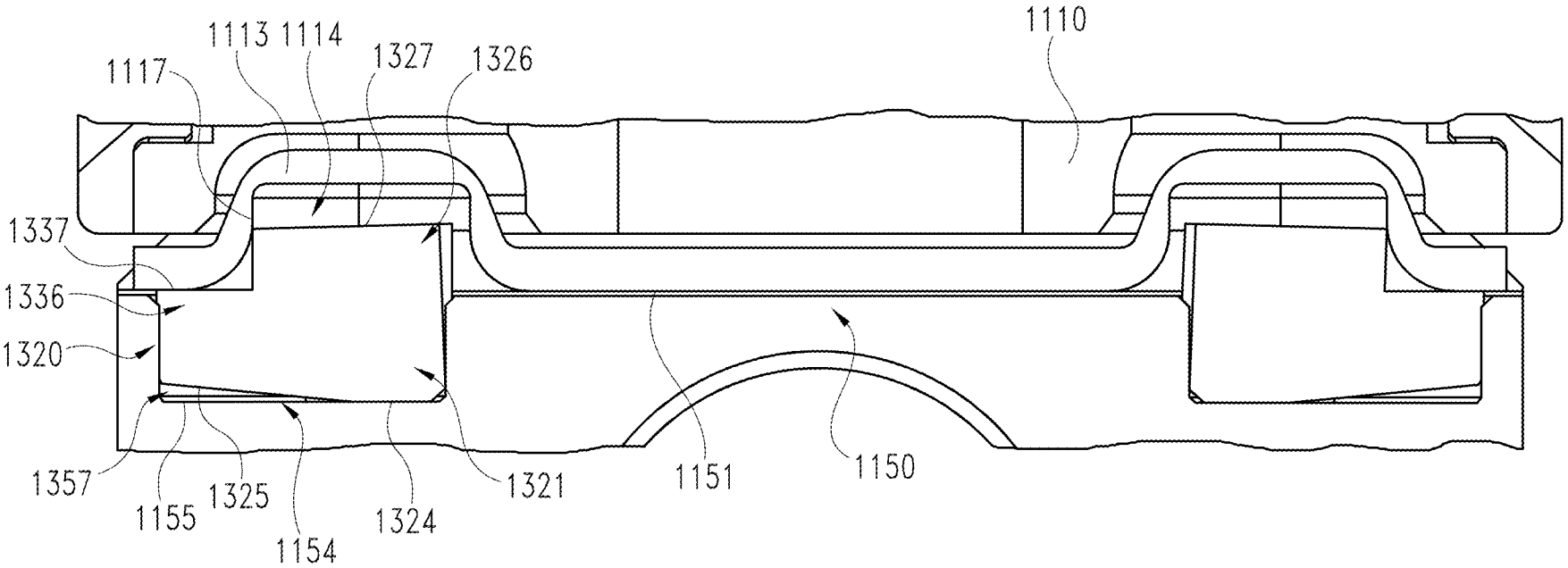
FIG. 25 is a partial cross-sectional rear view of the firearm of FIG. 1 showing the connection pins of FIG. 23 positioned within pin openings of the optical sight mount.

FIGS. 23-25 show another embodiment of a connection pin 1320. In particular, the connection pin 1320 may be used in some embodiments with the Leupold Deltapoint® Pro red dot sight. The connection pin 1320 has a pin base 1321. The pin base may have a cross-section that approximates the cross-sectional shape of the forward pin openings 1154. The pin base 1321 includes a base top surface 1322 and a pin bottom surface 1323. A pin body 1326 extends from the base top surface 1322 at one end of the pin base 1321 and includes a body top surface 1327. In the embodiment shown, the pin body 1326 includes a curved pin inner surface 1329.

A pin projection 1336 also extends from the base top surface 1322 and includes a projection top surface 1337. A height of the pin projection 1336 is less than a height of the pin body 1326 so that the projection top surface 1337 is positioned lower than the body top surface 1327. In the embodiment shown, the pin projection 1336 abuts the pin inner surface 1329. As shown in FIG. 24, the pin bottom surface 1323 includes two sections, a level portion 1324 and an angled portion 1325, with a pivot point between the two sections. The angled portion 1325 of the pin bottom surface 1323 is angled with respect to the level portion 1324 of the pin bottom surface 1323. Preferably, the connection pin 1320 is arranged so that the center of mass of the connection pin 1320 is positioned over the level portion 1324 of the pin bottom surface 1323 rather than over the angled portion 1325 of the pin bottom surface 1323. This allows the connection pin 1320 to sit on the level portion 1324 of the pin bottom surface 1323 when the connection pin 1320 is positioned within the forward pin opening 1154.

A partial, cross-sectional view of optical sight 1110 mounted to the optical sight mount 1150 is shown in FIG. 25. Similar to FIG. 22, a connection pin 1320 is positioned in each of the forward pin openings 1154 of the optical sight mount 1150. As shown, in some instances, the forward pin recesses 1114 of certain optical sights may have a width that is smaller than the width of a corresponding forward pin opening 1154 and/or the shape of the forward pin recess 1114 may not exactly correspond with the shape of the forward pin opening 1154.

The shape of the connection pins 1320 may assist to secure the optical sight 1110 to the optical sight mount 1150 and reduce movement of the optical sight 1110. The bottom surface 1113 of the optical sight 1110 comes into contact with the projection top surface 1337 of the pin projection 1336 of each of the connection pins 1320, causing the connection pin 1320 to rotate (e.g., tilt) within the forward pin opening 1154. The force of the bottom surface 1113 of the optical sight 1110 on the projection top surface 1337 of the pin projection 1336 causes the angled portion 1325 of the pin bottom surface 1323 to be pushed further into the forward pin opening 1154, into a gap 1357 formed between the angled portion 1325 of the pin bottom surface 1323 and the pin opening bottom surface 1155.

As the bottom surface 1113 of the optical sight 1110 contacts the pin projection 1336 and forces the pin projection 1336 of the connection pin 1320 further into the forward pin opening 1154, at least a portion of the pin body 1326 of the connection pin 1320 moves laterally with respect to the optical sight mounting surface 1151. The connection pin 1320 rotates (e.g., tilts) within the forward pin opening 1154 until the pin body 1326 contacts the bottom surface 1113 of the optical sight 1110 at an outside surface 1117 of the forward pin recess 1114 defined in the bottom surface 1113 of the optical sight 1110. Advantageously, the force on the pin projection 1336 applied by the bottom surface 1113 of the optical sight 1110 biases the pin body 1326 in an outward direction against the outside surface 1117 of the forward pin recess of the bottom surface 1113 of the optical sight 1110. This assists to at least resist lateral movement of the optical sight 1110 on the optical sight mounting surface 1151 even when the forward pin recesses 1114 of the optical sight 1110 do not align exactly with the forward pin openings 1154 in the optical sight mount 1150 of the slide 50.

Figure 26:
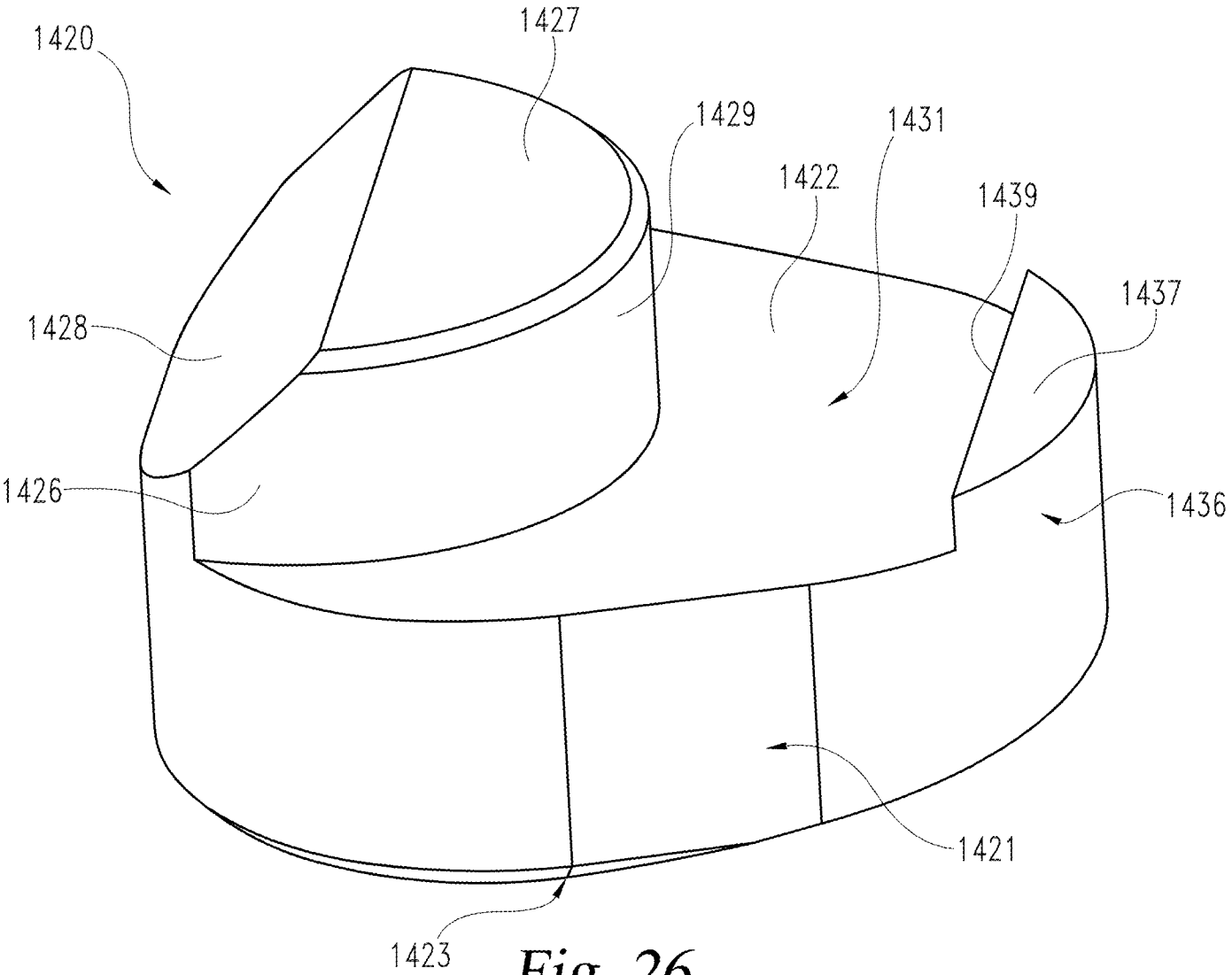
FIG. 26 is a perspective view of a connection pin for the firearm of FIG. 1.
Figure 27:
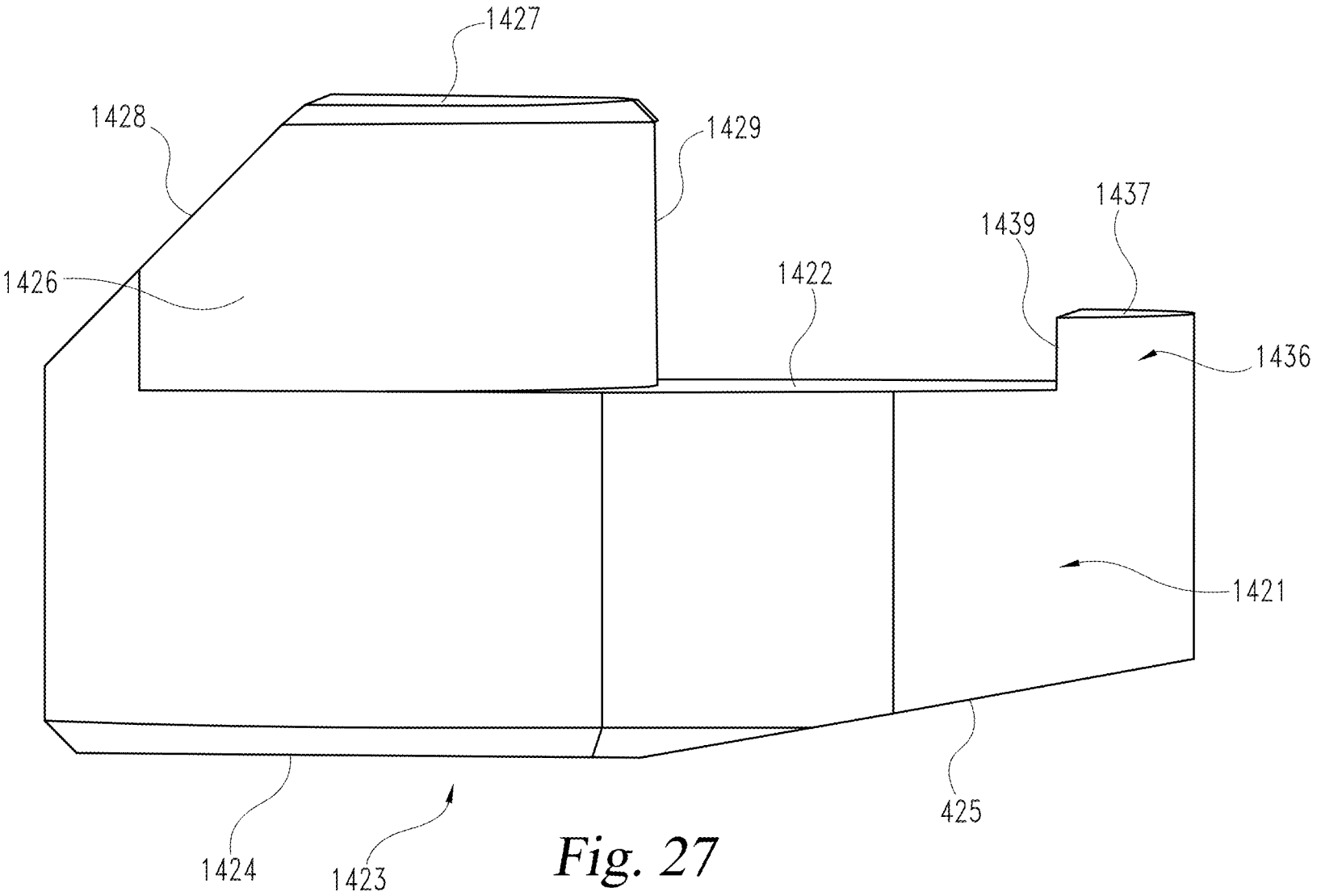
FIG. 27 is a rear view of the connection pin of FIG. 26.
Figure 28:
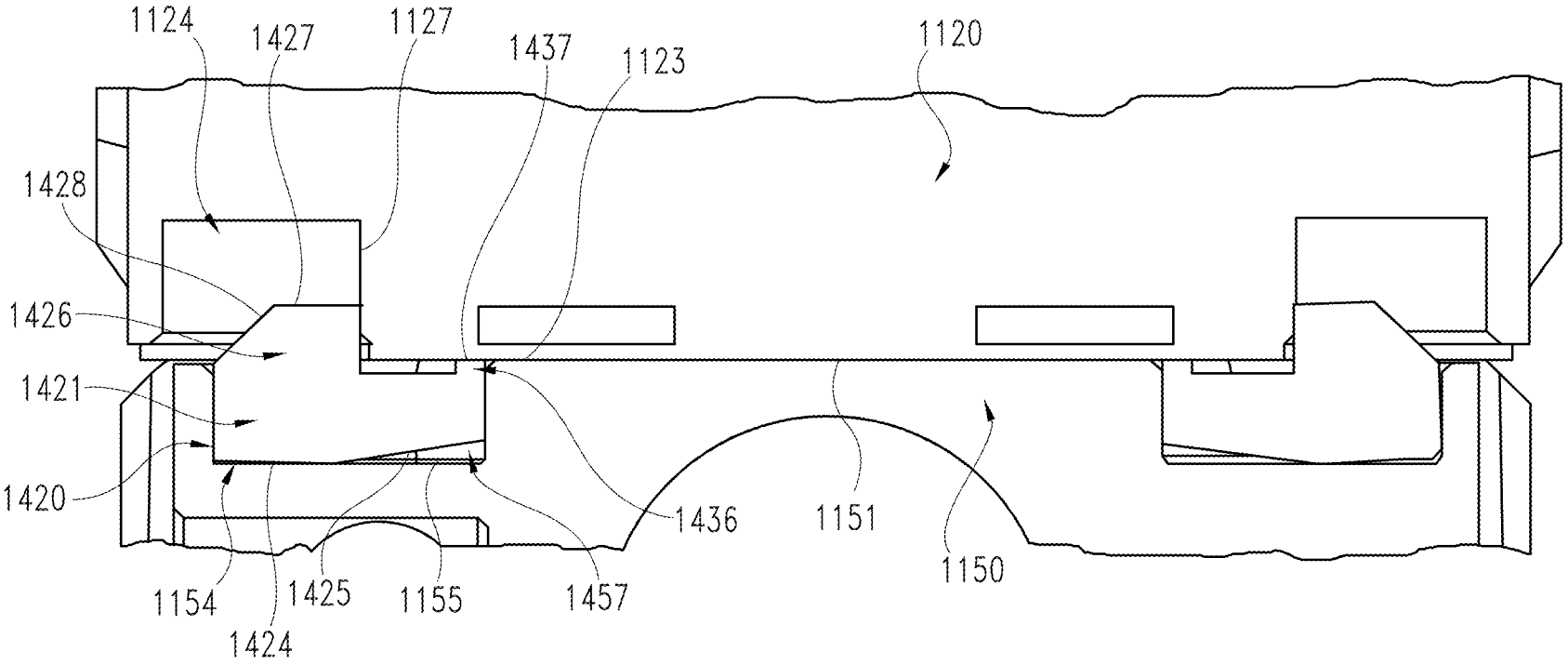
FIG. 28 is a partial cross-sectional rear view of the firearm of FIG. 1 showing the connection pins of FIG. 26 positioned within pin openings of the optical sight mount.

Preferably the projection top surface 1337 is further from the pivot point than the curved pin inner surface 1329, so as to provide a mechanical advantage (i.e., the force applied by curved pin inner surface 1329 being greater than the force applied to projection top surface 1337. It is contemplated, however, that the surface providing lateral force (i.e., along a direction parallel to the mounting surface) against the optical sight be further from the pivot point than the projection top surface. FIGS. 26-28 show another embodiment of a connection pin 1420. In particular, the connection pin 1420 may be used in some embodiments with a Trijicon RMR® optic sight. The connection pin 1420 has a pin base 1421 that has a cross-section that approximates the cross-sectional shape of the forward pin openings 1154. The pin base 1421 includes a base top surface 1422 and a pin bottom surface 1423. A pin body 1426 extends from the base top surface 1422 at one end of the pin base 1421 and includes a body top surface 1427. In the embodiment shown, the pin body 1426 also includes a slanted pin body outer surface 1428 and a curved pin body inner surface 1429.

A pin projection 1436 extends from the base top surface 1422 at another end of the pin base 1421 and includes a projection top surface 1437. A height of the pin projection 1436 is less than a height of the pin body 1426 so that the projection top surface 1437 is positioned lower than the body top surface 1427. In the embodiment shown, the pin projection 1436 also includes a planar inner projection surface 1439. A projection channel 1431 may be defined between the pin body 1426 and the pin projection 1436, so that the pin body 1426 does not come into contact with the pin projection 1436.

A side view of the connection pin 1420 is shown in FIG. 27. As shown, the pin bottom surface 1423 includes two sections, a level portion 1424 and an angled portion 1425, with a pivot point between the two sections. The angled portion 1425 of the pin bottom surface 1423 is angled with respect to the level portion 1424 of the pin bottom surface 1423. Preferably, the connection pin 1420 is arranged so that the center of mass of the connection pin 1420 is positioned over the level portion 1424 of the pin bottom surface 1423 rather than over the angled portion 1425 of the pin bottom surface 1423. This allows the connection pin 1420 to sit on the level portion 1424 of the pin bottom surface 1423 when the connection pin 1420 is positioned within the forward pin opening 1154.

A partial, cross-sectional view of optical sight 1120 mounted to the optical sight mount 1150 is shown in FIG. 28. A connection pin 1420 is positioned in each of the forward pin openings 1154 of the optical sight mount 1150. As shown, in some instances, the forward pin recesses 1124 of certain optical sights may have a width that is smaller than the width of a corresponding forward pin opening 1154 of the optical sight mount 1150, and/or the shape of the forward pin recess 1124 may not match or complement the shape of the forward pin opening 1154.

The shape of the connection pins 1420 may assist to secure the optical sight 1120 to the optical sight mount 1150 of slide 50. The optical sight bottom surface 1123 of the optical sight 1120 comes into contact with the projection top surface 1437 of the pin projection 1436 of each of the connection pins 1420, causing the connection pin 1420 to rotate (e.g., tilt) within the forward pin opening 1154. The force of the optical sight bottom surface 1123 on the projection top surface 1437 of the pin projection 1436 causes the angled portion 1425 of the pin bottom surface 1423 to be pushed further into the forward pin opening 1154, into a gap 1457 formed between the angled portion 1425 of the pin bottom surface 1423 and the pin opening bottom surface 1155.

As the optical sight bottom surface 1123 contacts the pin projection 1436 and forces the pin projection 1436 of the connection pin 1420 further into the forward pin opening 1154, at least a portion of the pin body 1426 of the connection pin 1420 moves laterally with respect to the optical sight mounting surface 1151. The connection pin 1420 rotates (e.g., tilts) within the forward pin opening 1154 until the pin body 1426 contacts the optical sight bottom surface 1123 at an inner surface 1127 of the forward pin recess 1124 defined in the optical sight bottom surface 1123 of the optical sight 1440. Advantageously, the force on the pin projection 1436 applied by the optical sight bottom surface 123 biases the pin body 1426 in an inward direction against the inner surface 1127 of the forward pin recess 1124 of the optical sight bottom surface 1123. This assists to at least resist movement of the optical sight 1120 on the optical sight mounting surface 1151 even when the forward pin recesses 1124 of the optical sight 1120 are not perfectly aligned with the forward pin openings 1154.

Preferably the projection top surface 1437 is further from the pivot point than the curved pin body inner surface 1429, so as to provide a mechanical advantage (i.e., the force applied by curved pin body inner surface 1429 being greater than the force applied to projection top surface 1437. It is contemplated, however, that the surface providing lateral force (i.e., along a direction parallel to the mounting surface) against the optical sight be further from the pivot point than the projection top surface.

Figure 29:
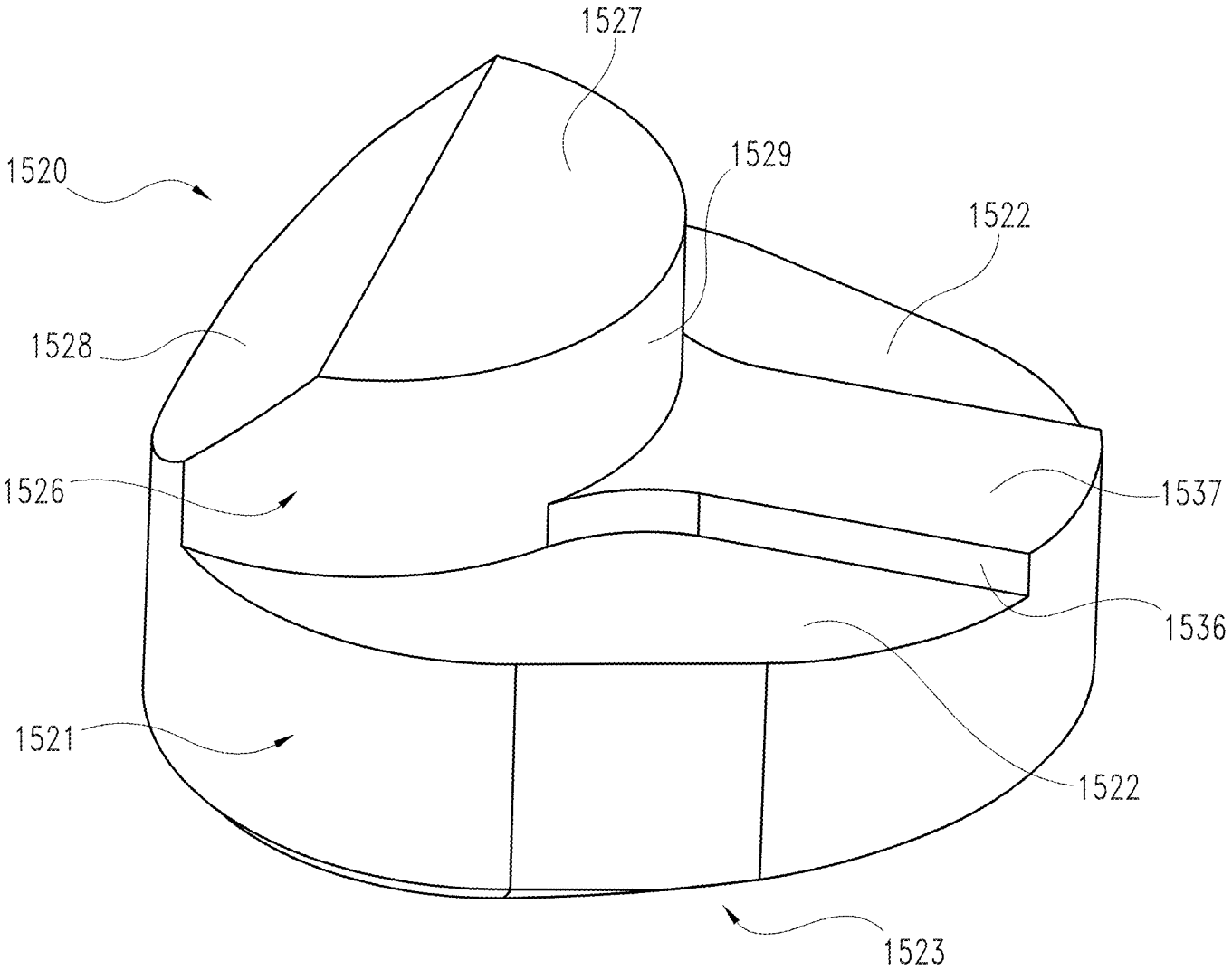
FIG. 29 is a perspective view of a connection pin for the firearm of FIG. 1.
Figure 30:
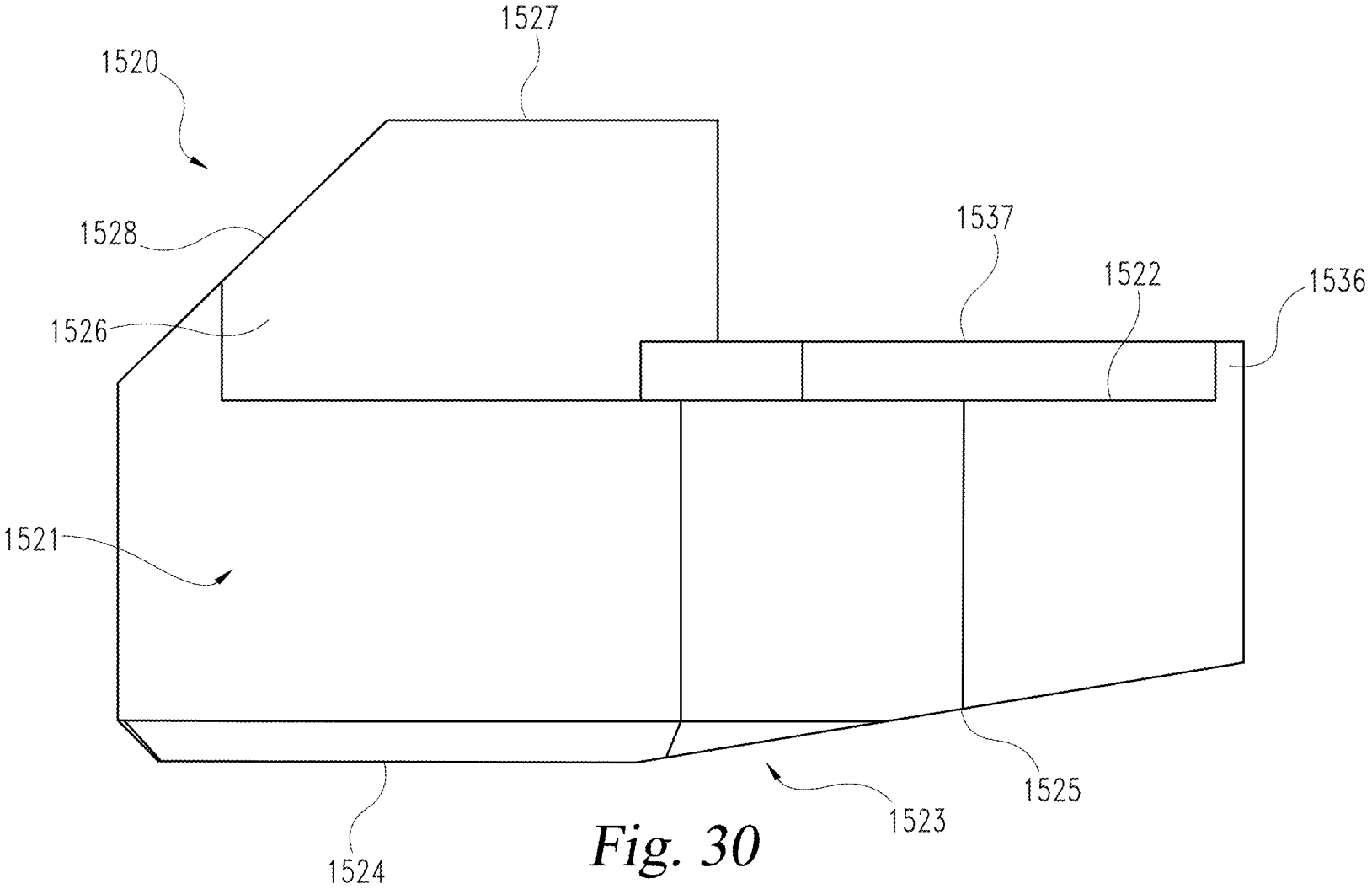
FIG. 30 is a rear view of the connection pin of FIG. 29.
Figure 31:
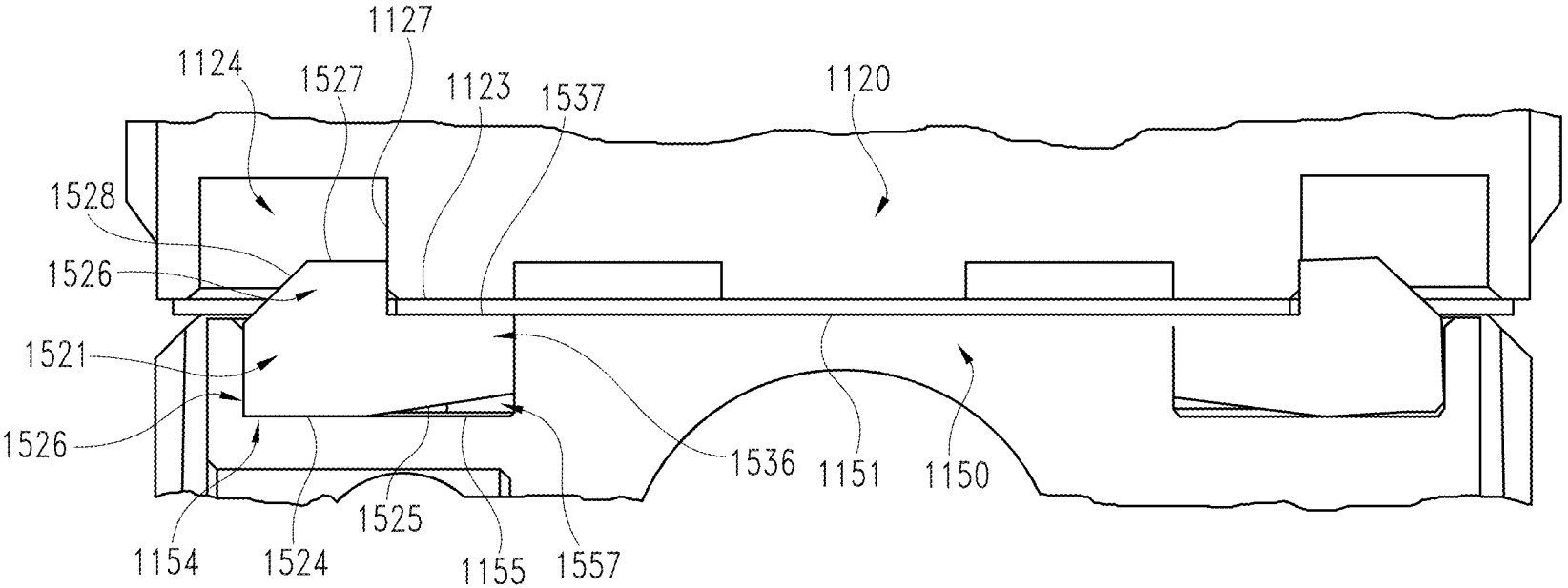
FIG. 31 is a partial cross-sectional rear view of the firearm of FIG. 1 showing the connection pins of FIG. 29 positioned within pin openings of the optical sight mount.

FIGS. 29-31 show another embodiment of a connection pin 1520. In particular, the connection pin 1520 may be used in some embodiments with a Trijicon RMR® optic sight. The connection pin 1520 has a pin base 1521 that has a cross-section that approximates the cross-sectional shape of the forward pin openings 1154. The pin base 1521 includes a base top surface 1522 and a pin bottom surface 1523. A pin body 1526 extends from one end of a top surface 1522 of the pin base 521 and includes a body top surface 1527. In the embodiment shown, the pin body 1526 also includes a slanted pin body outer surface 1528 and a curved pin body inner surface 1529.

A pin projection 1536 also extends from the top surface 1522 of the pin base 1521. The pin projection 1536 includes a projection top surface 1537. A height of the pin projection 1536 is less than a height of the pin body 1526 so that the projection top surface 1537 is positioned lower than the body top surface 1527. In the embodiment shown, the pin projection 1536 abuts the pin body 1526.

A side view of the connection pin 1520 is shown in FIG. 30. As shown, the pin bottom surface 1523 includes two sections, a level portion 1524 and an angled portion 1525, with a pivot point between the two sections. The angled portion 1525 of the pin bottom surface 1523 is angled with respect to the level portion 1524 of the pin bottom surface 1523. Preferably, the connection pin 1520 is arranged so that the center of mass of the connection pin 1520 is positioned over the level portion 1524 of the pin bottom surface 1523 rather than over the angled portion 1525 of the pin bottom surface 1523. This allows the connection pin 1520 to sit on the level portion 1524 of the pin bottom surface 1523 when the connection pin 1520 is positioned within the forward pin opening 1154.

A partial, cross-sectional view of optical sight 1120 mounted to the optical sight mount 1150 is shown in FIG. 31. A connection pin 1520 is positioned in each of the forward pin openings 1154 of the optical sight mount 150. As shown, in some instances, the forward pin recesses 1124 of certain optical sights may have a width that is smaller than the width of a corresponding forward pin opening 1154 of the optical sight mount 1150, and/or the shape of the forward pin recess 1124 may not exactly match or complement the shape of the forward pin opening 1154.

The shape of the connection pins 1520 may assist to secure the optical sight 1120 to the optical sight mount 1150. The optical sight bottom surface 1123 of the optical sight 1120 comes into contact with the projection top surface 1537 of the pin projection 1536 of each of the connection pins 1520, causing the connection pin 1520 to rotate (e.g., tilt) within the forward pin opening 1154. The force of the optical sight bottom surface 1123 on the projection top surface 1537 of the pin projection 1536 causes the angled portion 1525 of the pin bottom surface 1523 to be pushed further into the forward pin opening 1154, into a gap 1557 formed between the angled portion 1525 of the pin bottom surface 1523 and the pin opening bottom surface 1155.

As the optical sight 1120 contacts the pin projection 1536 and forces the pin projection 1536 of the connection pin 1520 further into the forward pin opening 1154, at least a portion of the pin body 1526 of the connection pin 1520 moves laterally with respect to the optical sight mounting surface 1151. The connection pin 1520 rotates (e.g., tilts) within the forward pin opening 1154 until the pin body 1526 contacts the optical sight bottom surface 1123 at the inner surface 1127 of the forward pin recess 1124 defined in the optical sight bottom surface 1123 of the optical sight 1120. Advantageously, the force on the pin projection 1536 applied by the optical sight bottom surface 1123 biases the pin body 1526 in an inward direction against the inner surface 1127 of the forward pin recess 1124 of the optical sight bottom surface 1123. This assists to at least resist movement of the optical sight 1120 on the optical sight mounting surface 151 even when the forward pin recesses 1124 of the optical sight 1120 are not perfectly aligned with the forward pin openings 1154.

Preferably the projection top surface is further from the pivot point than the curved inner projection surface, so as to provide a mechanical advantage (i.e., the force applied by curved inner projection surface being greater than the force applied to projection top surface. It is contemplated, however, that the surface providing lateral force (i.e., along a direction parallel to the mounting surface) against the optical sight be further from the pivot point than the projection top surface.

Figure 32:
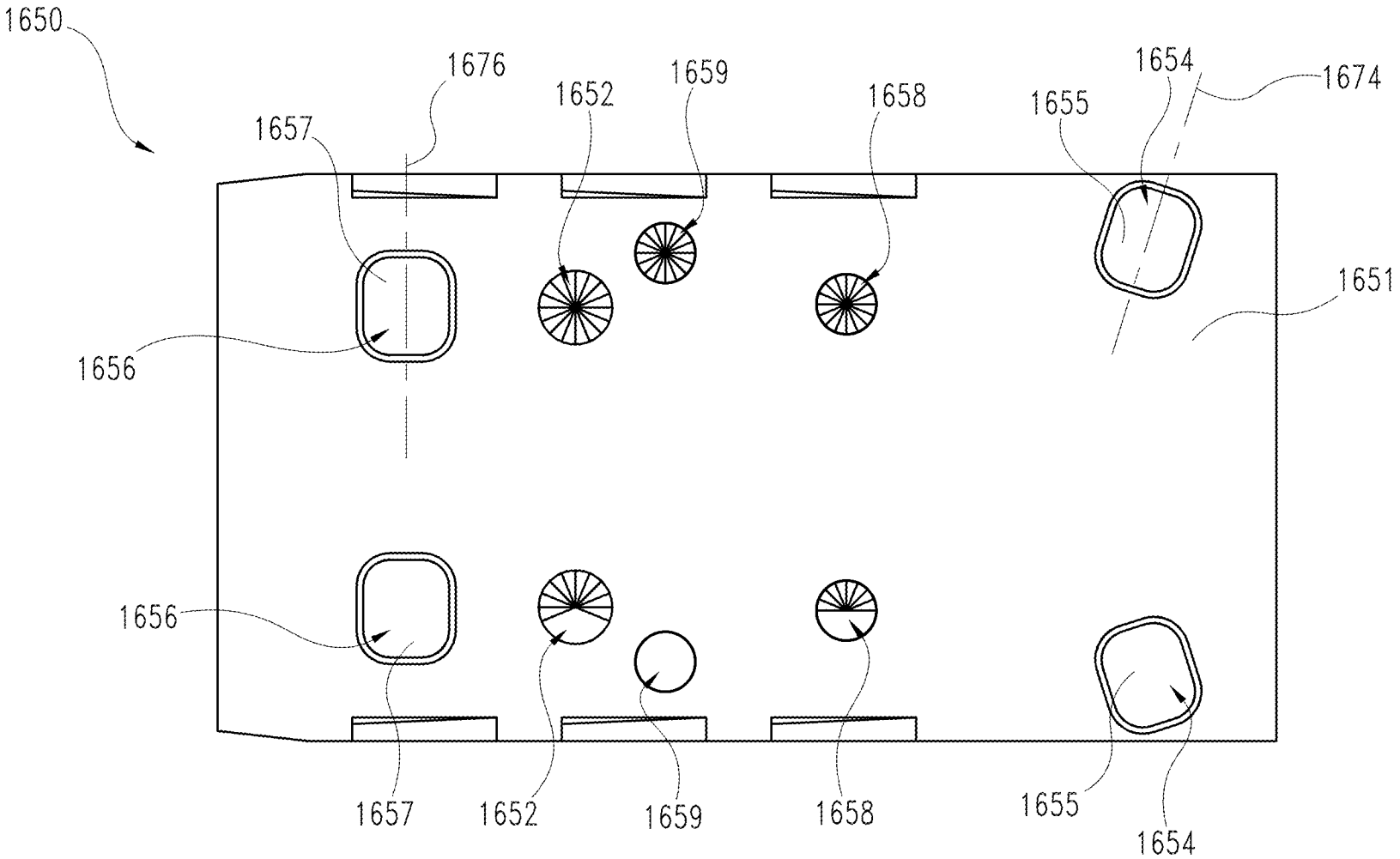
FIG. 32 is a top view of an optical sight mount of the firearm of FIG. 1.

A top view of an alternative embodiment of an optical sight mount 1650 is shown in FIG. 32. The optical sight mount 1650 includes an optical sight mounting surface 1651 and a number of openings defined by the optical sight mounting surface 1651 that assist with securing the optical sight 1110 to the optical sight mount 1650. A pair of mounting openings 1652 are defined by the optical sight mounting surface 1651 of the optical sight mount 1650 and open towards the connection openings 1112 of the optical sight 1110 when the optical sight 1110 is positioned on the optical sight mount 1650. The mounting openings 1652 are configured to receive at least a portion of the connector that is inserted through the connection openings 1112 of optical sight 1110.

A pair of forward pin openings 1654 are defined at least partially through the optical sight mounting surface 1651. The forward pin openings 1654 open towards the forward pin recesses 114 of the optical sight 1110 when the optical sight 1110 is secured to the optical sight mount 650. In some embodiments, each of the forward pin openings 1654 may be shaped to receive a connection pin, e.g., connection pin 1720 (shown in FIG. 33). Each of the forward pin openings 1654 includes a pin opening bottom surface 1655.

A pair of rear pin openings 1656 are defined at least partially through the optical sight mounting surface 1651. Each of the rear pin openings 1656 includes a rear pin opening bottom surface 1657. The rear pin openings 1656 open towards the rear pin recesses 1116 of the optical sight 1110 when the optical sight 1110 is secured to the optical sight mount 1650. In the embodiment shown, the rear pin openings 1656 have an oblong cross-section, but in other embodiments, the rear pin openings 1656 may be any suitable shape for receiving a connection pin to assist with securing the optical sight 1110 to the optical sight mount 1650.

As shown in FIG. 32, in some embodiments, the longitudinal axes 1674 defined by the forward pin openings 1654 may be at a transverse angle with respect to the longitudinal axes 1676 defined by the rear pin openings 1656. The angle of the forward pin openings 1654 may lead to a force being applied in both the front to back and side to side directions when the optical sight 1110 is attached to the optical sight mount 1650. Advantageously, this can assist to reduce movement of the optical sight in the axial and/or lateral direction with respect to the firearm when the optical sight 1110 is mounted on the optical sight mount 1650.

The optical sight mount 1650 may also include one or more pairs of additional mounting openings, e.g., mounting openings 1658 or mounting openings 1659, that may allow a different optical sight (e.g., different type and/or brand of optical sight) other than optical sight 1110 to be mounted to the optical sight mount 1650. The mounting openings 1658 or mounting openings 1659 may be positioned on optical sight mount 1650 at a location that corresponds to the connection openings of a different variety of optical sight. In other embodiments, additional pairs of mounting openings or pin openings may be included on optical sight mount 1650 to accommodate even more varieties of optical sights.

In some embodiments, the mounting openings 1658, 1659 may be threaded to receive threaded fasteners.

Preferably the projection top surface is further from the pivot point than the curved inner projection surface, so as to provide a mechanical advantage (i.e., the force applied by curved inner projection surface being greater than the force applied to projection top surface. It is contemplated, however, that the surface providing lateral force (i.e., along a direction parallel to the mounting surface) against the optical sight be further from the pivot point than the projection top surface.

Figure 33:
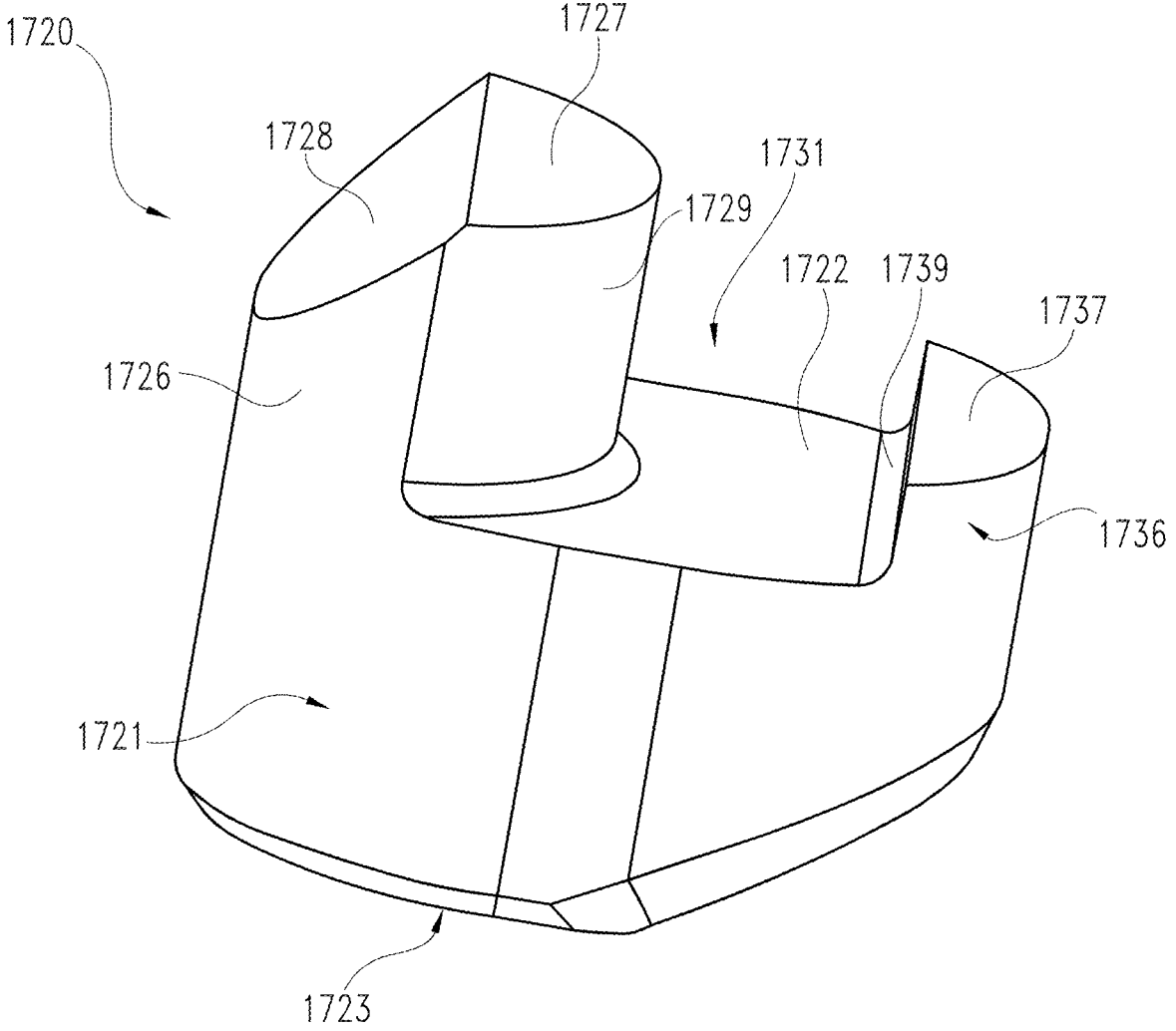
FIG. 33 is a perspective view of a connection pin for the firearm of FIG. 1.

FIG. 33 illustrates a perspective view of an embodiment of a connection pin 1720 for assisting to secure the optical sight 1110 to the optical sight mount 1650. In particular, in some embodiments, the connection pin 720 may be used in some embodiments with the Trijicon RMR® and/or the Leupold Deltapoint® Pro sight. The connection pin 1720 has a pin base 1721 that includes a base top surface 1722 and a pin bottom surface 1723. A pin body 1726 extends from the base top surface 1722 at one end of the pin base 1721 and includes a body top surface 1727. The body top surface 1727 includes an angled surface 1728 that extends downward and away from the body top surface 1727. In the embodiment shown, the pin body 1726 includes a pin inner surface 1729.

A pin projection 1736 extends from the other end of the base top surface 1722 of the pin base 1721 and includes a projection top surface 1737. A height of the pin projection 1736 is less than a height of the pin body 1726 so that the projection top surface 1737 is positioned lower than the body top surface 1727. In the embodiment shown, the pin projection 1736 also includes a planar inner projection surface 1739. A pin channel 1731 is defined between the pin body 1726 and the pin projection 1736.

Figure 34:
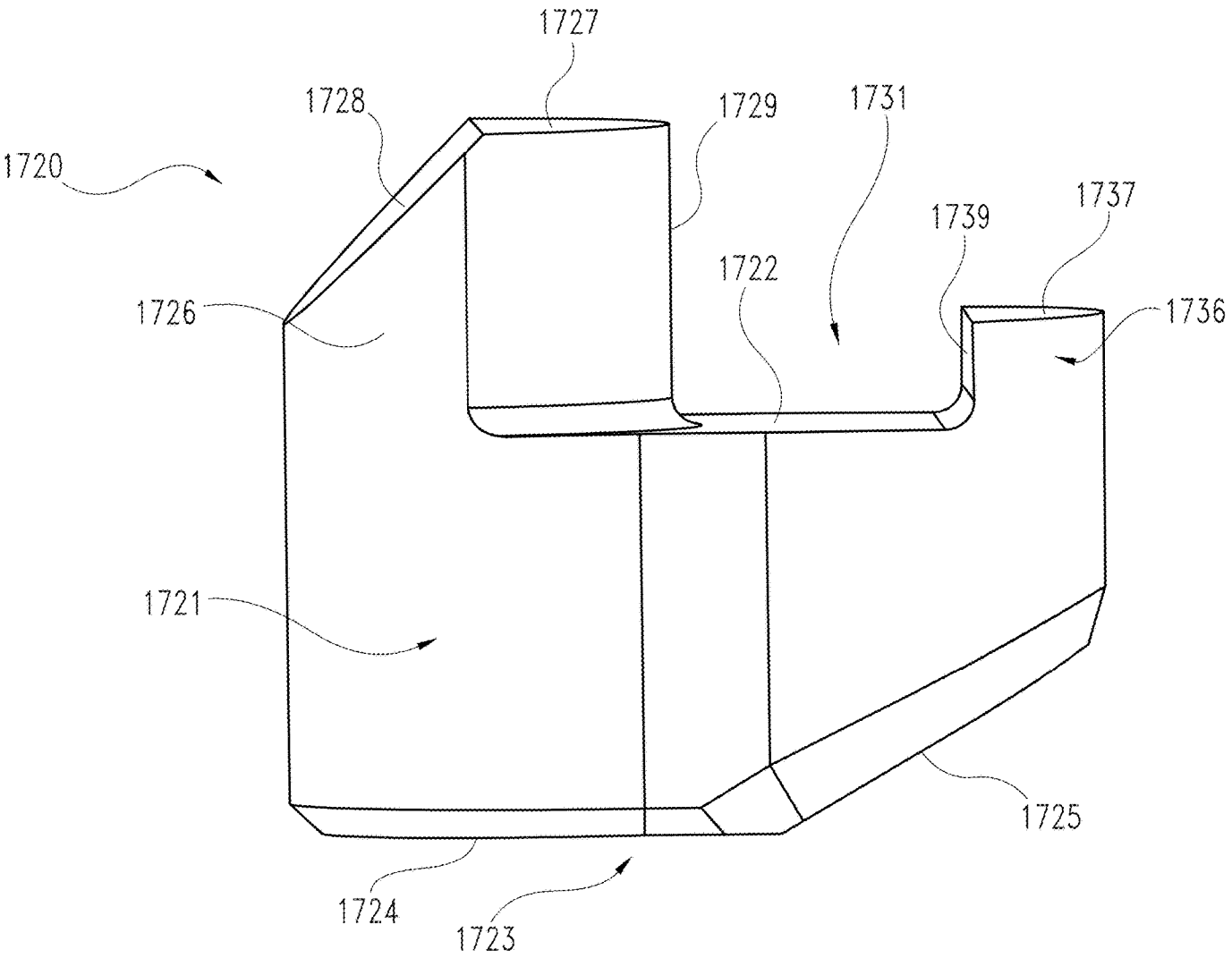
FIG. 34 is a side view of the connection pin of FIG. 33.

A side view of the connection pin 1720 is shown in FIG. 34. As shown, the pin bottom surface 1723 includes two sections, a level portion 1724 and an angled portion 1725, with a pivot point between the two sections. The angled portion 1725 of the pin bottom surface 723 is angled with respect to the level portion 1724 of the pin bottom surface 1723. Preferably, the connection pin 1720 is arranged so that the center of mass of the connection pin 1720 is positioned over the level portion 1724 of the pin bottom surface 1723 rather than over the angled portion 1725 of the pin bottom surface 1723. This allows the connection pin 1720 to sit on the level portion 1724 of the pin bottom surface 1723 when the connection pin 1720 is positioned within the forward pin opening 1654.

Figure 35:
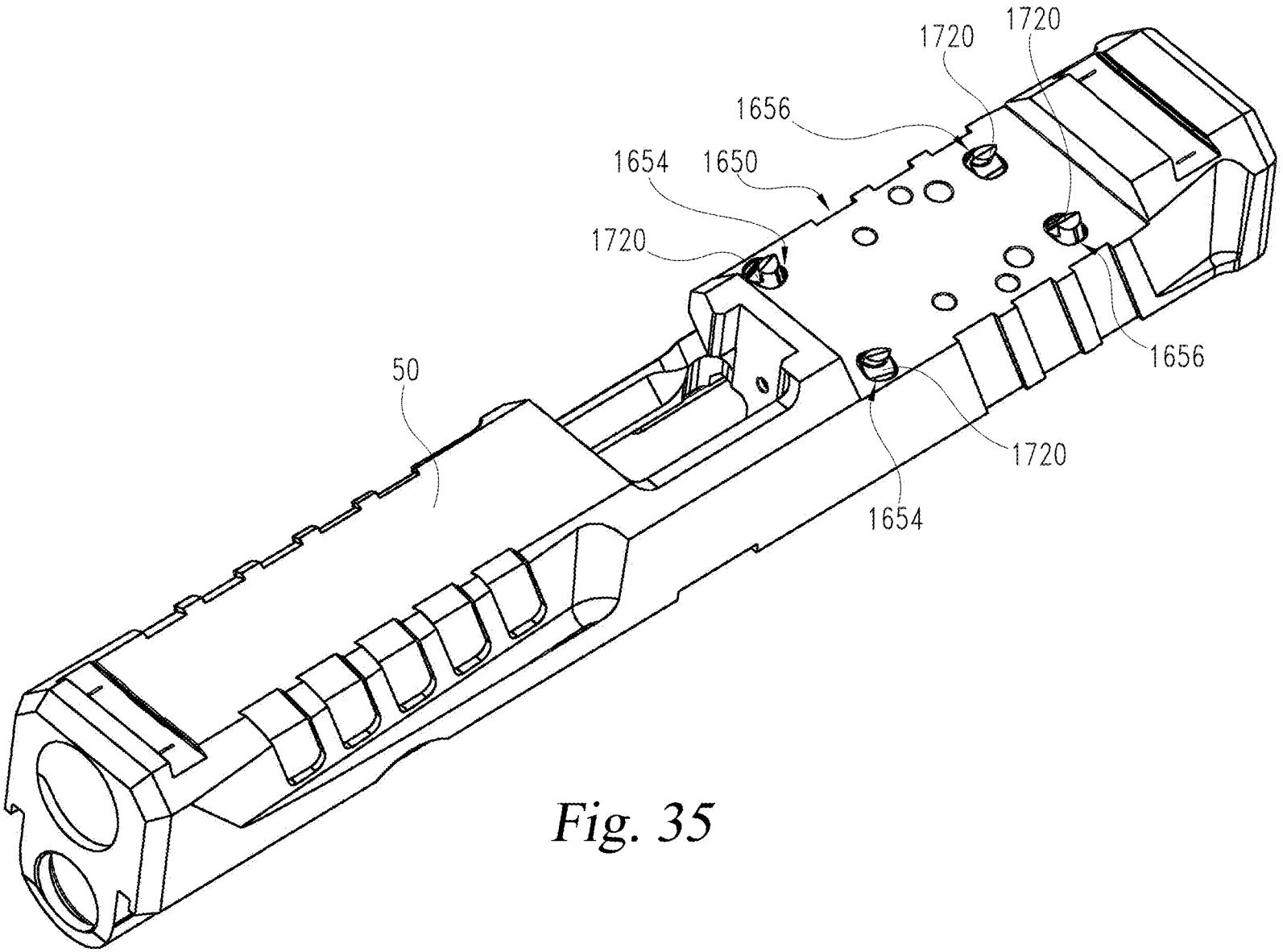
FIG. 35 is a front perspective view of the slide of the firearm of FIG. 1 with the connection pins of FIG. 33 positioned within pin openings of the optical sight mount.

As one example, a perspective view of the slide 50 of the firearm 20 with connection pins 1720 arranged for mounting optical sight 1110 onto the optical sight mount 1650 is shown in FIG. 35. As shown, a connection pin 1720 is positioned in each of the forward pin openings 1654 and a connection pin is positioned into each of the rear pin openings 1656. The connection pins 1720 that are positioned in the forward pin openings 1654 are oriented so that the pin projection 1736 of the connection pin 1720 is closer to the outer edge of the slide 50 than the pin body 1726. The connection pins 1720 that are positioned in the rear pin openings 1656 are oriented so that the pin body 1726 of the connection pin 1720 is closer to the outer edge of the slide 50 than the pin projection 1736.

Figure 36:
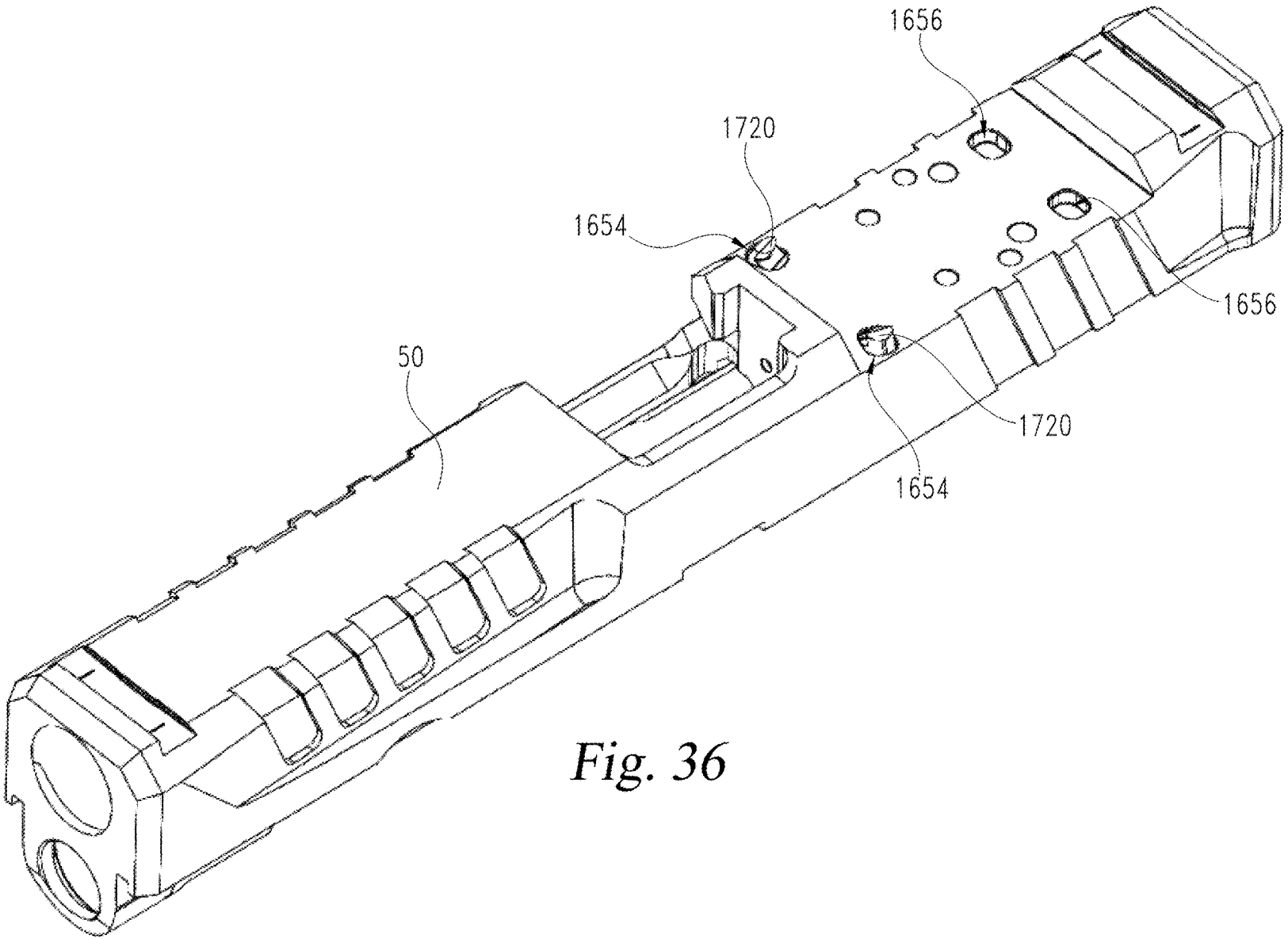
FIG. 36 is a front perspective view of the slide of the firearm of FIG. 1 with the connection pins of FIG. 33 positioned within pin openings of the optical sight mount.

FIG. 36 illustrates a second example, of the slide 50 of the firearm 20 with connection pins 1720 arranged for mounting optical sight 1120 onto the optical sight mount 1650. A connection pin 1720 is positioned in each of the forward pin openings 1654 that open towards the forward pin recesses 1124 in optical sight 1120 when the optical sight 1120 is positioned on the optical sight mount 1650. There may be no connection pins 1720 positioned in the rear pin openings 1656. The connection pins 1720 positioned in the forward pin openings 1654 are oriented so that the pin projection 1736 of the connection pin 1720 is closer to the outer edge of the slide 50 than the pin body 1726.

Figure 37:
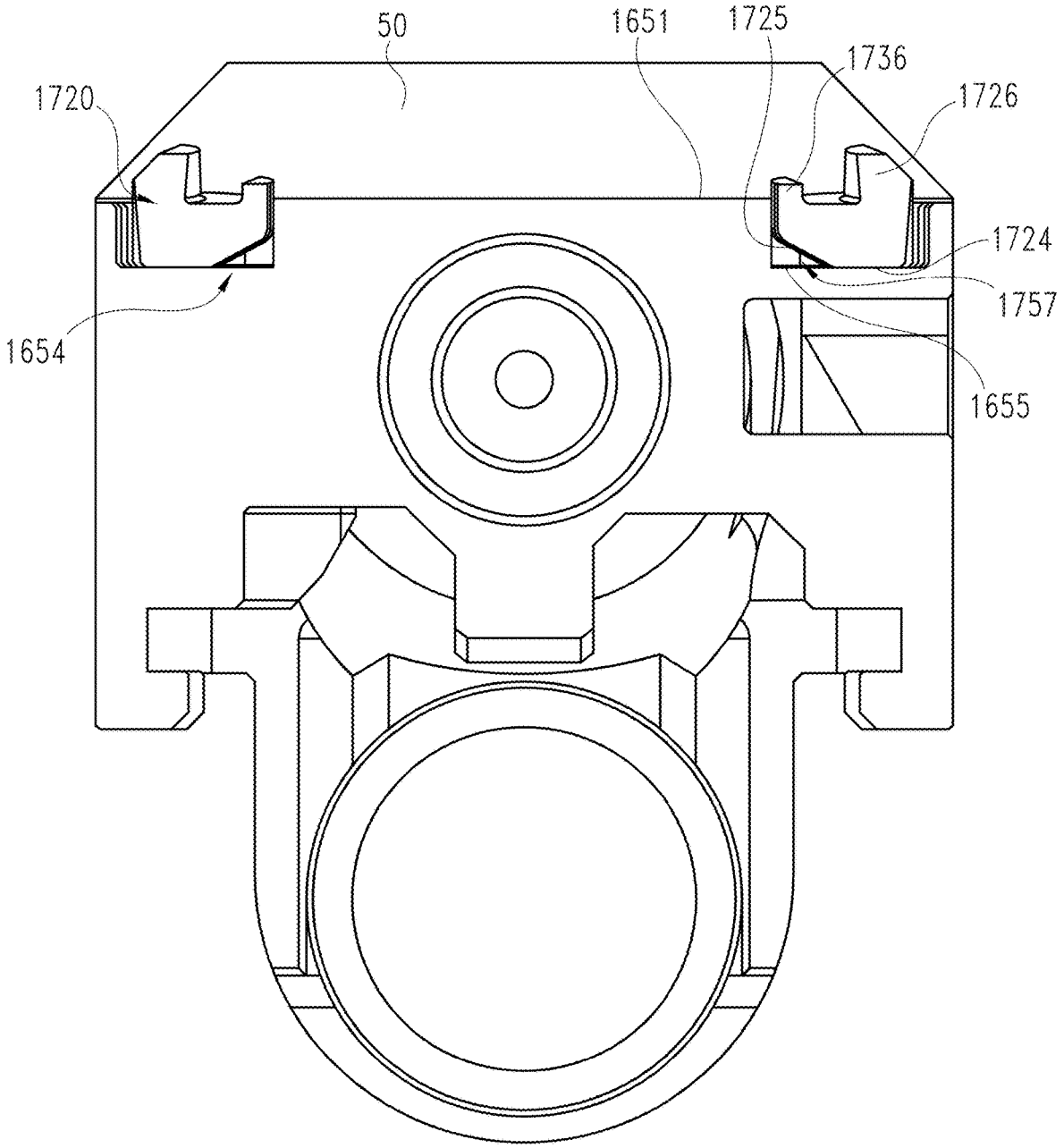
FIG. 37 is a cross-sectional rear view of the firearm of FIG. 1 showing the connection pins of FIG. 33 positioned within pin openings of the optical sight mount.

In operation, as shown in FIG. 37, the connection pin 1720 sits within the forward pin opening 1654, or in some instances, the rear pin opening 1656, so that the level portion 1724 of the pin bottom surface 1723 is in contact with the pin opening bottom surface 1655 of the forward pin opening 1654. The angled portion 1725 of the pin bottom surface 1723 is angled so that the angled portion 1725 of the pin bottom surface 1723 is not in contact with the pin opening bottom surface 1655, forming a gap 1757 between the angled portion 1725 of the pin bottom surface 1723 and the pin opening bottom surface 1655.

The pin body 1726 of the connection pin 1720 has a height that allows the body top surface 1727 to extend above the optical sight mounting surface 1651 of the optical sight mount 1650. The pin projection 1736 also has a height that allows the projection top surface 1737 to extend above the optical sight mounting surface 1651 of the optical sight mount 1650 when the connection pin 1720 is positioned in the forward pin opening 1654 and level portion 1724 of the pin bottom surface 1723 is in contact with the pin opening bottom surface 1655.

The shape of the connection pins 1720 may assist to secure the optical sight 1110 to the optical sight mount 1650 and reduce movement of the optical sight 1110. When the optical sight 1110 is positioned on the optical sight mount 1650, a bottom surface 1113 of the optical sight 1110 comes into contact with the projection top surface 1737 of the pin projection 1736 of the connection pins 1720, causing the connection pin 1720 to rotate (e.g., pivot or tilt) within the forward pin opening 1654. The force of the bottom surface 1113 of the optical sight 1110 on the pin projection 1736 causes the angled portion 1725 of the pin bottom surface 1723 to be pushed further into the forward pin opening 1654, into the gap 1757 formed between the angled portion 1725 of the pin bottom surface 1723 and the pin opening bottom surface 1655.

As the bottom surface 1113 of the optical sight 1110 contacts the pin projection 1736 and forces the pin projection 1736 portion of the connection pin 1720 further into the forward pin opening 1654, at least a portion of the pin body 1726 portion of the connection pin 1720 moves laterally with respect to the optical sight mounting surface 1651 of the optical sight mount 1650. The connection pin 1720 rotates (e.g., tilts) within the forward pin opening 1654 until the pin body 1726 contacts the bottom surface 113 of the optical sight 1110 at an outside surface 1117 of the forward pin recess 1114 defined in the bottom surface 1113 of the optical sight 1110. Advantageously, the force on the pin projection 736 applied by the bottom surface 1113 biases the pin body 1726 in an outward direction against the outside surface 1117 of the forward pin recess 1114 of the bottom surface 1113 of the optical sight 1110. This assists to at least resist lateral movement of the optical sight 1110 on the optical sight mount 1650 even when the forward pin recesses 1114 of the optical sight 1110 do not align exactly with the forward pin openings 1154 in the optical sight mount 1150 of the slide 50.

Preferably the projection top surface is further from the pivot point than the curved inner projection surface, so as to provide a mechanical advantage (i.e., the force applied by curved inner projection surface being greater than the force applied to projection top surface. It is contemplated, however, that the surface providing lateral force (i.e., along a direction parallel to the mounting surface) against the optical sight be further from the pivot point than the projection top surface.

Figure 38:
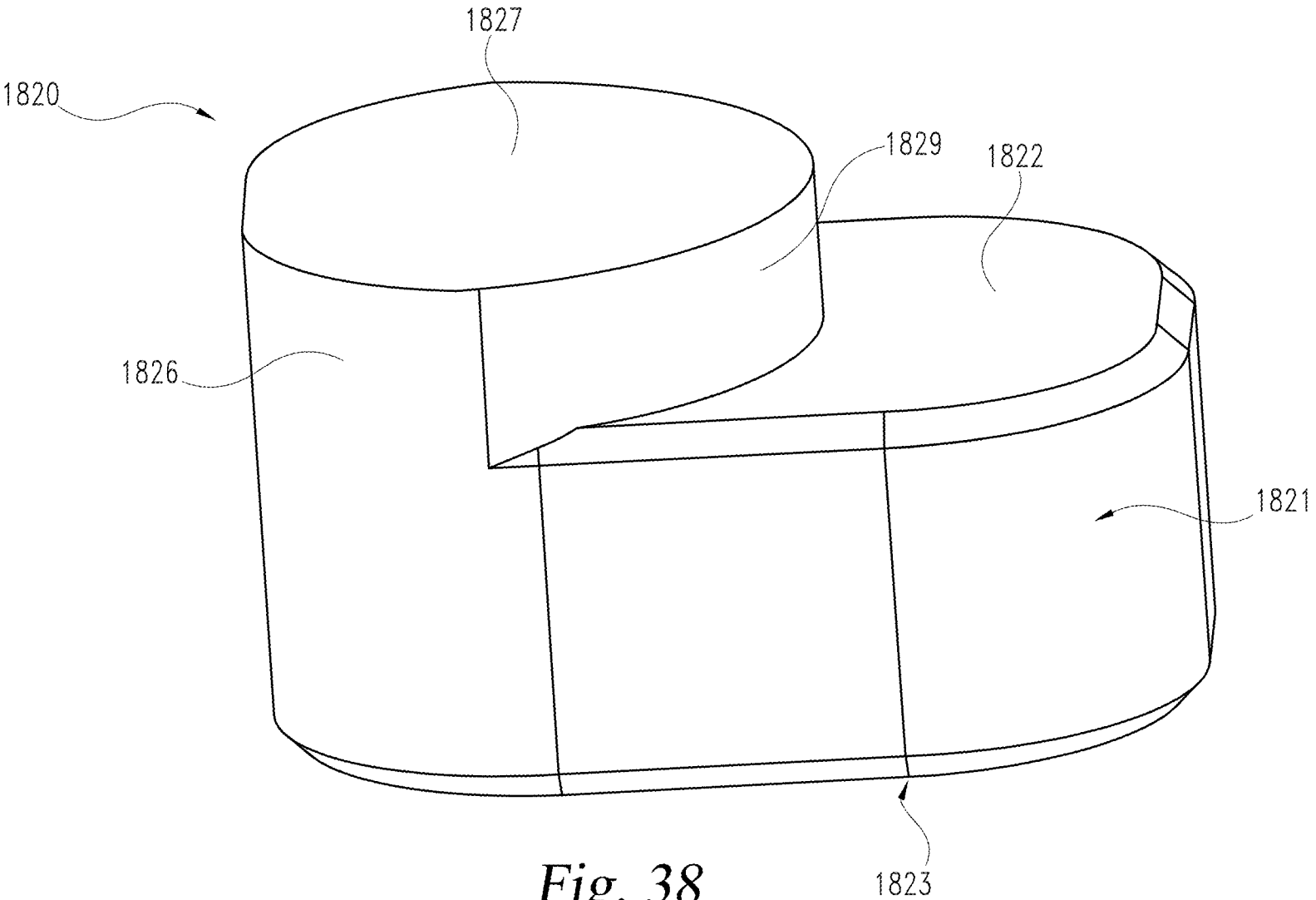
FIG. 38 is a perspective view of a connection pin for the firearm of FIG. 1.

An alternative embodiment of a connection pin 1820 is shown in FIG. 38. The connection pin 1820 has a pin base 1821 that has a cross-section that approximates the cross-sectional shape of the forward pin openings 1654 and rear pin openings 1656. The pin base 1821 includes a base top surface 1822 and a pin bottom surface 1823. A pin body 1826 extends from the base top surface 1822 at one end of the pin base 1821 and includes a body top surface 1827. In the embodiment shown, the pin body 1826 includes a curved pin inner surface 1829.

Figure 39:
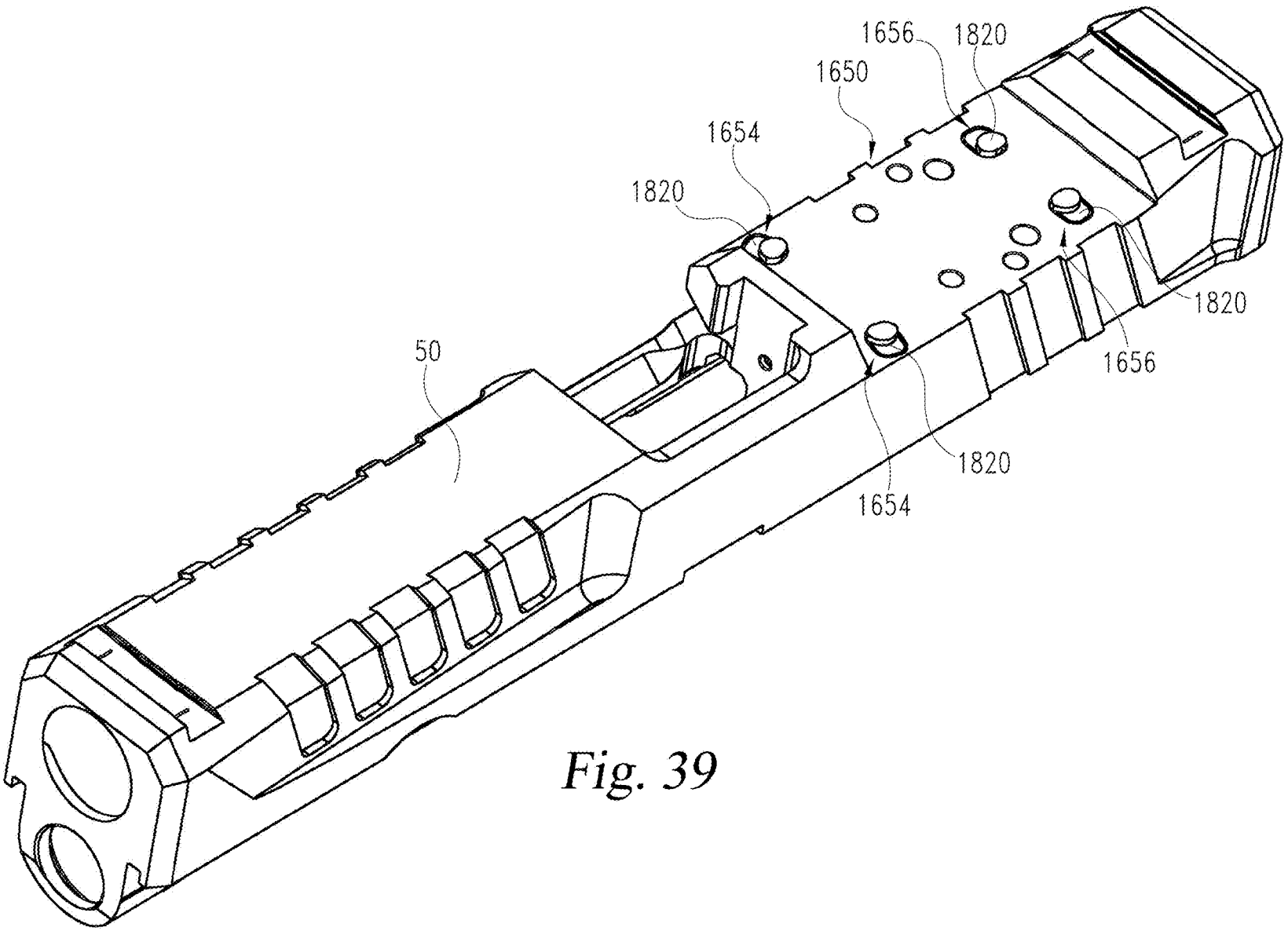
FIG. 39 is a front perspective view of the slide of the firearm of FIG. 1 with the connection pins of FIG. 38 positioned within pin openings of the optical sight mount.

FIG. 39 illustrates the slide 50 of the firearm 20 with connection pins 1820 arranged for mounting an optical sight onto the optical sight mount 1650. A connection pin 1820 is positioned in each of the forward pin openings 1654 and each of the rear pin openings 1656. Each of the connection pins 1820 that are positioned in the forward pin openings 1654 are oriented so that the pin body 1826 is positioned further from the outer edge of the slide 50 than the pin base top surface 1822. Likewise, each of the connection pins 1820 that are positioned in the rear pin openings 1656 are oriented so that the pin body 1826 is positioned further from the outer edge of the slide 50 than the pin base top surface 1822.

Figure 40:
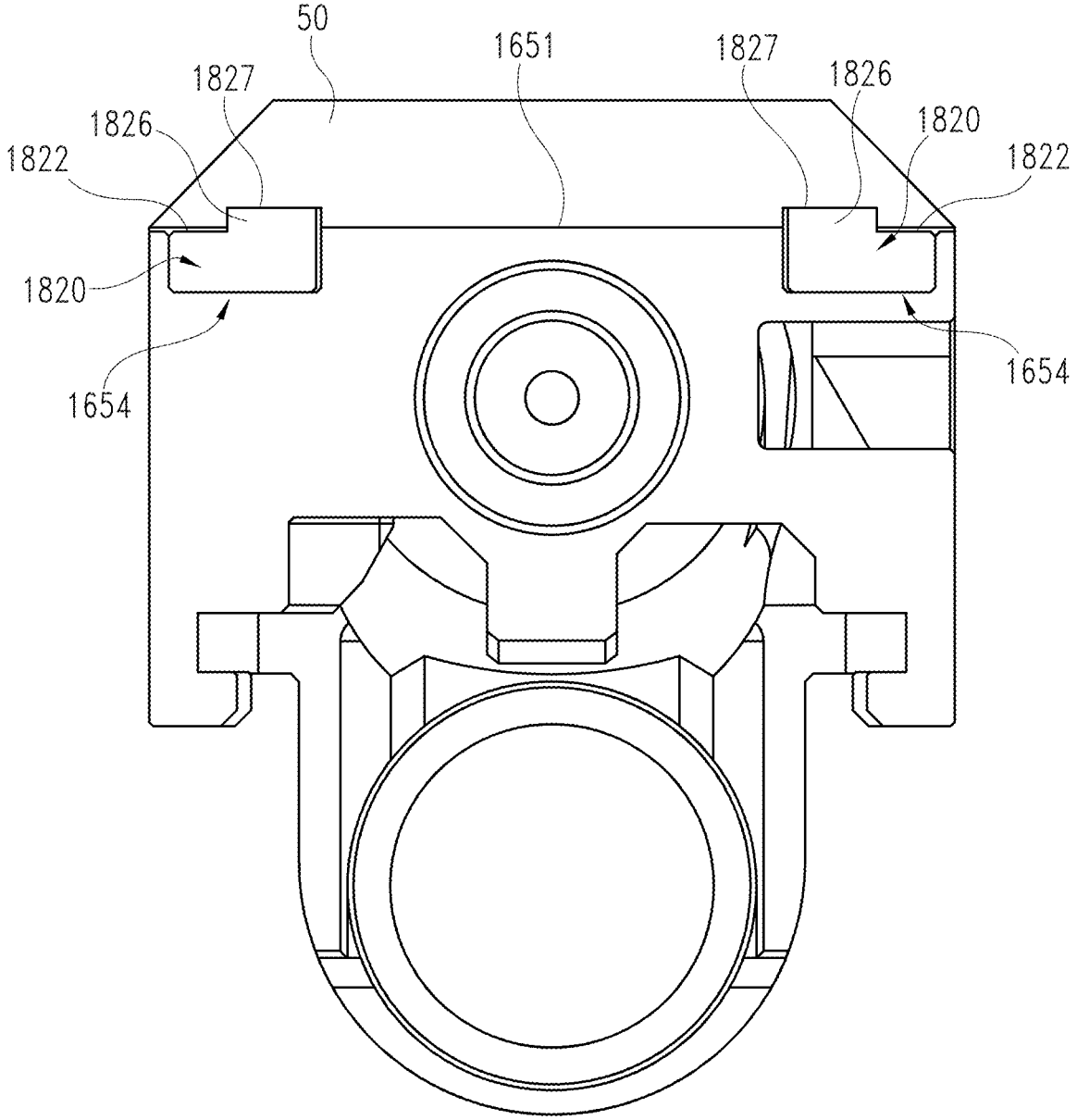
FIG. 40 is a cross-sectional rear view of the firearm of FIG. 1 showing the connection pins of FIG. 38 positioned within pin openings of the optical sight mount.

A cross-sectional view of the slide 50 is shown in FIG. 40. As shown a connection pin 1820 is positioned in each of the forward pin openings 1654. The connection pin 1820 fits within the forward pin opening 1654 so that the body top surface 1827 extends above the optical sight mounting surface 1651. The base top surface 1822 of the connection pin 1820 is substantially flush with the optical sight mounting surface 1651.

Preferably the projection top surface is further from the pivot point than the curved inner projection surface, so as to provide a mechanical advantage (i.e., the force applied by curved inner projection surface being greater than the force applied to projection top surface. It is contemplated, however, that the surface providing lateral force (i.e., along a direction parallel to the mounting surface) against the optical sight be further from the pivot point than the projection top surface.

In operation, the shape of the connection pins 1820 may assist to secure certain varieties of optical sights to the optical sight mount 1650 and assist to reduce movement of those optical sights when mounted to the optical sight mount 1650. For example, in some embodiments, the optical sight may include pin recesses having a cross-section that matches the cross-sectional shape of the pin body 1826 of connection pin 1820 so that the pin bodies 1826 of the connection pins 1820 fits snugly within the pin recesses of the optical sight and assist to limit movement of the optical sight on the optical sight mount 1650. In other embodiments, the interior of the pin recesses of the optical sight may include an angled surface that contacts the pin body 1826 of connection pin 1820 when the optical sight is mounted on optical sight mount 1650. The pin body 1826 may bear on the angled surface of the interior of pin recess to assist to secure the optical sight to the slide 50 at the optical sight mount 1650.

Figure 41:
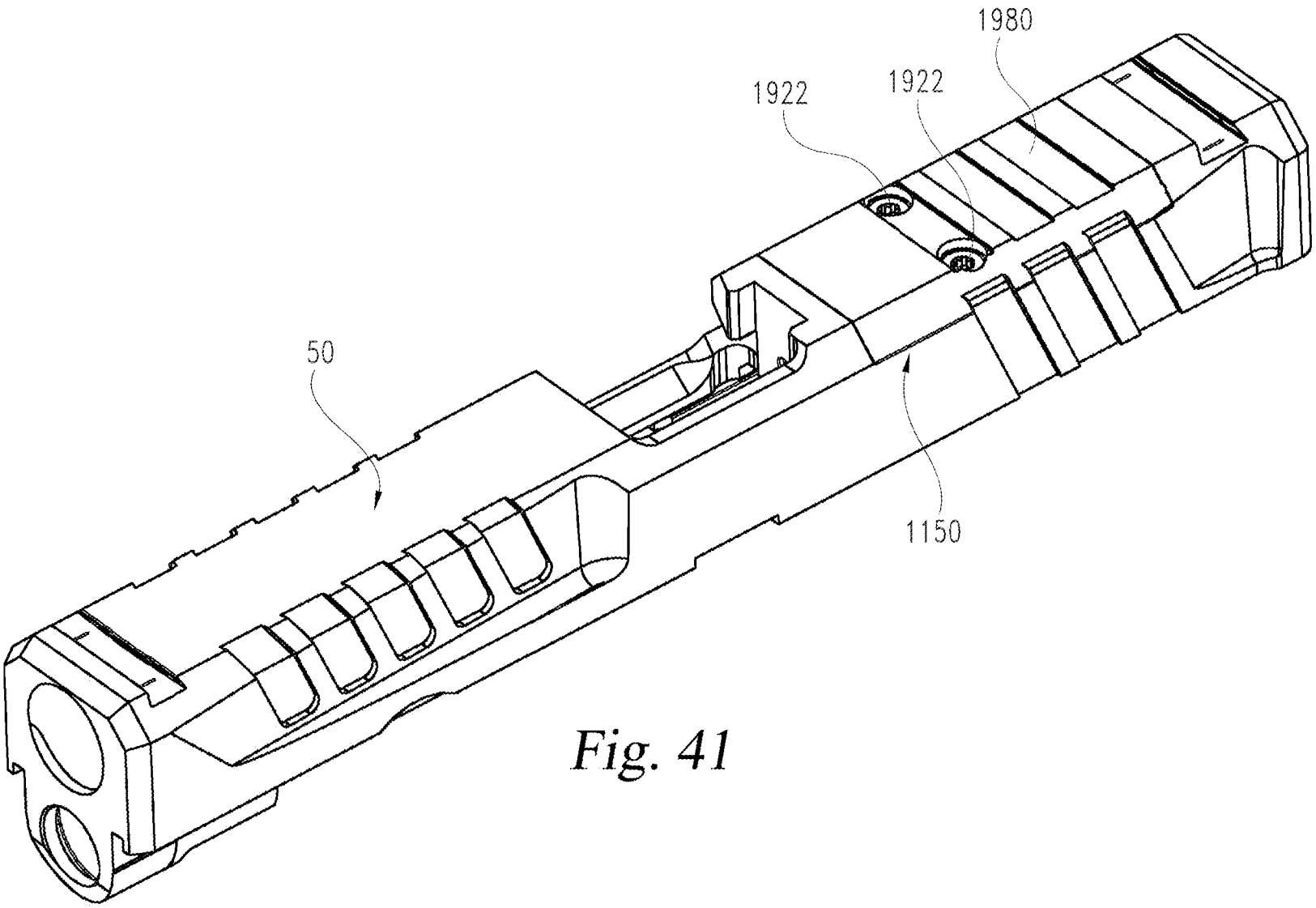
FIG. 41 is a perspective view of the slide of the firearm of FIG. 1 with a mounting plate positioned on the optical sight mount.

Although the firearm 20 allows for optical sights to be mounted directly to the slide 50, the optical sight mount 1150 of the slide 50 may also receive a mounting plate 1980 to allow for other types of optical sights to be installed on slide 50 or to cover the optical sight mount 1150 of the slide 50 when no optical sight is desired on firearm 20. It should be recognized that the mounting plate 1980 may also be installed on the optical sight mount 1650. For example, as shown in FIG. 41, the plate 1980 may be attached to the slide 50 at the optical sight mount 1150 of the slide 50. In some embodiments, the plate 1980 may include attachment features for securing different varieties of optical sights to the slide 50 by attaching the optical slide to the plate 1980 rather than directly to the slide 50.

Figure 42:
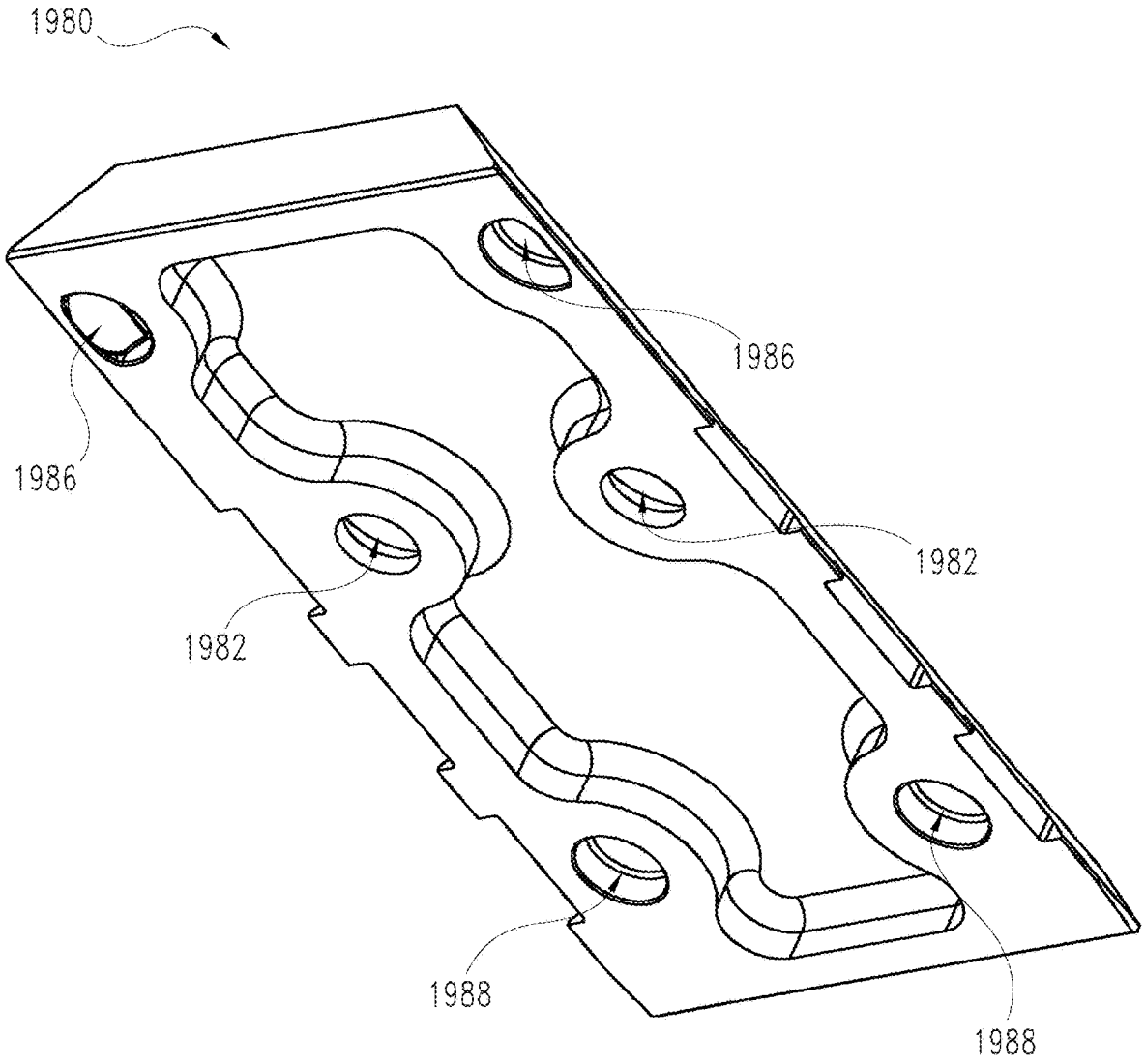
FIG. 42 is a bottom perspective view of the mounting plate of FIG. 41.

A bottom perspective view of the plate 1980 is shown in FIG. 42. As shown, the plate 1980, includes a pair of plate screw openings 1982 configured to receive plate screws that may attach the plate 1980 to the slide 50. The plate screw openings 1982 open towards the mounting openings 1158 defined by the top surface 51 of the slide when the plate 1980 is positioned on the optical sight mount 1150 of the slide 50. The plate connectors 1922 may be inserted through the plate screw openings 1982 of the plate 1980 and then through the mounting openings 1158 of the slide 50 to attach the plate 1980 to the slide 50.

The plate 1980 also includes forward connection pin recesses 1986 that open towards the forward pin openings 1956 defined in the optical sight mount 1150 of slide 50 when the plate 1980 is positioned on the optical sight mount 1150. A connection pin (e.g., connection pin 1220, 320, 1420, 1520, 1720, or 1820) may be held within the forward pin opening 1154 that opens towards the forward connection pin recess 1986 so that the connection pin is covered by the plate 1980 and available for use if an optical sight 1110 is desired to be added to the firearm 20. Likewise, the plate includes rear connection pin recess 1488 that open towards the rear pin openings 1156 or 1656 defined in the optical sight mount 1150 or 1650 of slide 50 when the plate is positioned on the optical sight mount 1150 or 1650. A connection pin, e.g., connection pin 1720, may be held within the rear pin opening 1156 that opens towards the rear connection pin recess 1988 so that the rear connection pin 1720 is covered by the plate 1980 and available for use if an optical sight 1110 is desired to be added to the firearm 20.

Figure 43:
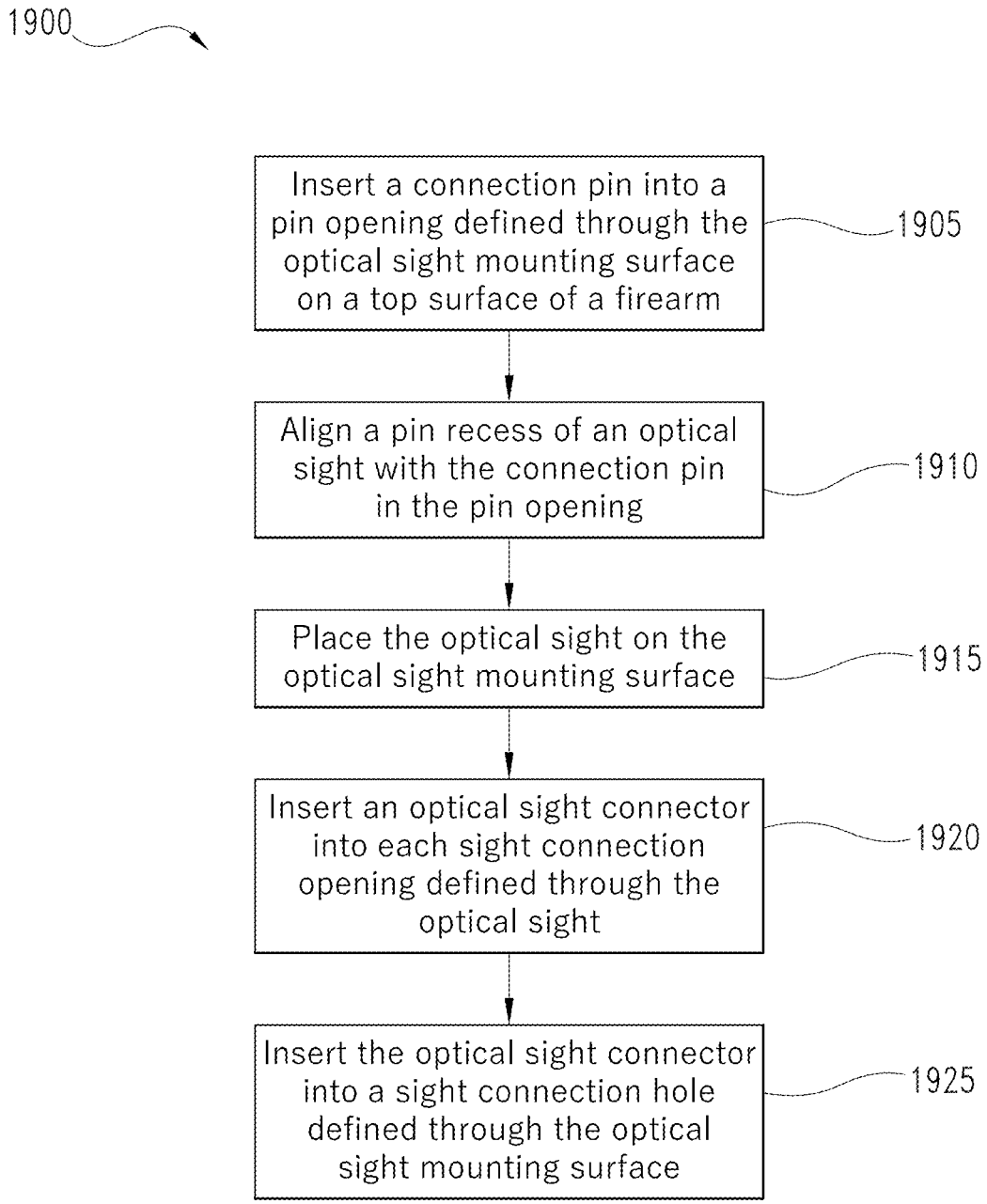
FIG. 43 is a flowchart describing a method of installing an optical sight on a firearm.

A flowchart 1900 describing a method of installing an optical sight on a firearm is shown in FIG. 43. In a first stage 1905, a connection pin is inserted into a pin opening defined by the optical sight mounting surface on a top surface of the firearm. In some embodiments, the top surface of the firearm may on the slide of the firearm. The pin opening may be recessed into the optical sight mounting surface and the connection pin may fit within the pin opening so that a portion of the connection pin extends above the optical sight mounting surface.

In some embodiments, the first stage 1905 may include multiple connection pins, and each of the connection pins may be inserted into a respective pin opening defined by the optical sight mounting surface. For example, the optical sight mounting surface may include a pair of forward pin openings and a pair of rear pin openings, and a connection pin may be inserted into each of the forward pin opening and into each of the rear pin openings.

In a second stage 1910, a pin recess in an optical sight is aligned to receive the connection pin that is positioned in the pin openings in the optical sight mounting surface. In some embodiments, the optical sight may have multiple pin recesses to align with the multiple pin openings and connection pins inserted into those pin openings in the optical sight mounting surface.

In a third stage 1915, the optical sight is placed directly on the optical sight mounting surface so that the portion of the connection pin extending above the optical sight mounting surface enters the pin recess of the optical sight. The connection pin may cooperate with the pin recess to limit movement of the optical sight with respect to the firearm. In embodiments where there are multiple connection pins, each of the portion of the connection pins that extend above the optical sight mounting surface enter a respective pin recess defined in the optical sight.

In a fourth stage 1920, an optical sight connector is inserted into a sight connection opening defined by the optical sight. In a fifth stage 1925, the optical sight connector is then inserted into a corresponding sight attachment opening that is defined by the optical sight mounting surface and communicates with the sight connection opening defined by the optical sight. In some embodiments, the optical sight connector may be threaded and the sight attachment opening may have corresponding threading so that the optical sight connector may be screwed into the sight connection opening.

Figure 44:
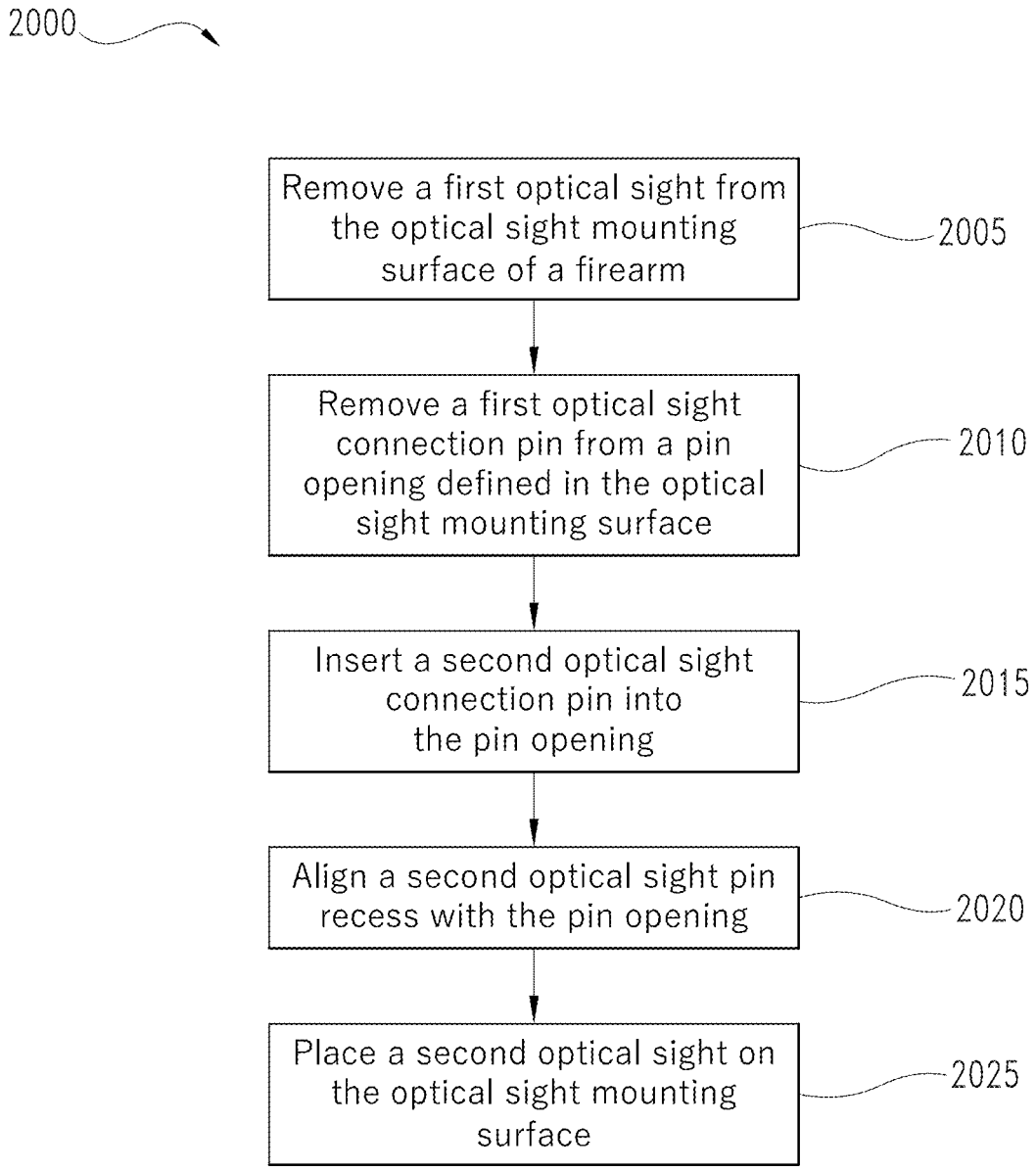
FIG. 44 is a flowchart describing a method of replacing a first optical sight with a second optical sight.

A flowchart 2000 describing a method of replacing a first optical sight with a second optical sight is illustrated in FIG. 44. In a first stage 2005, the first optical sight is removed from the optical sight mounting surface of the firearm. In some embodiments, to remove the first optical sight from the slide, each of the optical sight connectors are removed from the sight openings defined in the optical sight mounting surface and, optionally, removed from the corresponding sight connection opening defined by the first optical sight. The first optical sight is then pulled away from the optical sight mounting surface.

In a second stage 2010, a first optical sight connection pin is removed from a respective pin opening defined in the optical sight mounting surface. In some embodiments, there are multiple first optical sight connection pins and a first optical sight connection pin is positioned in each of the forward pin openings and/or in each of the rear pin openings. One or more of these first optical sight connection pins are removed from the respective pin opening in the second stage 2010.

In a third stage 2015, a second optical sight connection pin is inserted into the pin opening defined in the optical sight mounting surface. In some embodiments, there are multiple second optical sight connection pins, and a second optical sight connection pin is inserted into each of the forward pin openings and/or each of the rear pin openings in the optical sight mounting surface.

In a fourth stage 2020, a pin recess in the second optical sight is aligned with the second optical sight connection pin that is positioned in the pin opening in the optical sight mounting surface. In some embodiments, the second optical sight may have multiple pin recesses to align with the multiple pin openings and connection pins inserted into those pin openings in the optical sight mounting surface. In some embodiments, the location of the pin recesses on the second optical sight may be different from the location of the pin recesses on the first optical sight. In these embodiments, the second optical sight connection pins may be inserted into different pin openings in the optical sight mounting surface that align with the pin recesses of the second optical sight, when compared to the first optical sight.

In a fifth stage 2025, the second optical sight is placed directly on the optical sight mounting surface so that the portion of the connection pin extending above the optical sight mounting surface enters the pin recess of the optical sight. The connection pin may cooperate with the pin recess to limit movement of the optical sight with respect to the firearm. In embodiments where there are multiple connection pins, each of the portions of the connection pins that extend above the optical sight mounting surface preferably enter a respective pin recess defined in the second optical sight.

After the second optical sight is positioned on the optical sight mounting surface, optical sight connectors may be inserted into sight connection openings defined by the second optical sight and into corresponding sight attachment openings that are defined by the optical sight mounting surface. In some instances, the corresponding sight attachment openings for the second optical sight may be different than the sight attachment openings for the first optical sight.

Figure 45:
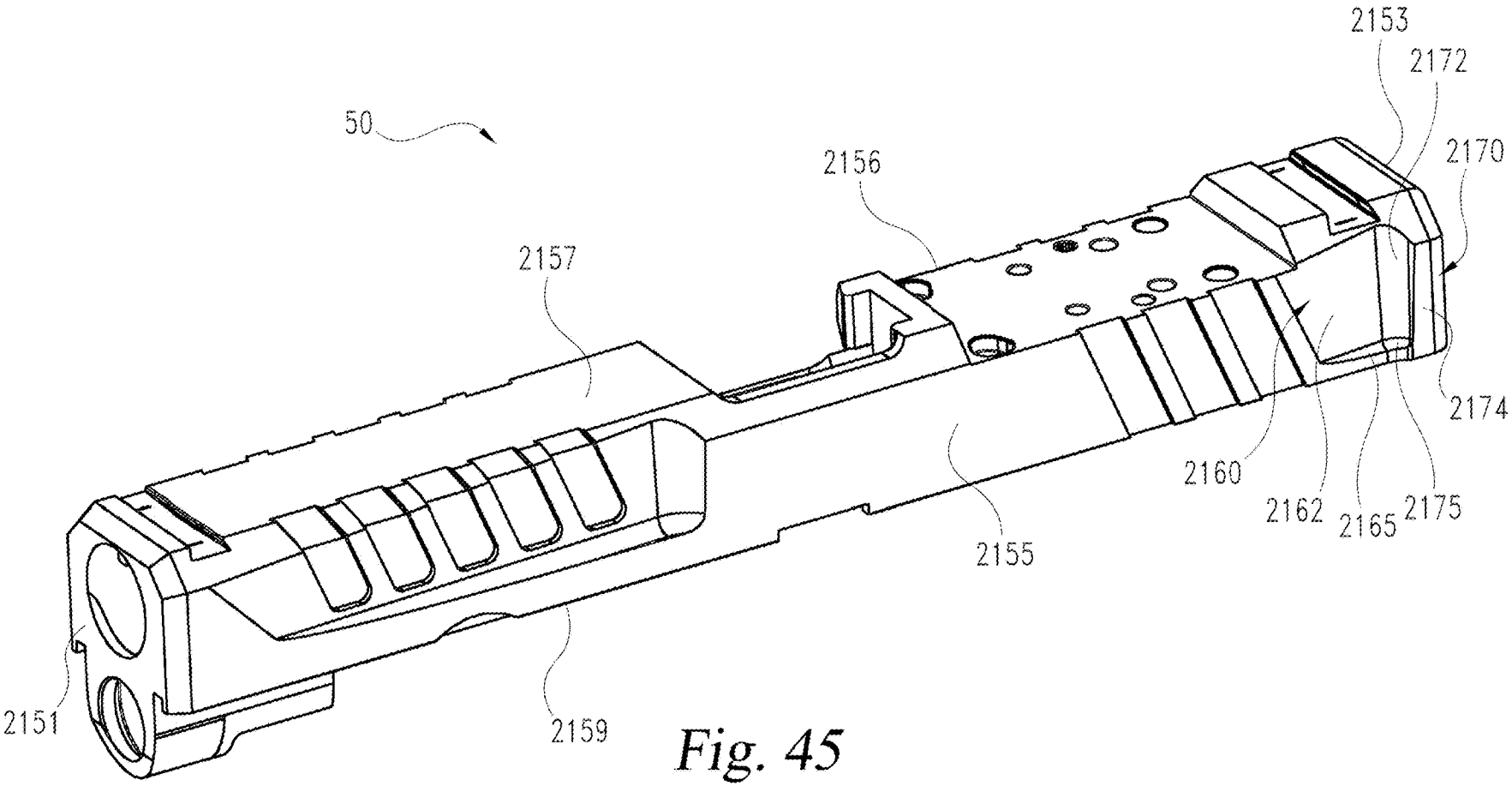
FIG. 45 is a side perspective view of the slide of the firearm of FIG. 1.

The slide 50 of the firearm is shown in more detail in FIG. 45. The slide 50 includes a forward end 2151, a rearward end 2153, a first lateral side 2155, a second lateral side 2156, a top surface 2157, and a bottom surface 2159. The first lateral side 2155 and the second lateral side 2156 extend between the forward end 2151 and the rearward end 2153. As shown, the first lateral side 2155 includes a lead-in portion 2160 that leads to a laterally extending protrusion 2170.

The lead-in portion 2160 includes a lateral surface 2162. In the embodiment shown, the leading surface 2162 is angled to extend laterally inward moving rearwardly along the first lateral side 2155 of the slide 50. In the embodiment shown, the lead-in portion 2160 extends to the top surface 2157 of the slide 50, but may not extend all the way to the bottom surface 2159 of the slide 50, forming a lead-in portion bottom surface 2165 positioned at the bottom of the lateral surface 2162. The lead-in portion bottom surface 2165 extends laterally outward with respect to the lateral surface 2162 of the lead-in portion 2160.

The protrusion 2170 is positioned rearward of the lead-in portion. The protrusion 2170 includes a forward protrusion surface 2172 and an outer protrusion surface 2174. The forward protrusion surface 2172 is positioned between the lateral surface 2162 and the outer protrusion surface 2174. The forward protrusion surface extends laterally outwards with respect to the lateral surface 2162. The outer protrusion surface 2174 is positioned laterally outward with respect to the forward protrusion surface 2172. In some instances, the laterally extending protrusion 2170 is the laterally outwardmost feature of the first lateral side 2155.

The lateral surface 2162 of the lead-in portion 2160 is adjacent to the forward protrusion surface 2172 is adjacent to the lateral surface 2162 of the lead-in portion 2160 and extends laterally outward with respect to the lateral surface 2162. Similar to the lateral surface 2162, the forward protrusion surface 2172 extends to the top surface 2157 of the slide 50, but may not extend all the way to the bottom surface 2159 of the slide 50, forming a bottom protrusion surface 2175 positioned at the bottom of the forward protrusion surface 2172.

In the embodiment shown, the protrusion 2170 is integral to the slide 50. Preferably the slide and the protrusion are formed of a monolithic piece of material (e.g., metal). Additionally, in this embodiment, the protrusion 2170 forms the rearward end of the first lateral side 2155 so that the protrusion 2170 is positioned at the rearward end 2153 of the slide 50 without any additional space between the protrusion 2170 and the rearward end 2153 of the slide 50.

The second lateral side 2156 of the slide 50 also includes a lead-in portion 2160 and a protrusion 2170 similar to the first lateral side 2155 as described above. In the embodiment shown, in FIG. 43, the rearward portions of the second lateral side 2156 is symmetrical with respect to the first lateral side 2155 so that the lead-in portion 2160 and the protrusion 2170 on the second lateral side 2156 is identical to the lead-in portion 2160 and the protrusion 2170 on the first lateral side 2155.

A length of the lead-in portion 2160 and the protrusion 2170 is measured along a direction from the forward end 2151 to the rearward end 2153. The length of the lead-in portion 2160 varies along the length of the slide 50 so that the top of the lead-in portion 2160 has a length that is greater than the length of the bottom of the lead-in portion 2160. This gives the lateral surface 2162 of the lead-in portion a trapezoidal shape. In the embodiment shown in FIG. 43, the length of the lead-in portion 2160 at its shortest length near the bottom of the lead-in portion 2160 is approximately equal to the length of the protrusion 2170. The length of the lead-in portion 2160 at its greatest length near the top of the lead-in portion 2160 is approximately greater than the length of the protrusion 2170. In other embodiments, the length of the lead-in portion 2160 and/or the length of the protrusion 2170 may be modified as desired. For example, the smallest length of the lead-in portion 2160 may be double the length of the protrusion.

A width of the protrusion 2170 is measured along a direction from the first lateral side 2155 of the slide 50 to the second lateral side 2156 of the slide 50. In the embodiment shown in FIG. 45, the shortest length of the lead-in portion 2160 is approximately five times the width of protrusion 2170. In other embodiments, the width of the protrusion 2170 and/or the length of the lead-in portion 2160 may be modified as desired to adjust the ratio between the width of the protrusion 2170 and the length of the lead-in portion 2160.

Figure 46:
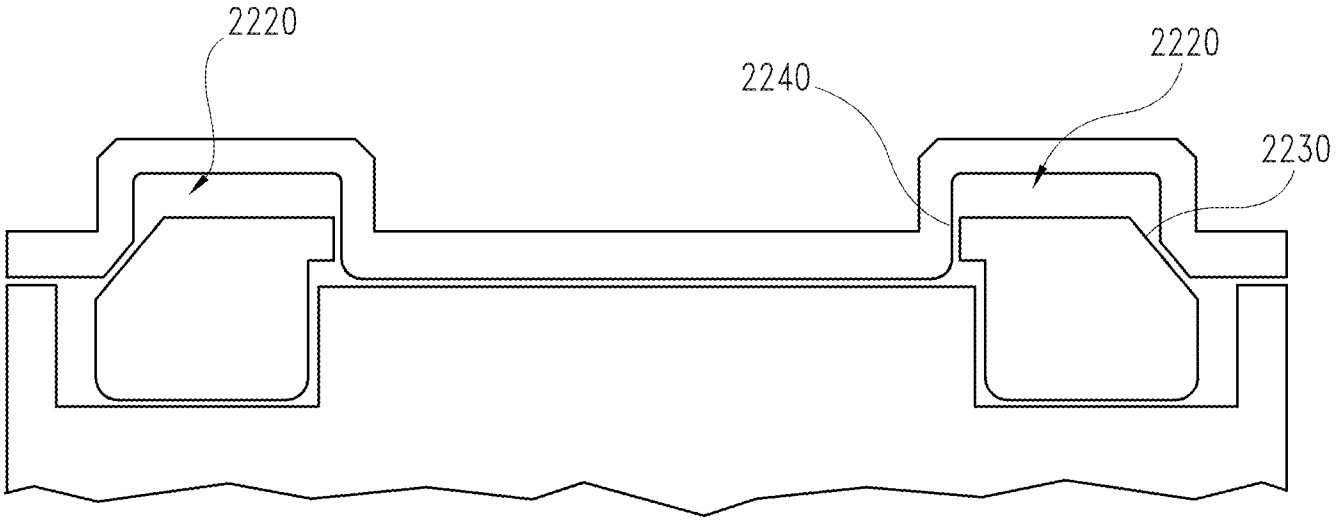
FIG. 46 is a cross-sectional rear view of a firearm showing connection pins that translate relative to the mounting surface.

FIG. 46 shows an embodiment wherein the connection pin 2220 has a sloped surface 2230 configured to contact the bottom surface of the optical sight and translate the connection pin laterally as the optical sight is forced towards the optical sight mounting surface. In this way, lateral engagement surface 2240 of the connection pin comes into contact with the inner surface of the in recess defined by the bottom surface of the optical sight.

While illustrated embodiments show the connection pin as rotating about an axis parallel to a plane defined by the mounting surface, it is also contemplated that the connection pin could rotation about an axis transverse to the plane defined by the mounting surface. For example, the connection pin may rotate about an axis orthogonal to the plane defined by the mounting surface. Such rotation could bring a portion of the connection pin (e.g., a protrusion) into contact with the optical sight and apply a force on the optical sight along a direction parallel to the plane defined by the mounting surface.

The following numbered clauses set out specific embodiments that may be useful in understanding the present invention:

1. A slide of a firearm comprising:
   a slide top surface;
   an optical sight mounting portion on said slide top surface, wherein said optical sight mounting portion includes an optical sight mounting surface;
   at least one first pin opening defined through said optical sight mounting surface, wherein each of said at least one first pin opening is positioned to receive a first optical sight pin for securing a first optical sight directly to said slide top surface;
   at least one second pin opening defined through said optical sight mounting surface, wherein each of said at least one second pin openings is positioned to receive a pin for securing a second optical sight directly to said slide top surface;
   wherein a first optical sight pin is positioned in each of said at least one first pin openings when said first optical sight is positioned on said optical sight mounting surface and each of said at least one second pin openings is empty when said first optical sight is positioned on said optical sight mounting surface; and
   wherein a second optical sight pin is positioned in each of said at least one second pin openings when said second optical sight is positioned on said optical sight mounting surface and each of said at least one first pin openings is empty when said second optical sight is positioned on said optical sight mounting surface.
2. The slide of clause 1, further comprising:
   at least one first sight attachment opening defined through said optical sight mounting surface, wherein each of said at least one first sight attachment openings is positioned to receive a first optical sight connector for securing the first optical sight to said slide top surface.
3. The slide of clause 2, wherein there are a pair of first pin openings defined through said optical sight mounting surface and wherein said first pin openings are aligned along a width of said optical sight mounting surface.
4. The slide of clause 3, wherein there are a pair of first sight attachment openings defined through said optical sight mounting surface, and wherein said first sight attachment openings are aligned along a width of said optical sight mounting surface.
5. The slide of clause 4, wherein said pair of first pin openings are positioned forward of said pair of first sight attachment openings on said optical sight mounting surface.
6. The slide of clause 5, further comprising:
   at least one second sight attachment opening defined through said optical sight mounting surface, wherein each of said at least one second sight attachment openings is positioned to receive an optical sight connector for securing the second optical sight directly to said slide top surface.
7. The slide of clause 6, wherein there are a pair of second pin openings defined through said optical sight mounting surface and wherein said second pin openings are aligned along a width of said optical sight mounting surface.
8. The slide of clause 7, wherein there are a pair of second sight attachment openings defined through said optical sight mounting surface, and wherein said second sight attachment openings are aligned along a width of said optical sight mounting surface.
9. The slide of clause 8, wherein said pair of second pin openings are positioned rearward of said pair of second sight attachment openings on said optical sight mounting surface.
10. The slide of clause 9, further comprising:
    at least one plate attachment opening defined through the optical sight mounting surface.
11. The slide of clause 10, wherein there are a pair of plate attachment openings defined through said optical sight mounting surface and wherein said plate attachment openings are aligned along a width of said optical sight mounting surface.

12. The slide of clause 11,
wherein said pair of plate attachment openings are positioned rearward of said first pin openings and forward of said second pin openings.
13. The slide of any preceding clause, wherein said optical sight mounting portion is recessed into said slide top surface.
14. A firearm comprising:
a frame;
a slide positioned atop said frame, wherein said slide includes a slide top surface;
an optical sight mounting portion on said slide top surface, wherein said optical sight mounting portion includes an optical sight mounting surface;
at least one first pin opening defined through said optical sight mounting surface;
at least one second pin opening defined through said optical sight mounting surface;
a first optical sight attachable to said slide top surface, wherein said first optical sight includes at least one pin recess defined through a bottom surface of said optical sight;
wherein each of said at least one first pin openings are positioned to receive a first optical sight pin for securing the first optical sight to said slide top surface;
wherein each of said at least one second pin openings are positioned to receive a second optical sight pin for securing a second optical sight to said slide top surface; and
wherein said at least one first pin recess defined through the bottom surface of said first optical sight is aligned with said at least one first pin opening so that the first optical sight pin is positioned within said first pin recess and said first pin opening when said first optical sight is positioned on said slide top surface; and
wherein said first optical sight covers each of said at least one second pin openings when said first optical sight is positioned on said slide top surface.
15. The firearm of clause 14, further comprising:
at least one first sight attachment opening defined through said optical sight mounting surface, wherein each of said at least one first sight attachment openings is positioned to receive a first optical sight connector for securing the first optical sight to said slide top surface.
16. The firearm of clause 15, further comprising:
at least one first connection opening defined through the bottom surface of said first optical sight.
17. The firearm of clause 16, further comprising:
at least one optical sight connector, wherein each of said at least one optical sight connectors is configured to fit within one of said at least one first sight attachment openings defined through said optical sight mounting surface and one of said at least one connection openings defined through said optical sight to secure said slide to said optical sight mounting surface.
18. The firearm of clause 17, wherein each of said at least one first pin openings are positioned forward of each of said at least one first sight attachment openings.
19. The firearm of one of clauses 13-18, further comprising:
at least one second sight attachment opening defined through said optical sight mounting surface, wherein each of said at least one second sight attachment openings is positioned to receive a second optical sight connector for securing the second optical sight to said slide top surface.
20. The firearm of one of clauses 13-19, wherein each of said at least one first pin openings are positioned forward of each of said at least one second pin openings.
21. The firearm of one of clauses 13-20, further comprising:
at least one plate attachment opening defined through said optical sight mounting surface of said slide, wherein each of said at least one plate attachment openings are threaded.
22. The firearm of clause 21, wherein each of said at least one plate attachment openings are positioned rearward of each of said at least one first pin openings and forward of each of said at least one second pin openings.
23. A method comprising:
inserting a first connection pin into a first pin opening defined through an optical sight mounting surface on a top surface of a slide of a firearm;
placing a first optical sight on said optical sight mounting surface and aligning a first pin recess defined through a surface of said first optical sight with said first pin opening defined through said optical sight mounting surface so that said connection pin is at least partially inserted into said first pin recess;
inserting an optical sight connector through a first sight connection opening defined through said first optical sight and into an aligned first sight attachment opening defined through said optical sight mounting surface to secure said first optical sight to said top surface of said slide; and
wherein said first optical sight covers a second pin opening defined through said optical sight mounting surface when said first optical sight is positioned on said top surface of said slide.
24. The method of clause 23, wherein said first optical sight is mounted directly on said top surface of said slide.
25. The method of one of clauses 23-24, wherein said second pin opening is configured to receive a second connection pin for securing a second optical slide to said top surface of slide.
26. A connection pin for securing an optical sight to a slide of a firearm, the connection pin comprising:
a pin base including a base top surface and a pin bottom surface;
a pin body including a pin body top surface, wherein said pin body extends from said pin base;
a pin projection, including a pin projection top surface, wherein said pin projection extends from said pin base;
wherein said pin bottom surface includes a level portion and an angled portion; and
wherein said angled portion of said pin bottom surface extends at an oblique angle with respect to said level portion of said pin bottom surface.
27. The connection pin of clause 26, wherein said pin body top surface has a height that is greater than a height of said pin projection top surface.
28. The connection pin of clause 26, wherein a height of said pin projection top surface is greater than a height of said pin body top surface.
29. The connection pin of any one of clauses 26-28, wherein said angled portion of said pin bottom surface is positioned beneath said pin projection.

30. The connection pin of any one of clauses 26-29, wherein said level portion of said pin bottom surface is positioned beneath said pin body.
31. The connection pin of any one of clauses 26-30, wherein a center of mass of the connection pin is positioned over said level portion of said pin bottom surface.
32. The connection pin of any one of clauses 26-31, wherein said pin body extends from said base top surface.
33. The connection pin of any one of clauses 26-32, wherein said pin projection extends from said base top surface.
34. The connection pin of any one of clauses 26-33, further comprising:
a pin channel defined between said pin body and said pin projection.
35. The connection pin of any one of clauses 26-34, wherein said pin projection abuts said pin body.
36. A firearm comprising:
an optical sight mount, wherein said optical sight mount includes an optical sight mounting surface;
a pin opening defined by said optical sight mounting surface;
a connection pin configured to fit within said pin opening, wherein said connection pin includes a pin body, and wherein said connection pin is movable from a first position to a second position within said pin opening;
an optical sight including a pin recess defined by a bottom surface of said optical sight;
wherein at least a portion of said pin recess is positioned over said pin opening when said optical sight is positioned on said optical sight mounting surface;
wherein a portion of said connection pin is positioned within said pin recess of said optical sight when said optical sight is positioned on said optical sight mounting surface; and
wherein said optical sight biases said connection pin from said first position towards said second position when said optical sight is positioned on said optical sight mounting surface; and
wherein in said second position said connection pin applies a force to said optical sight along a direction parallel to said optical sight mounting surface.
37. The firearm of clause 36, wherein said connection pin rotates relative to the optical sight mounting surface when moving from the first position to the second position; and
wherein said connection pin includes a pin bottom surface, wherein said pin bottom surface includes a level portion and an angled portion, and wherein said angled portion of said pin bottom surface extends at an oblique angle with respect to said level portion of said pin bottom surface.
38. The firearm of clause 37, wherein in said first position said level portion of said connection pin is in contact with a bottom surface of said pin opening.
39. The firearm of clause 38, wherein said connection pin rotates within said pin opening when said optical sight contacts said pin projection of said connection pin.
40. The firearm of any one of clauses 37-38, wherein a gap is defined between said bottom surface of said pin opening and said angled portion of said connection pin when said connection pin is positioned in said pin opening in said first position.
41. The firearm of any one of clauses 36-40, wherein said pin body includes a pin body top surface and said pin projection includes a pin projection top surface, and wherein said pin body top surface has a height that is greater than a height of said pin projection top surface.
42. The firearm of any one of clauses 36-41, wherein said pin body is in contact with an outside surface of said pin recess of said optical sight when said optical sight is positioned on said optical sight mounting surface and in contact with said pin projection.
43. The firearm of any one of clauses 36-42, wherein said pin body is in contact with an inner surface of said pin recess of said optical sight when said optical sight is positioned on said optical sight mounting surface and in contact with said pin projection.
44. The firearm of any one of clauses 36-43, wherein a top surface of said pin projection is positioned above said optical sight mounting surface when said optical sight is not positioned on said optical sight mounting surface.
45. The firearm of any one of clauses 36-44, wherein a top surface of said pin body is positioned above said optical sight mounting surface.
46. A firearm comprising:
an optical sight mounting surface, wherein said optical sight mounting surface is configured to receive a first optical sight or a second optical sight;
a forward pin opening defined in the optical sight mounting surface, wherein said forward pin opening has a forward pin opening bottom surface, and wherein the forward pin opening is configured to receive a first optical sight connection pin or a second optical sight connection pin;
a rear pin opening defined in the optical sight mounting surface, wherein said rear pin opening is positioned rearwardly of said forward pin opening;
wherein a first optical sight connection pin is positioned in said forward pin opening when said first optical sight is positioned on said optical sight mounting surface, and wherein said first optical sight connection pin resists movement of said first optical sight along said optical sight mounting surface; and
wherein a second optical sight connection pin is positioned in said forward pin opening when said second optical sight is positioned on said optical sight mounting surface, and wherein said second optical sight connection pin resists movement of said second optical sight along said optical sight mounting surface.
47. The firearm of clause 46, further comprising:
a first optical sight attachment opening defined in the optical sight mounting surface.
48. The firearm of clause 47, wherein a first optical sight connector is positioned through a first optical sight connection opening defined by said first optical sight and into said first optical sight attachment opening when said first optical sight is positioned on said optical sight mounting surface, and wherein said first optical sight connector forces said first optical sight towards said optical sight mounting surface.
49. The firearm of any one of clauses 47-48, further comprising:
a second optical sight attachment opening defined in the optical sight mounting surface.
50. The firearm of clause 49, wherein a second optical sight connector is positioned through a second optical sight connection opening defined by said second optical sight and into said second optical sight attachment opening when said second optical sight is positioned on said optical sight mounting surface, and wherein said second optical sight connector forces said second optical sight towards said optical sight mounting surface.

51. The firearm of any one of clauses 49-50, wherein said first optical sight at least partially covers said second optical sight attachment opening when said first optical sight is mounted on said optical sight mounting surface.

52. The firearm any one of clauses 49-51, wherein said second optical sight at least partially covers said first optical sight attachment opening when said second optical sight is mounted on said optical sight mounting surface.

53. The firearm of any one of clauses 49-52, further comprising:

a plate attachment opening defined in the optical sight mounting surface.

54. The firearm of clause 53, wherein said first optical sight at least partially covers said rear pin opening when said first optical sight is mounted on said optical sight mounting surface.

55. The firearm of any one of clauses 53-54, wherein said second optical sight at least partially covers said plate attachment opening when said second optical sight is mounted on said optical sight mounting surface.

56. A method comprising:

removing a first optical sight forward connection pin from a forward pin opening defined by an optical sight mounting surface of a firearm;

inserting a second optical sight forward connection pin into said forward pin opening;

positioning at least a portion of a second optical sight forward pin recess defined by a surface of said second optical sight over said forward pin opening;

placing a second optical sight on said optical sight mounting surface so that said second optical sight forward connection pin is at least partially inserted into said second optical sight forward pin recess; and wherein said second optical sight forward connection pin resists movement of said second optical sight along said optical sight mounting surface.

57. The method of clause 56, further comprising:

inserting a second optical sight rear connection pin into a rear pin opening defined by the optical sight mounting surface.

58. The method of clause 57, further comprising:

positioning at least a portion of a second optical sight rear pin recess defined by a surface of said second optical sight over said rear pin opening so that said second optical sight rear connection pin is at least partially inserted into said second optical sight rear pin recess.

59. The method of any one of clauses 56-58, further comprising:

inserting a second optical sight connector through a second sight connection opening defined by said second optical sight and into an aligned second sight attachment opening defined by said optical sight mounting surface to force said second optical sight towards said optical sight mounting surface.

60. The method of any one of clauses 56-59, further comprising:

removing a plate from the optical sight mounting surface to reveal said first optical sight forward connection pin.

61. The method of clause 60, wherein removing the plate from the optical sight mounting surface includes removing a plate connector from a plate attachment opening defined in said optical sight mounting surface and from a plate screw opening defined by said plate.

62. The method of clause 61, wherein said second optical sight at least partially covers the plate attachment opening when said second optical sight is mounted on said optical sight mounting surface.

63. The method of any one of clauses 56-62, wherein said second optical sight at least partially covers a first optical sight attachment opening defined by the optical sight mounting surface when said second optical sight is mounted on said optical sight mounting surface.

64. The method of any one of clauses 56-63, wherein said optical sight mounting surface defines two forward pin openings, and wherein a second optical sight forward connection pin is inserted into each of the forward pin openings.

65. The method of clause 64, wherein said optical sight mounting surface defines two rear pin openings, and wherein a second optical sight rear connection pin is inserted into each of the rear pin openings.

66. A method comprising:

inserting a first optical sight forward connection pin into a forward pin opening defined by a top surface of a firearm;

positioning at least a portion of a first optical sight forward pin recess of a first optical sight over said forward pin opening;

placing said first optical sight on said top surface and so that said first optical sight forward connection pin is at least partially inserted into said first optical sight forward pin recess, wherein said first optical sight forward connection pin cooperates with said first optical sight forward pin recess to limit movement of said first optical sight with respect to said firearm; and inserting a first optical sight connector into a first optical sight connection opening defined by said first optical sight and then into a first sight attachment opening defined in the top surface of the firearm aligned with said first optical sight connection opening, wherein said first optical sight connector resists movement of said first optical sight away from said firearm.

67. The method of clause 66, wherein said first optical sight at least partially covers a rear pin opening defined by the top surface of the firearm and positioned rearwardly with respect to said forward pin opening.

68. The method of any one of clauses 66-67, wherein said first optical sight at least partially covers a second sight attachment opening defined in the top surface of said firearm.

69. The method of any one of clauses 66-68, further comprising:

removing a mounting plate from the top surface of the firearm, wherein said mounting plate is removed before said first optical sight forward connection pin is inserted into said forward pin opening.

70. The method of clause 69, wherein a plate connector is removed from a plate attachment opening defined by the top surface of the firearm to remove the mounting plate from the firearm.

71. The method of clause 70, wherein the plate attachment opening is at least partially covered by said first optical sight when said first optical sight is positioned on the top surface of said firearm.

72. The method of any one of clauses 66-71, wherein said first optical sight connector is threaded, and wherein said first optical sight connector is threadedly inserted into said first optical sight connection opening.

73. The method of any one of clauses 66-72, further comprising:

inserting a first optical sight rear connection pin into a rear pin opening defined by said top surface of the firearm.

74. The method of clause 73, further comprising:

positioning at least a portion of a first optical sight rear pin recess of the first optical sight over said rear pin opening so that said first optical sight rear connection pin is at least partially inserted into said first optical sight rear pin recess; and wherein said first optical sight rear connection pin cooperates with said first optical sight rear pin recess to limit movement of said first optical sight with respect to said firearm.

75. The method of any one of clauses 66-74, wherein said first optical sight is placed on a slide of the firearm.

76. A firearm comprising:

an optical sight mounting surface, wherein said optical sight mounting surface is configured to receive a first optical sight or a second optical sight;

a forward pin opening defined by said optical sight mounting surface, wherein the forward pin opening is configured to receive a first optical sight forward connection pin or a second optical sight forward connection pin;

wherein said first optical sight and said second optical sight each include a forward pin recess;

wherein at least a portion of said first optical sight forward pin recess is positioned over said forward pin opening when said first optical sight is positioned on said optical sight mounting surface so that at least a portion of said first optical sight forward connection pin enters said first optical sight forward pin recess when said first optical sight is positioned on said optical sight mounting surface; and wherein said first optical sight forward connection pin bears upon an inner surface of said first optical sight forward pin recess when said first optical sight is positioned on said optical mounting surface; and wherein said first optical sight forward connection pin resists movement of said first optical sight with respect to the firearm a plane defined by said optical sight mounting surface when said first optical sight forward connection pin bears upon said inner surface of said first optical sight forward pin recess.

77. The firearm of clause 76, wherein said first optical sight forward connection pin is movable with respect to the optical sight mounting surface when said first optical sight connection pin is positioned within said forward pin opening and said first optical sight is positioned on said optical sight mounting surface.

78. The firearm of clause 77, wherein said first optical sight forward connection pin rotates within said forward pin opening when said first optical sight is positioned on said optical sight mounting surface and contacts said first optical sight forward connection pin.

79. The firearm of clause 78, wherein said first optical sight forward connection pin has a pin bottom surface that includes a level portion and an angled portion, wherein said level portion of said first optical sight forward connection pin is in contact with a bottom surface of said forward pin opening when said first optical sight is not positioned on said optical sight mounting surface, and wherein said angled portion of said first optical sight forward connection pin is biased towards said bottom surface of said forward pin opening when said first optical sight is positioned on said optical sight mounting surface.

80. The firearm of any one of clauses 76-79, wherein at least a portion of said second optical sight forward pin recess is positioned over said forward pin opening when said second optical sight is positioned on said optical sight mounting surface so that at least a portion of said second optical sight forward connection pin enters said second optical sight forward pin recess when said second optical sight is positioned on said optical sight mounting surface.

81. The firearm of clause 80, wherein said second optical sight forward connection pin bears upon an inner surface of said second optical sight forward pin recess when said second optical sight is positioned on said optical sight mounting surface; and wherein said second optical sight forward connection pin resists movement of said second optical sight with respect to the firearm along the plane defined by said optical sight mounting surface when said second optical sight forward connection pin bears upon said inner surface of said second optical sight forward pin recess.

82. The firearm of clause 81, wherein said second optical sight forward connection pin is movable with respect to the optical sight mounting surface when said second optical sight forward connection pin is positioned within said forward pin opening and said second optical sight is positioned on said optical sight mounting surface.

83. The firearm of clause 82, wherein said second optical sight forward connection pin rotates within said forward pin opening when said second optical sight is positioned on said optical sight mounting surface and contacts said second optical sight forward connection pin.

84. The firearm of any one of clauses 81-83, further comprising:

a rear pin opening defined by said optical sight mounting surface;

wherein the forward pin opening is configured to receive a first optical sight rear connection pin or a second optical sight rear connection pin; and wherein said rear pin opening is positioned rearwardly on said optical sight mounting surface with respect to said forward pin opening.

85. The firearm of clause 84, wherein said first optical sight includes a first optical sight rear pin recess; and wherein at least a portion of said first optical sight rear pin recess is positioned over said rear pin opening when said first optical sight is positioned on said optical sight mounting surface so that at least a portion of said first optical sight rear connection pin enters said first optical sight rear pin recess when said first optical sight is positioned on said optical sight mounting surface.

86. The firearm of clause 85, wherein said first optical sight rear connection pin bears upon an inner surface of said first optical sight rear pin recess when said first optical sight is positioned on said optical sight mounting surface.

87. The firearm of clause 86, wherein said first optical sight rear connection pin resists movement of said first optical sight with respect to the firearm along the plane defined by said optical sight mounting surface when said first optical sight rear connection pin bears upon said inner surface of said first optical sight rear pin recess.

88. The firearm of clause 87, wherein said first optical sight rear connection pin rotates within said rear pin opening when said first optical sight is positioned on said optical sight mounting surface and contacts said first optical sight rear connection pin.

89. The firearm of clause 88, wherein said first optical sight rear connection pin has a pin bottom surface that includes a level portion and an angled portion, wherein said level portion of said first optical sight rear connection pin is in contact with a bottom surface of said forward pin opening when said first optical sight is not positioned on said optical sight mounting surface, and wherein said angled portion of said first optical sight rear connection pin is biased towards said bottom surface of said forward pin opening when said first optical sight is positioned on said optical sight mounting surface.

90. The firearm of any one of clauses 85-89, wherein said second optical sight includes a second optical sight rear pin recess, and wherein said second optical sight rear connection pin bears upon an inner surface of said second optical sight rear pin recess when said second optical sight is positioned on said optical sight mounting surface.

91. The firearm of clause 90, wherein said second optical sight rear connection pin resists movement of said second optical sight with respect to the firearm along the plane defined by said optical sight mounting surface when said second optical sight rear connection pin bears upon said inner surface of said second optical sight rear pin recess.

92. The firearm of clause 91, wherein said second optical sight rear connection pin rotates within said rear pin opening when said second optical sight is positioned on said optical sight mounting surface and contacts said second optical sight rear connection pin.

93. The firearm of any one of clauses 84-92, wherein said front pin opening is at a transverse angle with respect to said rear pin opening.

94. The firearm of any one of clauses 84-93, wherein said rear pin opening includes a rear pin opening bottom surface.

95. The firearm of any one of clauses 76-94, wherein said optical sight mounting surface is defined directly in a top surface of the firearm.

96. The firearm of any one of clauses 76-95, wherein said forward pin opening includes a forward pin opening bottom surface.

97. A slide for a firearm, comprising:

a forward end and a rearward end;

a top surface and a bottom surface;

a first lateral side extending between said forward end and said rearward end and a second lateral side extending between said forward end of and said rearward end;

wherein said first lateral side includes a first laterally extending protrusion, wherein said first laterally extending protrusion is integral to the first lateral side of the slide, and wherein said first laterally extending protrusion includes a width measured along a direction from the first lateral side of the slide to the second lateral side of the slide; and wherein said first lateral side includes a first lead-in portion adjacent to and forward of said first laterally extending protrusion, and wherein said first lead-in portion is positioned laterally inward of an outer surface of said first laterally extending protrusion.

98. The slide of clause 97, wherein said first lead-in portion has a length measured along a distance from the forward end to the rearward end of the slide, the length of the first lead-in portion being at least five times the width of said first laterally extending protrusion.

99. The slide of any one of clauses 97-98, wherein said first lead-in portion and said first laterally extending protrusion each have a length measured along a distance from the forward end to the rearward end of the slide, and wherein the length of said first lead-in portion is at least equal to the length of the first laterally extending protrusion.

100. The slide of any one of clauses 97-99, wherein said laterally-extending protrusion has a forward protrusion surface that faces the forward end of the slide.

101. The slide of clause 100, wherein said forward protrusion surface extends laterally outward with respect to the first lead-in portion.

102. The slide of any one of clauses 97-101, wherein a rearward edge of said laterally-extending protrusion is positioned at the rearward end of the slide.

103. The slide of any one of clauses 97-102, wherein said first lead-in portion includes a lateral surface, and wherein said lateral surface has a trapezoidal shape.

104. The slide of clause 103, wherein said first lead-in portion includes a lead-in bottom surface, wherein said is lead-in bottom surface extends from a bottom edge of said lateral surface, and wherein said lead-in bottom surface extends radially outward from said lateral surface.

105. The slide of any one of clauses 97-104, wherein said second lateral side includes a second laterally extending protrusion, wherein said second laterally extending protrusion is integral to the second lateral side of the slide; and wherein said second lateral side includes a second lead-in portion adjacent to and forward of said second laterally extending protrusion, and wherein said second lead-in portion is positioned laterally inward of an outer surface of said second laterally extending protrusion.

106. The slide of clause 105, wherein said second lead-in portion has a length measured along a distance from the forward end to the rearward end of the slide, the length of the second lead-in portion being at least five times the width of said second laterally extending protrusion.

107. The slide of any one of clauses 105-106, wherein said second lead-in portion and said second laterally extending protrusion each have a length measured along a distance from the forward end to the rearward end of the slide, and wherein the length of said second lead-in portion is at least equal to the length of the second laterally extending protrusion.

108. The slide of any one of clauses 105-107, wherein said laterally-extending protrusion has a forward protrusion surface that faces the forward end of the slide.

109. The slide of clause 108, wherein said forward protrusion surface extends laterally outward with respect to the second lead-in portion.

110. The slide of any one of clauses 105-109, wherein a rearward edge of said laterally-extending protrusion is positioned at the rearward end of the slide.

111. The slide of any one of clauses 105-110, wherein said second lead-in portion includes a lateral surface, and wherein said lateral surface has a trapezoidal shape.

112. The slide of clause 111, wherein said second lead-in portion includes a lead-in bottom surface, wherein said is lead-in bottom surface extends from a bottom edge of said lateral surface, and wherein said lead-in bottom surface extends radially outward from said lateral surface.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The invention claimed is:

1. A firearm comprising:

a frame;

a slide positioned atop said frame, wherein said slide includes a slide top surface;

said slide top surface defining an optical sight mounting portion on said slide top surface, wherein said optical sight mounting portion includes an optical sight mounting surface integral with said slide, wherein said optical sight mounting surface defines a plurality of forward pin holes and a plurality of rear pin holes through said optical sight mounting surface and into the slide;

a plurality of first optical sight pins insertable into said plurality of forward pin holes;

a plurality of second optical sight pins insertable into said plurality of rear pin holes;

a first optical sight attachable to said slide top surface, wherein said first optical sight includes a plurality of first pin recesses defined through a bottom surface of said first optical sight;

wherein said plurality of first pin recesses receive a first portion of the first optical sight pins that extends above said optical sight mounting surface when said first optical sight is positioned on said optical sight mounting surface;

wherein forward pin holes of said plurality of forward pin holes are non-circular and receive a second portion of the first optical sight pins that does not extend above said optical sight mounting surface; and wherein said forward pin holes are larger than the second portion of the first optical sight pins received in said forward pin holes.

2. The firearm of claim 1, wherein said first optical sight pins are non-circular.

3. The firearm of claim 1, further comprising:

a plurality of first sight attachment holes defined through said optical sight mounting surface, wherein said plurality of first sight attachment holes are positioned rearward of said plurality of forward pin holes and positioned forward of said plurality of rear pin holes;

a plurality of second sight attachment holes defined through said optical sight mounting surface, wherein said plurality of second sight attachment holes are positioned rearward of said plurality of forward pin holes and positioned forward of said plurality of rear pin holes; and a plurality of plate attachment holes defined through said optical sight mounting surface, wherein said plurality of plate attachment holes are positioned rearward of said plurality of forward pin holes and positioned forward of said plurality of rear pin holes.

4. The firearm of claim 1, wherein said forward pin holes are blind holes that include a forward pin hole bottom surface.

5. The firearm of claim 1, wherein said rear pin holes are blind holes that include a rear pin hole bottom surface.

6. The firearm of claim 1, wherein a width of said forward pin holes as measured along the width of the firearm is greater than a width of said rear pin holes.

7. The firearm of claim 1, wherein the first optical sight includes a plurality of second pin recesses defined through a bottom surface of said first optical sight; and wherein the second pin recesses receive a portion of the second optical sight pins when said first optical sight is positioned on said optical sight mounting surface.

8. The firearm of claim 1, wherein each first optical sight pin of said plurality of first optical sight pins is configured to move relative to said optical sighting mounting surface when said first optical sight is positioned on said slide top surface.

9. A firearm comprising:

a frame;

a slide positioned atop said frame, wherein said slide includes a slide top surface;

an optical sight mounting portion defined by said slide top surface, wherein said optical sight mounting portion includes an optical sight mounting surface, wherein said optical sight mounting surface defines a plurality of forward pin holes and a plurality of rear pin holes extending into said slide;

a plurality of first optical sight pins insertable into said plurality of forward pin holes, and wherein portions of said first optical sight pins extend above said optical sight mounting surface when said first optical sight pins are positioned within said plurality of forward pin holes;

a plurality of second optical sight pins insertable into said plurality of rear pin holes, and wherein portions of said second optical sight pins extend above said optical sight mounting surface when said second optical sight pins are positioned within said plurality of rear pin holes;

wherein said plurality of forward pin holes are positioned forward of said plurality of rear pin holes on said optical sight mounting surface;

wherein forward pin holes of said plurality of forward pin holes are non-circular; and wherein said forward pin holes are larger than the portions of the first optical sight pins that do not extend above said optical sight mounting surface when said first optical sight pins are positioned within said forward pin holes.

10. The firearm of claim 9, wherein said forward pin holes are blind holes that include a forward pin hole bottom surface.

11. The firearm of claim 9, wherein said rear pin holes are blind holes that include a rear pin hole bottom surface.

12. The slide of claim 9, wherein a width of said forward pin holes as measured along the width of the firearm is greater than a width of said rear pin holes.

13. The firearm of claim 9, further comprising:

a plurality of first sight attachment holes defined through said optical sight mounting surface, wherein said plurality of first sight attachment holes are positioned rearward of said plurality of forward pin holes and positioned forward of said plurality of rear pin holes;

a plurality of second sight attachment holes defined through said optical sight mounting surface, wherein said plurality of second sight attachment holes are positioned rearward of said plurality of forward pin holes and positioned forward of said plurality of rear pin holes; and a plurality of plate attachment holes defined through said optical sight mounting surface, wherein said plurality of plate attachment holes are positioned rearward of said plurality of forward pin holes and positioned forward of said plurality of rear pin holes.

14. The slide of claim 9, wherein said forward pin holes of said plurality of forward pin holes are aligned along a first axis, wherein said rear pin holes of said plurality of rear pin holes are aligned along a second axis, and wherein said first axis is parallel to said second axis.

15. The firearm of claim 9, wherein each of said first optical sight pins is non-circular.

16. A slide of a firearm comprising:

a slide top surface;

an optical sight mounting portion defined by said slide top surface, wherein said optical sight mounting portion includes an optical sight mounting surface;

a plurality of forward pin holes defined through said optical sight mounting surface and into said slide;

a plurality of rear pin holes defined through said optical sight mounting surface and into said slide;

a plurality of first sight attachment holes defined through said optical sight mounting surface and into said slide;

a plurality of second sight attachment holes defined through said optical sight mounting surface and into said slide;

a plurality of plate attachment holes defined through said optical sight mounting surface and into said slide;

a plurality of first optical sight pins insertable into said plurality of forward pin holes, and wherein portions of said first optical sight pins extend above said optical sight mounting surface when said first optical sight pins are positioned within said forward pin holes;

wherein said plurality of forward pin holes are positioned forward of the plurality of rear pin holes on said optical sight mounting surface;

wherein said plurality of first sight attachment holes, said plurality of second sight attachment holes; and said plurality of plate attachment holes are positioned rearward of said plurality of forward pin holes on said optical sight mounting surface; and wherein said plurality of first sight attachment holes, said plurality of second sight attachment holes; and said plurality of plate attachment holes are positioned forward of said plurality of rear pin holes on said optical sight mounting surface;

wherein forward pin holes of said plurality of forward pin holes are non-circular; and wherein said forward pin holes are larger than portions of the first optical sight pins that do not extend above said optical sight mounting surface when said first optical sight pins are positioned within said forward pin holes.

17. The slide of claim 16, wherein said forward pin holes are blind holes.

18. The slide of claim 17, wherein said rear pin holes are blind holes.

19. The slide of claim 16, wherein a width of said forward pin holes as measured along the width of the firearm is greater than a width of said rear pin holes.

20. The slide of claim 16, wherein said forward pin holes are aligned along a first axis, wherein said rear pin holes are aligned along a second axis, and wherein said first axis is parallel to said second axis.

21. The slide of claim 20, wherein said first sight attachment holes are aligned along a third axis, wherein said second sight attachment holes are aligned along a fourth axis, wherein said plate attachment holes are defined along a fifth axis, and wherein said third axis is parallel to said fourth axis and said fifth axis.

* * * * *